US005331383A

United States Patent [19]

Nou et al.

[11] Patent Number: 5,331,383

[45] Date of Patent: Jul. 19, 1994

[54] CONDUCTIVE ROLLER TRANSFER DEVICE WITH IMPROVED TRANSFER EFFICIENCY AND POLLUTION CONTROL

[75] Inventors: Hiroshi Nou; Masahiro Wanou, both of Kawasaki; Masashi Ogasawara, Zama; Masae Ikeda, Kawasaki; Nobuo Suematsu, Kawasaki; Shino Sakai, Kawasaki; Akihiko Ishii, Kawasaki; Hideki Kamaji, Kawasaki, all of Japan

[73] Assignee: Fujitsu Limited, Kawasaki, Japan

[21] Appl. No.: 909,036

[22] Filed: Jul. 6, 1992

[30] Foreign Application Priority Data

| | | | |
|---|---|---|---|
| Jul. 6, 1991 | [JP] | Japan | 3-165996 |
| Jul. 6, 1991 | [JP] | Japan | 3-165997 |
| Jul. 6, 1991 | [JP] | Japan | 3-166012 |
| Jul. 6, 1991 | [JP] | Japan | 3-166014 |
| Oct. 25, 1991 | [JP] | Japan | 3-278147 |
| Dec. 11, 1991 | [JP] | Japan | 3-327267 |

[51] Int. Cl.[5] ..... G03G 15/16

[52] U.S. Cl. ..... 355/274; 355/219

[58] Field of Search ..... 355/271, 273, 274, 275, 355/276, 219, 203, 208; 361/221, 225, 235

[56] References Cited

U.S. PATENT DOCUMENTS

| | | | |
|---|---|---|---|
| 3,781,105 | 12/1973 | Meagher | 355/274 |
| 4,309,803 | 1/1982 | Blaszak | 29/130 |
| 4,959,688 | 9/1990 | Koitabashi | 355/219 |
| 5,034,777 | 7/1991 | Ohzeki et al. | 355/274 |
| 5,151,736 | 9/1992 | Ohzeki et al. | 355/274 X |
| 5,179,397 | 1/1993 | Ohzeki et al. | 355/271 X |
| 5,182,604 | 1/1993 | Asai | 355/273 |
| 5,196,885 | 3/1993 | Takeuchi et al. | 355/219 |

FOREIGN PATENT DOCUMENTS

| | | |
|---|---|---|
| 0323226 | 12/1988 | European Pat. Off. . |
| 0323252 | 12/1988 | European Pat. Off. . |
| 0367245 | 10/1989 | European Pat. Off. . |
| 0391306 | 4/1990 | European Pat. Off. . |
| 0395061 | 4/1990 | European Pat. Off. . |
| 0397501 | 5/1990 | European Pat. Off. . |
| 0422527 | 2/1991 | European Pat. Off. . |
| 51-9840 | 1/1976 | Japan . |
| 1-85572 | 7/1989 | Japan . |
| 1-185572 | 7/1989 | Japan . |
| 1-292385 | 11/1989 | Japan . |
| 2-123385 | 5/1990 | Japan . |
| 3-156480 | 7/1991 | Japan . |
| 3-248181 | 11/1991 | Japan . |

OTHER PUBLICATIONS

European Search Report.

*Primary Examiner*—A. T. Grimley
*Assistant Examiner*—William J. Royer
*Attorney, Agent, or Firm*—Staas & Halsey

[57] ABSTRACT

A toner image transferring device has a roller formed of a conductive rubber foam material having a resistivity of more than $10^7$ Ωcm. In a toner image transferring process, a constant current is applied to the roller, whereby a charged toner image can be transferred to a sheet or paper at a desired toner transfer efficiency regardless of a size of the paper or sheet. To remove a toner pollution of the roller, a constant voltage having a polarity opposite to that of the charged toner is applied to the roller. The roller is constituted such that pore openings appear over a surface of the roller, whereby a residual part of a toner polluting the roller will not leave a stain on a rear surface of the sheet or paper.

28 Claims, 44 Drawing Sheets

*1
*2
1003
F1 = "0" ?
NO
YES
1004
DRIVE SIGNAL DS40 IS MADE "H"
1005
DRIVE SIGNAL DS44 IS MADE "H"
1006
F1 ← 1
1007
F2 = "0" ?
1008
C ← C + 1
1009
C ≥ T1 ?
1010
ON/OFF SIGNAL OS20 IS MADE "H"
1022
IS PRINTING COMMAND SIGNAL MADE "H" ?
1023
F1 = "0" ?
1024
DRIVE SIGNAL DS40 IS MADE "H"
1025
F1 ← 1
1026
F2 = "0" ?
1027
C ← C + 1
1028
C ≥ T3 ?

※4
※5
DRIVE SIGNAL DS48 IS MADE "H"
1036
C ← 0
1037
F3 ← 1
1038
F4 = "0" ?
1039
NO
YES
C ← C + 1
1040
C ≧ T5 ?
1041
NO
YES
ON/OFF SIGNAL OS50 IS MADE "H"
1042
C ← 0
1043
F4 ← 1
1044

7
8
POLARITY CHANGING SIGNAL PS20 IS MADE "H"
1058
C ← 0
1059
F7 ← 1
1060
IS ONE PAGE IMAGE WRITING COMPLETED ?
1061
NO
YES
IS PRINTING COMMAND SIGNAL MADE "H" ?
1062
NO
YES
F8 = "0" ?
1063
NO
YES

※8
※9
1064
C ← C + 1
1065
C ≧ T8 ?
NO
YES
1066
DRIVE SIGNAL DS54 IS MADE "L"
1067
C ← 0
1068
F8 ← 1
1069
F9 = "0" ?
NO
YES
1070
IS LATENT IMAGE WRITING POSSIBLE ?
NO
YES
1086
F8 = "0" ?
NO
YES
1087
C ← C + 1
1088
C ≧ T11 ?
NO
YES
1089
DRIVE SIGNAL DS54 IS MADE "L"
1090
C ← 0
1091
F8 ← 1

CONDUCTIVE ROLLER TRANSFER DEVICE WITH IMPROVED TRANSFER EFFICIENCY AND POLLUTION CONTROL

BACKGROUND OF THE INVENTION

1) Field of the Invention

The present invention relates to a toner image transferring device for electrostatically transferring a toner image from a toner image carrying body such as a photosensitive drum, a dielectric drum, a dielectric belt or the like to a sheet or paper. The present invention also relates to an electrophotographical recording apparatus such as a laser printer in which such a toner image transferring device is incorporated.

2) Description of the Related Art

For example, the toner image transferring device is incorporated in an electrophotographic printer which typically carries out the processes of: producing a uniform distribution of electrical charges on a surface of a rotary photosensitive drum; forming an electrostatic latent image on the electrically charged surface of the photosensitive drum by optically writing an image thereon with a laser beam scanner, an LED (light emitting diode) array, an LCS (liquid crystal shutter) array or the like; visually developing the electrostatic latent image with a developer, i.e., toner, which is electrically charged to be electrostatically adhered to the electrostatic latent image zone; electrostatically transferring the developed visible image or toner image from the drum to a sheet or paper; and fixing the transferred image on the sheet or paper.

In the transferring process, the transfer of the toner image from the photosensitive drum to the paper is carried out by feeding an electric charge to the paper. Conventionally, the toner image transferring device comprises an electric discharger such as a corona discharger for feeding the electric charge to the paper. Namely, the discharger is disposed in the vicinity of the photosensitive drum, the paper is introduced into a clearance therebetween, and the discharger gives the paper an electric charge having a polarity opposite to that of the electric charge of the toner image, whereby the toner image is electrostatically transferred from the drum to the sheet or paper.

The electric discharger has an inherent defect that ozone is produced during the energizing thereof. Not only is ozone injurious to the health, but also it causes a premature deterioration of the photosensitive drum and other parts of the printer. Also, the use of the electric discharger results in an increase in the production cost of the printer, because it must be provided with a high voltage electric power source for the electric discharger and an ozone filter for preventing an ozone leakage.

For this reason, a conductive roller type toner image transferring device has been recently used in the electrophotographic printer. This type of toner image transferring device comprises a conductive elastic transfer roller pressed against a surface of the photosensitive drum and rotated at the same peripheral speed as the drum, and while a sheet or paper is passed through a nip between the conductive transfer roller and the drum, the conductive transfer roller is supplied with an electric energy to give the paper an electric charge having a polarity opposite to that of the charge of the toner image. Note, in general, an electric source for supplying the electric energy to the conductive transfer roller has a lower power than that of the electric discharger.

Note, the quality of a transferred toner image depends upon an efficiency of the transfer of the toner image from the photosensitive drum to the paper, and the toner transfer efficiency is governed by various factors such as a nature of the electric source, a resistivity of the conductive transfer roller, and a nature of a paper to which the toner image is transferred. Accordingly, these factors should be determined so that it is possible to obtain a reasonable transfer efficiency to produce a transferred toner image quality at least passable in practical use. If only one kind of paper having the same size is used in the printer, it is very easy to determine other factors such that the reasonable transfer efficiency can be obtained, but when various kinds of papers having a different size are actually used in the printer, it is very difficult to suitably and properly determine the nature of the electric source and the resistivity of the conductive transfer roller such that the reasonable transfer efficiency can be obtained with respect to the papers having a different size.

Also, the conductive transfer roller has an inherent defect in that it is easily polluted by residual toner particles on the photosensitive drum. Furthermore, when a paper cannot reach the nip between the conductive transfer roller and the photosensitive drum due, for example, to jamming, the toner image is directly transfered to the conductive transfer roller, and thus this roller is greatly polluted by the transferred toner image. Of course, the polluted conductive transfer roller leaves a stain on a rear surface of a paper during a passage of the paper through the nip between the roller and the drum, and accordingly, the conductive transfer roller must be frequently cleaned in such a manner that it leaves no stain on the rear surface of the paper. Nevertheless, a conventional conductive transfer roller type toner image transferring device fails to clean the polluted conductive transfer roller in the manner such that it cannot leave any stain on the rear surface of the paper, as discussed in detail hereinafter.

SUMMARY OF THE INVENTION

Therefore, an object of the present invention is to provide a conductive transfer roller type toner image transferring device constituted such that the reasonable transfer efficiency can be obtained with respect to various papers having different sizes.

Another object of the present invention is to provide a conductive transfer roller type toner image transferring device constituted such that a polluted conductive transfer roller cannot leave a stain on a rear surface of a paper during a toner image transferring process.

Yet another object of the present invention is to provide an electrophotographic recording apparatus in which a conductive transfer roller type toner image transferring device as mentioned above is used.

In accordance with one aspect of the present invention, there is provided a toner image transferring device for electrostatically transferring a charged toner image electrostatically held by a toner image carrying body means to a sheet or paper, which comprises: a conductive elastic transfer roller means having a resistivity of more than $10^7$ Ωcm and disposed in contact with the toner image carrying body means to form a nip therebetween for passing the sheet or paper; and an electric source means for applying a substantially constant current output to the conductive elastic transfer roller means, to thus give the sheet or paper an electric charge having a polarity opposite to that of a charge of the toner image, during a passage of the sheet or paper through the nip between the toner image carrying body means and the conductive elastic transfer roller means, whereby the charged toner image can be transferred from the toner image carrying body means to the sheet or paper at a desired toner transfer efficiency regardless of a size of the paper or sheet.

In this toner image transferring device, the resistivity of the conductive elastic transfer roller means is preferably from about $10^8$ to about $10^{11}$ Ωcm, and the electric source means is preferably constituted such that the constant current output thereof has a voltage of less than 3k volts.

According to another aspect of the present invention, there is provided a toner image transferring device for electrostatically transferring a charged toner image electrostatically held by a toner image carrying body means to a sheet or paper, which comprises: a conductive elastic transfer roller means disposed in contact with the toner image carrying body means to form a nip therebetween for passing the sheet or paper; and an electric source means for selectively applying a first electric energy and a second electric energy to the conductive elastic transfer roller means, the first electric energy giving the sheet or paper an electric charge having a polarity opposite to that of a charge of the toner image, during a passage of the sheet or paper through the nip between the toner image carrying body means and the conductive elastic transfer roller means, whereby the charged toner image can be transferred from the toner image carrying body means to the sheet or paper, the second electric energy giving the conductive elastic transfer roller means an electric charge having the same polarity as the charge of the toner image, whereby a toner pollution of the conductive elastic transfer roller means can be electrostatically removed therefrom, wherein the conductive elastic transfer roller means is formed of a conductive foam rubber material such that pore openings appear over a surface of the conductive elastic transfer roller means, whereby a residual part of the toner pollution of the conductive elastic transfer roller means can leave no stain on a rear surface of the sheet or paper during the passage of the sheet or paper through the nip between the toner image carrying body means and the conductive elastic transfer roller means.

In this toner image transferring device, preferably, the conductive foam rubber material has a closed cell foam structure. The electric source means may include a constant current source having a substantially constant current output as the first electric energy, and a constant voltage source having a substantially constant voltage output as the second electric energy. Preferably, an electric potential of the toner image carrying body means is preferably maintained at substantially zero during the application of the constant voltage output to the conductive elastic transfer roller means. The application of the constant voltage output to the conductive elastic transfer roller means is preferably continued over a time necessary for rotating the conductive elastic transfer roller means at least five times, whereby the removal of the toner pollution can be effectively carried out. After the application of the constant voltage output to the conductive elastic transfer roller means is finished, the conductive elastic transfer roller means is preferably subjected to an application of a voltage output having a polarity opposite to that of the constant voltage output over a time necessary for rotating the conductive elastic transfer roller means at least one time. The voltage output having the polarity opposite to that of the constant voltage output may be derived from the constant current source. The electric source means also may include a single current source capable of selectively generating one of a substantially constant current output as the first electric energy and a constant voltage source having a substantially constant voltage output as the second electric energy.

According to yet another aspect of the present invention, an electrophotographic recording apparatus comprising: an photosensitive body means on which an electrically charged area can be produced; an optical writing means for optically writing a latent image on the charged area of the photosensitive body means; a toner developing means for electrostatically developing the latent image with an electrically charged toner to form a charged toner image thereon; a conductive elastic transfer roller means disposed in contact with the photosensitive body means to form a nip therebetween for passing a sheet or paper; and an electric source means for selectively applying a first electric energy and a second electric energy to the conductive elastic transfer roller means, the first electric energy giving the sheet or paper an electric charge having a polarity opposite to that of a charge of the toner image, during passage of the sheet or paper through the nip between the photosensitive body means and the conductive elastic transfer roller means, whereby the charged toner image can be transferred from the photosensitive body means to the sheet or paper, the second electric energy giving the conductive elastic transfer roller means an electric charge having the same polarity as the charge of the toner image, whereby a toner pollution of the conductive elastic transfer roller means can be electrostatically removed therefrom, wherein an electric potential of the photosensitive body means is maintained at substantially zero by the optical writing means during the application of the second electric energy to the conductive elastic transfer roller means for the removal of the toner pollution therefrom. This electrophotographic recording apparatus may further comprises means for preventing the charged toner of the developing means from coming into contact with the photosensitive body means.

BRIEF DESCRIPTION OF THE DRAWINGS

Other objects and advantages of the present invention will be better understood from the following description, with reference to the accompanying drawings, in which:

FIG. 3(*b*) is a block diagram of an electric power device used in the toner image transferring device according to the present invention;

FIG. 4(*b*) is a graph showing a relationship between a transfer voltage and a toner transfer efficiency with respect to a resistivity of the conductive transfer roller;

FIG. 5(*b*) is a graph showing a relationship between a transfer charge density and a toner transfer efficiency with respect to a resistivity of a conductive transfer roller;

FIG. 6(*b*) is another graph showing a relationship between a transfer current and a toner transfer efficiency with respect to a width of a paper and a resistivity of a conductive transfer roller;

FIG. 6(*c*) is yet another graph showing a relationship between a transfer current and a toner transfer efficiency with respect to a width of a paper and a resistivity of a conductive transfer roller;

FIG. 8(*b*) is a graph showing an I–V characteristic of the circuit diagram shown in FIG. 8(*a*);

FIG. 12(*b*) is a time chart showing a modification of FIG. 12(*a*);

FIG. 13(*b*) is a graph showing a relationship between a number of revolutions of a conductive transfer roller and a cleaning efficiency and a stain optical density;

FIG. 19(*b*) is a view similar to FIG. 19(*a*), showing the developing device moved to a different position;

FIG. 20(*b*) is a graph showing a V-I characteristic of the circuit diagram shown in FIG. 20(*a*);

FIG. 22(*b*) is a perspective view showing a conductive elastic transfer roller used in the toner image transferring device shown in FIG. 22(*a*).

DESCRIPTION OF THE PREFERRED EMBODIMENTS

Figure 1:
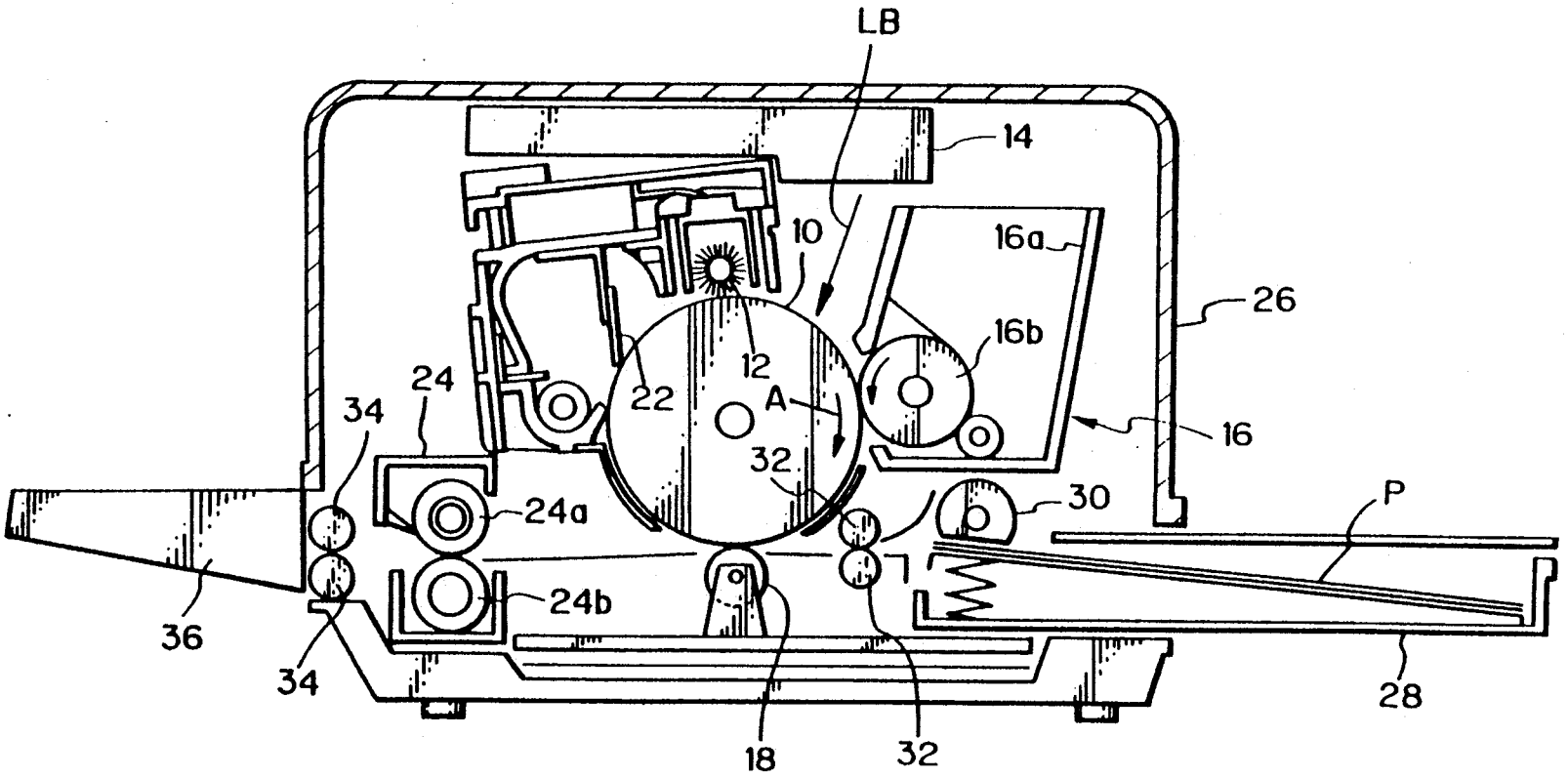
FIG. 1 is a longitudinal cross-sectional view showing a laser printer in which a conductive roller type toner image transferring device according to the present invention is used.
Figure 2:
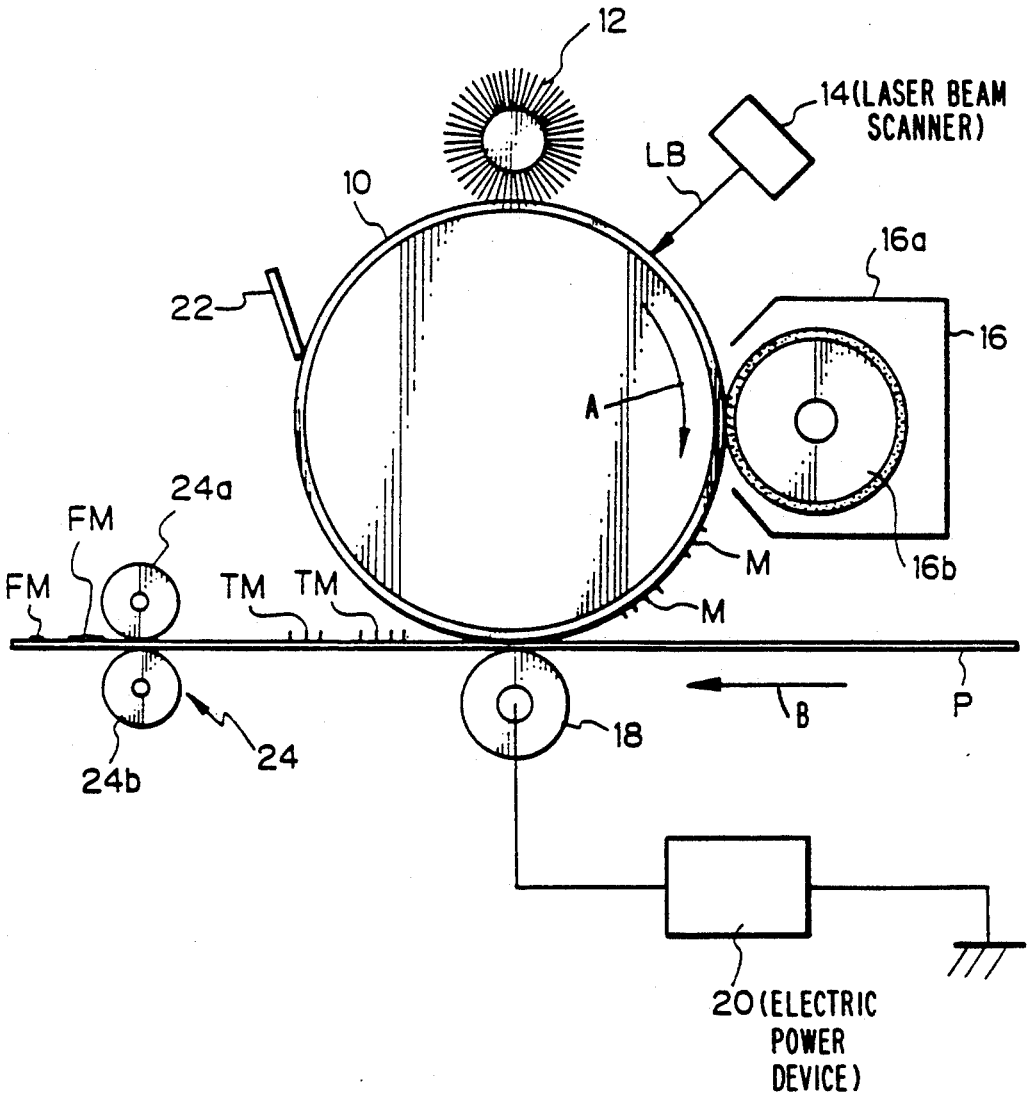
FIG. 2 is a schematic arrangement view of main elements of the laser printer shown in FIG. 1.

FIG. 1 shows an electrophotographic laser printer to which a conductive roller type toner image transferring device according to the present invention is applied, and FIG. 2 schematically shows main elements of the laser printer shown in FIG. 1. As shown in FIG. 2, the laser printer includes the eight main elements: a toner image carrying body or rotary photosensitive drum 10; a conductive brush type charger 12; an optical latent image writing means or laser beam scanner 14; a toner developing device 16; a conductive roller type transfer device 18; an electric power device 20; a toner cleaner 22; and a toner image fixing device 24. As shown in FIG. 1, the elements 10, 12, 14, 16, 18, 20, 22 and 24 are housed by a movable housing cover 26, but these elements are accessible by opening the housing cover 26. During an operation of the printer, the drum 10 is rotated in a direction as indicated by an arrow A. The laser printer also includes a paper feeder cassette 28 having a paper feeder roller 30 and a pair of register rollers 32, 32. A stack of sheets or papers is received in the cassette 28, and a sheet or paper P to be printed is fed by the feeder roller 30. The fed paper P is once stopped at the register rollers 32, 32 and is then introduced into a nip between the drum 10 and the conductive transfer roller 18 at a given timing, in a direction as indicated by an arrow B (FIG. 2). The printer further includes a pair of paper discharging rollers 34, 34 and a paper receiving tray 36. A printed paper is discharged from a printer housing onto the tray 36 by the paper discharging rollers 34, 34.

The photosensitive drum 10 may be formed of an aluminum cylindrical hollow body and a photoconductive film composed of an organic photoconductor (OPC) and bonded to a surface of the hollow body. For example, the drum 10 may have a diameter of 40 mm and a width 279 mm equal to that of an A3-size paper, and during the rotation thereof, the drum 10 may have a peripheral speed of 70 mm/s.

The conductive brush 12 is formed of a plurality of conductive filaments, and is rotated such that the free ends of the filaments are in contact with the photosensitive drum 10. Also, the brush 12 is connected to a electric power source (not shown in FIGS. 1 and 2) to give electric charges to the photoconductive insulating film of the drum 10, so that a uniform distribution of the charges is produced on the photoconductive film of drum 10. For example, the charged area of the drum 10 may have a potential of about −600 volts, and is scanned by a laser beam LB emitted from the laser beam scanner 14, and the laser beam LB is switched on and off on the basis of binary image data obtained from, for example, a word processor, personal computer or the like, so that an electrostatic latent image is written as a dot image on the charged area of the drum 10.

The toner developing device 16 comprises a vessel 16*a* for holding a developer or toner, and a developing roller 16*b* provided within the vessel 16*a* in such a manner that a portion of the developing roller 16*b* is exposed therefrom and faces the surface of the photosensitive drum 10. In this embodiment, a non-magnetic type one-component developer composed of colored fine synthetic resin particles is used, and these toner particles are electrically charged at the same polarity as that of the charged area of the drum 10. For example, the developer may have an average charge of about −10 μC/g. Note, a triboelectrification and/or a charge-injection effect, as disclosed in U.S. Pat. Nos. 5,057,871 and 5,062,385, may be utilized for the charge of the toner particles. Also, the developing roller 16*b* is preferably formed of a conductive foam rubber material as disclosed in the above-mentioned two U.S. Patents. The developing roller 16*b* is resiliently pressed against the photosensitive drum 10 to form a developing area therebetween, and is rotated so that the toner particles are entrained by a surface of the developing roller 16*b*, and is carried to the developing area. The developing roller 16*b* is connected to a voltage power source (not shown in FIGS. 1 and 2) so that a developing bias voltage of, for example, −500 volts is supplied thereto. In the developing area, the toner particles are electrostatically attracted only to the latent image zone due to the supply of the developing bias voltage, whereby the latent image is developed as a visible image M (FIG. 2).

Note, in place of the developing device 16 using the non-magnetic type one-component developer, another type developing device using a magnetic type one-component developer or a two-component developer composed of a toner component (colored fine synthetic resin particles) and a magnetic component (magnetic fine carrier) may be incorporated in the printer.

Figure 3A:
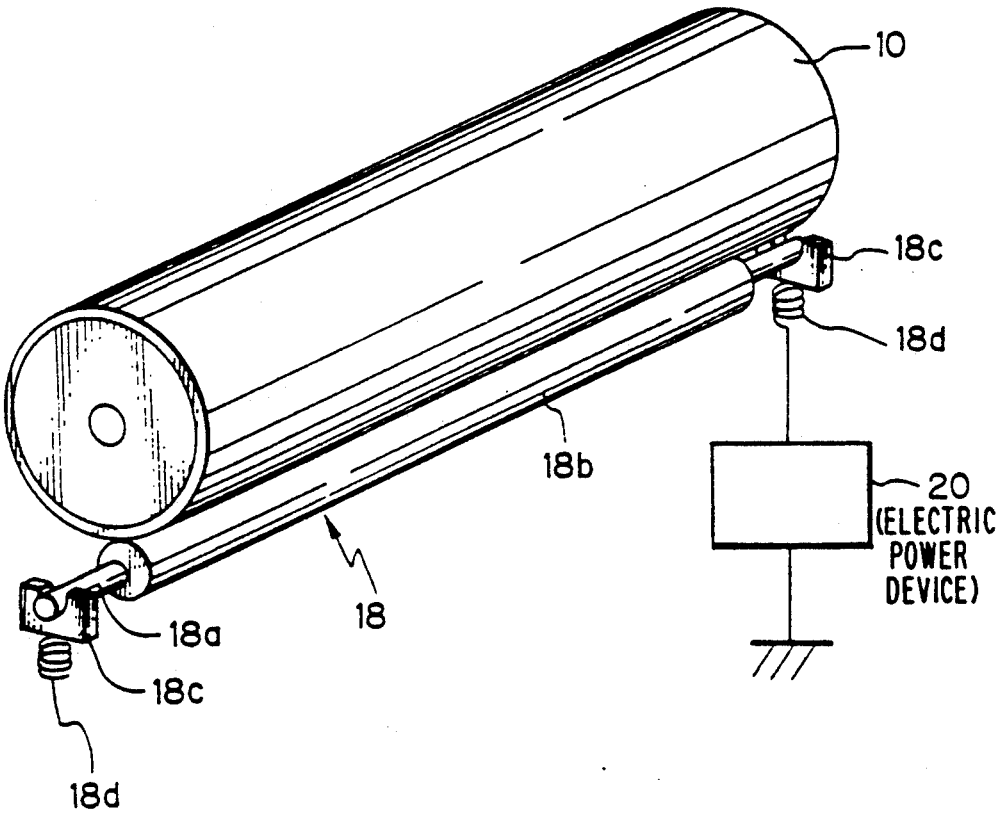
FIG. 3(*a*) is a perspective view showing a conductive elastic transfer roller used in the toner image transferring device shown in FIGS. 1 and 2.
Figure 3B:
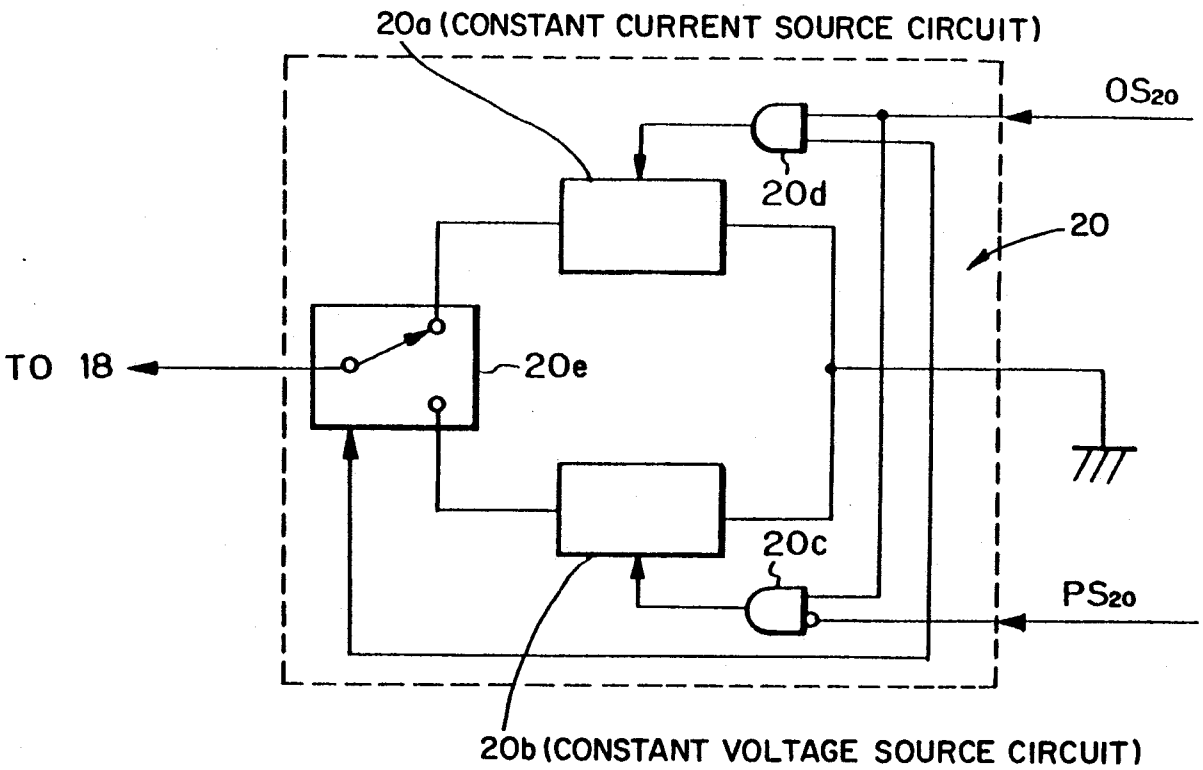

As best shown in FIG. 3(*a*), the conductive transfer roller 18 comprises a shaft element 18*a* made of a conductive material such as a metal, and a roller element 18*b* mounted on the shaft element 18*a*. The roller element 18*b* is formed of a conductive foam rubber material, which may be composed of a synthetic rubber such as a polyurethane rubber, a silicone rubber, an ethylene-propylene rubber or the like, and a conductive filler such as carbon black. The transfer roller 18 is supported at the ends of the shaft element 18*a* by a pair of movable bearings 18*c*, 18*c*, and is resiliently pressed against the photosensitive drum 10 by a pair of coil springs 18*d*, 18*d* acting on the movable bearings 18*c*, 18*c*, respectively. The transfer roller 18 is connected to the electric power device 20 through the intermediary of one of the bearings 18*c*, 18*c* and the corresponding coil spring 18*d*.

In this embodiment, the electric power device 20 includes a constant current source circuit 20*a*, a constant voltage source circuit 20*b*, a switching circuit 20*c*, an AND gate circuit 20*d*, and a gate circuit 20*e*, as shown in FIG. 3(*b*). The source circuits 20*a* and 20*b* are constituted so as to output a constant current of, for example, about 10 μA, and a constant voltage of, for example, about −500 volts, respectively, and only one of the outputs of the source circuits 20*a* and 20*b* is selected by the switching circuit 20*c*. In particular, when an ON/OFF signal $OS_{20}$ and a polarity changing signal $PS_{20}$ are changed from a low level "L" to a high level "H", the AND gate circuit 20*d* is opened so that a high level signal is output from the AND gate circuit 20*d* to the constant current source circuit 20*a*, whereby the constant current is output from the constant current source circuit 20*a*. Also, when the polarity changing signal $PS_{20}$ is at the high level "H", the switching circuit 20*c* makes a connection between the constant current source circuit 20*a* and the transfer roller 18, as shown in FIG. 3(*b*), and thus the constant current is supplied from the constant current source circuit 20*a* to the transfer roller 18. On the other hand, when the ON/OFF signal $OS_{20}$ is at the high level "H", and when the polarity changing signal $PS_{20}$ is at the low level "L", the gate circuit 20*e* is opened so that a high level signal is output from the gate circuit 20*e* to the constant voltage source circuit 20*b*, whereby the constant voltage is output from the constant voltage source circuit 20*b*. Also, when the polarity changing signal $PS_{20}$ is at the high level "H", the switching circuit 20*c* makes a connection between the constant voltage source circuit 20*b* and the transfer roller 18. Thus, the constant voltage is supplied from the constant voltage source circuit 20*b* to the transfer roller 18. Note, when the signals $OS_{20}$ and $PS_{20}$ are both at the low level "L", each of the gate circuits 20*d* and 20*e* outputs a low level signal to the corresponding source circuit 20*a*, 20*b*, so that no electric energy is output from the source circuit 20*a*, 20*b*, whereby the transfer roller 18 cannot be electrically energized.

As mentioned above, the paper P to be printed is introduced into the nip between the photosensitive drum 10 and the transfer roller 18 at the given timing by the register rollers 32, 32, and just after a leading edge of the paper P is passed through the nip between the photosensitive drum 10 and the transfer roller 18, the constant current of about 10 μA is supplied from the constant current source circuit 20*a* of the electric power device 20 to the transfer roller 18, so that the developed toner images M can be electrostatically transferred to the paper P (FIG. 2).

The paper P having the transfered toner images TM is then fed to the toner image fixing device 24 including a heat roller 24*a* and a backup roller 24*b*. When the paper P is passed through a nip between the rollers 24*a* and 24*b*, the transferred toner image TM is thermally fused due to the heat roller 24*a*, and thus the fused toner image is fixed as a fixed toner image FM on the paper P (FIG. 2). The printed paper having the fixed toner image FM is then discharged from the printer housing onto the tray 36 by the paper discharging rollers 34, 34, as mentioned above.

In the toner image transferring process, the developed toner images M cannot be completely transferred from the photosensitive drum 10 to the paper P. Namely, a part of the developed toner images M is inevitably left as residual toner particles on the surface of the drum 10. Although the residual toner particles are removed from the drum surface by a scraper blade of the toner cleaner 22, a small amount of toner particles is still left as residual toner particles on the drum surface, and when these toner particles come into direct contact with the transfer roller 18, a surface of the roller element 18*b* is polluted with the residual toner particles. Although the pollutant of the transfer roller 18 is initially very small, the amount of the pollutant becomes gradually greater as long as the toner particles are not removed from the transfer roller 18, so that the polluted transfer roller 18 leaves a stain on a rear surface of a paper during the toner image transferring process.

To perform the cleaning process of the conductive transfer roller 18, a constant voltage of 500 volts is output from the constant voltage source circuit 20*b* of the electric power device 20 to the polluted transfer roller 18, so that the toner particles, by which the transfer roller 18 is polluted, can be electrostatically returned to the photosensitive drum 10. Note, the returned toner particles are removed from the drum surface by the toner cleaner 22.

According to one aspect of the present invention, the transfer roller 18 is constituted such that the conductive roller element 18*b* has a resistivity of more than $10^7$ Ωcm, preferably from about $10^9$ to about $10^{11}$ Ωcm, whereby it is possible to obtain a reasonable toner transfer efficiency of at least more than 75% m, regardless of a thickness and a width of a paper to be printed, as discussed below.

Note, in general, a quality of a transferred toner image depends upon a toner transfer efficiency $\eta$, which is defined by the following formula:

$$\eta = T_1/T_0 \times 100\ (\%)$$

wherein: $T_0$ is an amount of toner held in a solid state on a photosensitive drum, and $T_1$ is an amount of toner transferred from the drum to a paper. In practice, it is difficult to measure the amounts of toner $T_1$ and $T_0$ placed on the drum-and the paper.

Thus, the toner transfer efficiency $\eta$ is determined from the fact that an amount of toner is proportional to an optical density. Namely, the toner transfer efficiency n may be defined by the following formula:

$$\begin{aligned}\eta &= OD_1/OD_0 \times 100\ (\%)\\ &= OD_1/(OD_1 + OD_2) \times 100\ (\%)\end{aligned}$$

Wherein: $OD_0$ is an optical density derived from an amount of toner held in a solid state on the drum; $OD_1$ is an optical density derived from an amount of toner H 35 transferred from the drum to the paper; and $OD_2$ is derived from an amount of toner left on the drum after the toner transferring process.

Figure 4A:
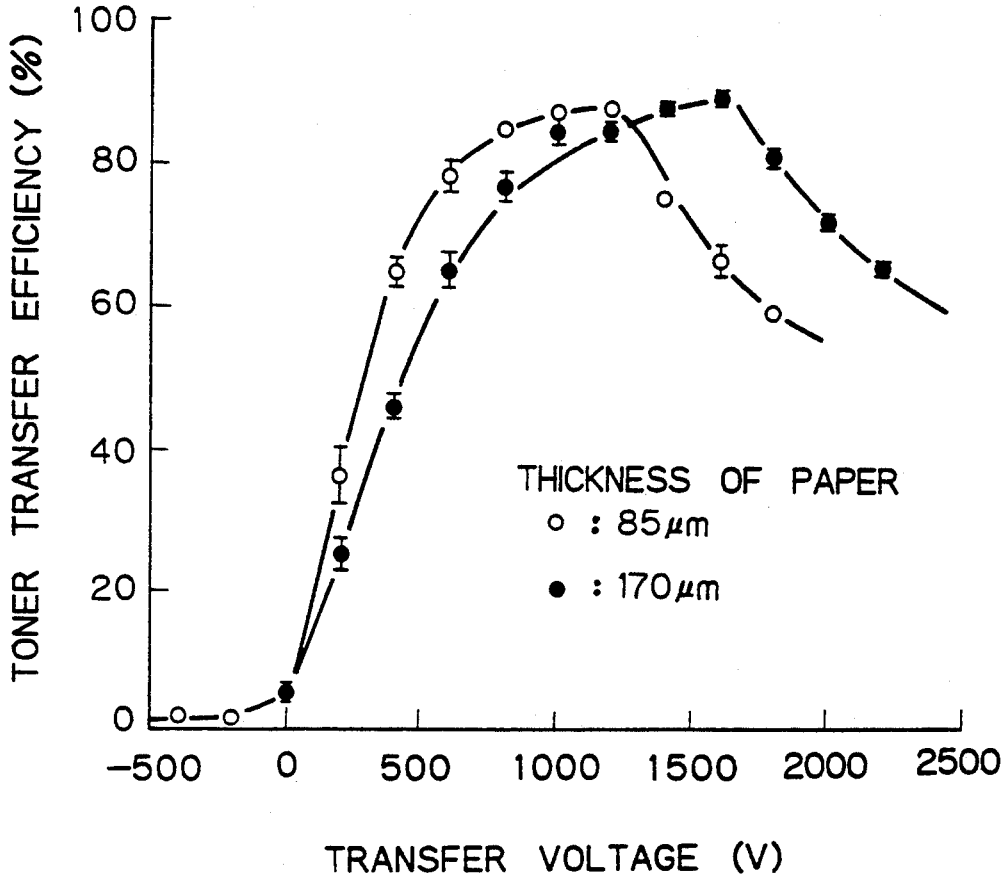
FIG. 4(*a*) is a graph showing a relationship between a transfer voltage and a toner transfer efficiency with respect to a thickness of a paper.
Figure 4B:
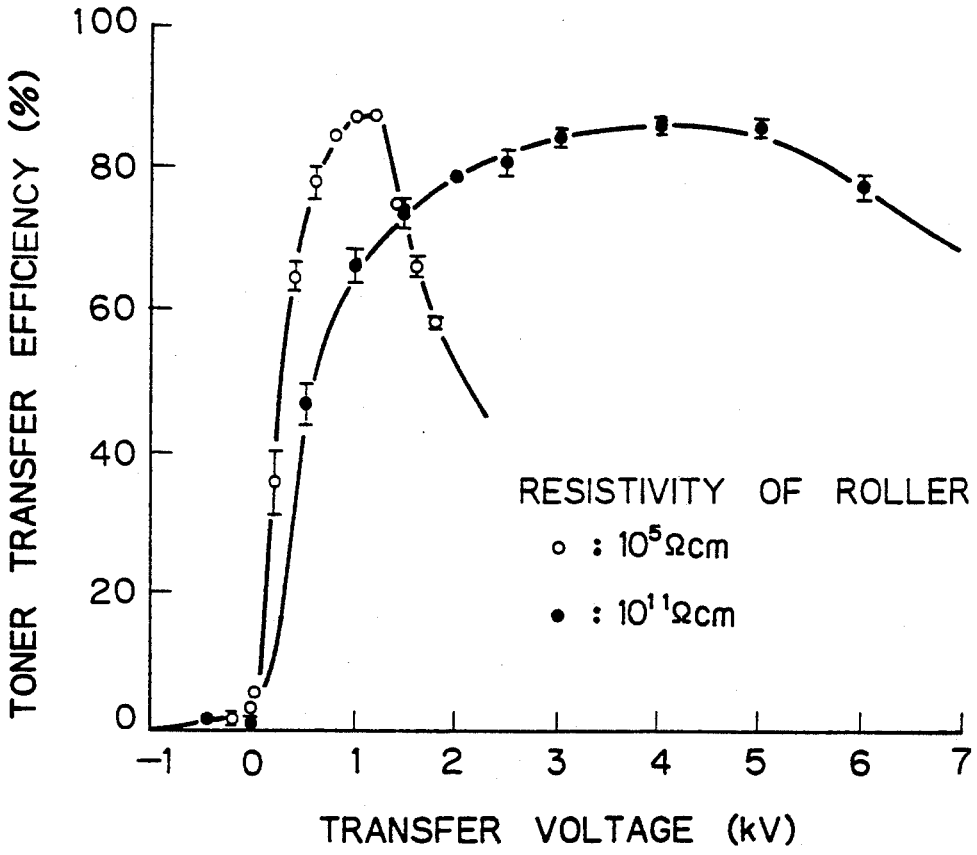

In a toner image transferring process, if a constant transfer voltage is supplied to a conductive foam rubber transfer roller, a toner transfer efficiency considerably varies in accordance with a thickness of a paper, as shown in a graph of FIG. 4(*a*). As apparent from this graph, for example, when a transfer voltage of about 750 volts is applied to the conductive transfer roller, a toner transfer efficiency of about 70% is obtained with respect to a paper having a thickness of ⅜μm, whereas a toner transfer efficiency of about 83% is obtained with respect to a paper having a thickness of 85 μm. Only when a constant transfer voltage of about 1250 volts is applied to the conductive transfer roller, a toner transfer efficiency of about 85% can be obtained with respect to the two papers having thicknesses of 85 μm and 170 μm, respectively. Accordingly, when the transfer voltage is supplied to the conductive transfer roller, it is necessary to adjust a value of the transfer voltage in accordance with a thickness of the paper before the reasonable toner transfer efficiency can be obtained with respect to the paper having a different thickness. Note, this adjustment is very difficult in practice.

When the constant transfer voltage is supplied to the conductive transfer roller in the toner transferring process, a toner transfer efficiency also varies in accordance with a resistivity of the conductive transfer roller, as shown in a graph of FIG. 4(*b*). As apparent from this graph, when the conductive transfer roller has a resistivity of $10^5$ Ωcm, the toner transfer efficiency has the maximum peak of about 84% at a transfer voltage of about 1k volts. When the conductive transfer roller has a resistivity of $10^{11}$ Ωcm, the toner transfer efficiency has a substantially flat maximum range of from a transfer voltage of about 3k volts to 5k volts. In general, in the production of a conductive foam rubber material of which the conductive transfer roller is formed, it is difficult to maintain a resistivity of the foam rubber material at constant value. Namely, when many conductive foam rubber transfer rollers are produced, a resistivity of the rollers is variable within a permissible range. Accordingly, the conductive transfer roller should be formed of a conductive foam rubber material having a higher resistivity, before a stable toner transfer efficiency can be obtained.

Figure 5A:
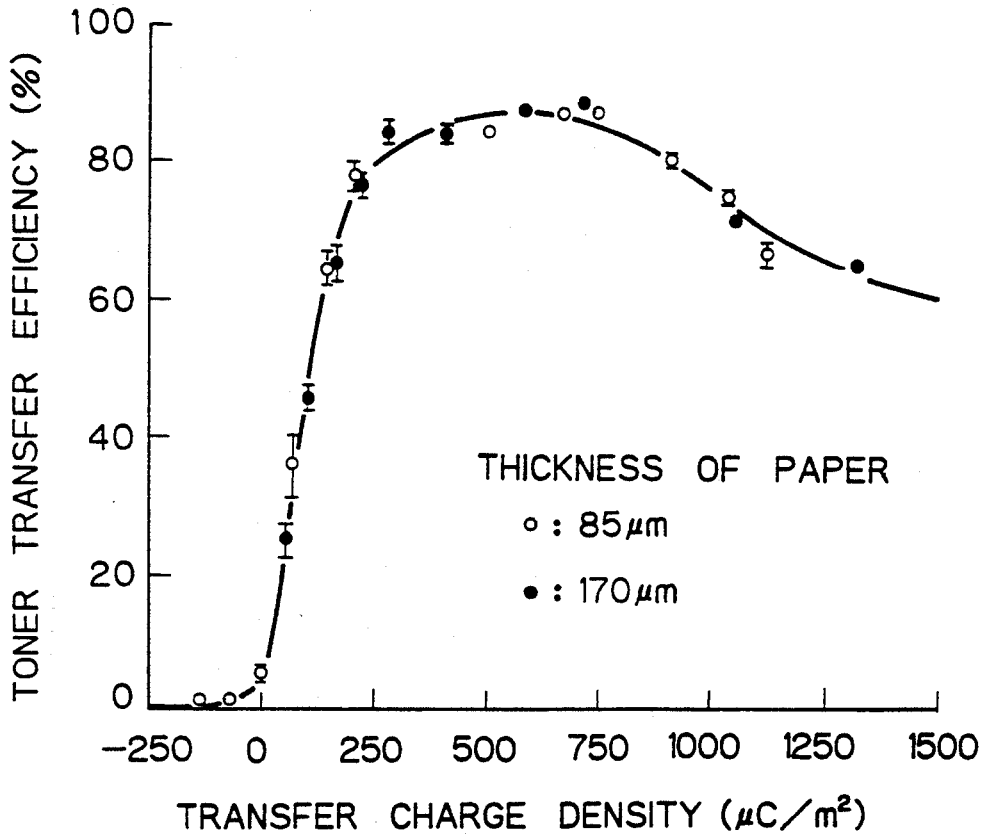
FIG. 5(*a*) is a graph showing a relationship between a transfer charge density and a toner transfer efficiency with respect to a thickness of a paper.
Figure 5B:
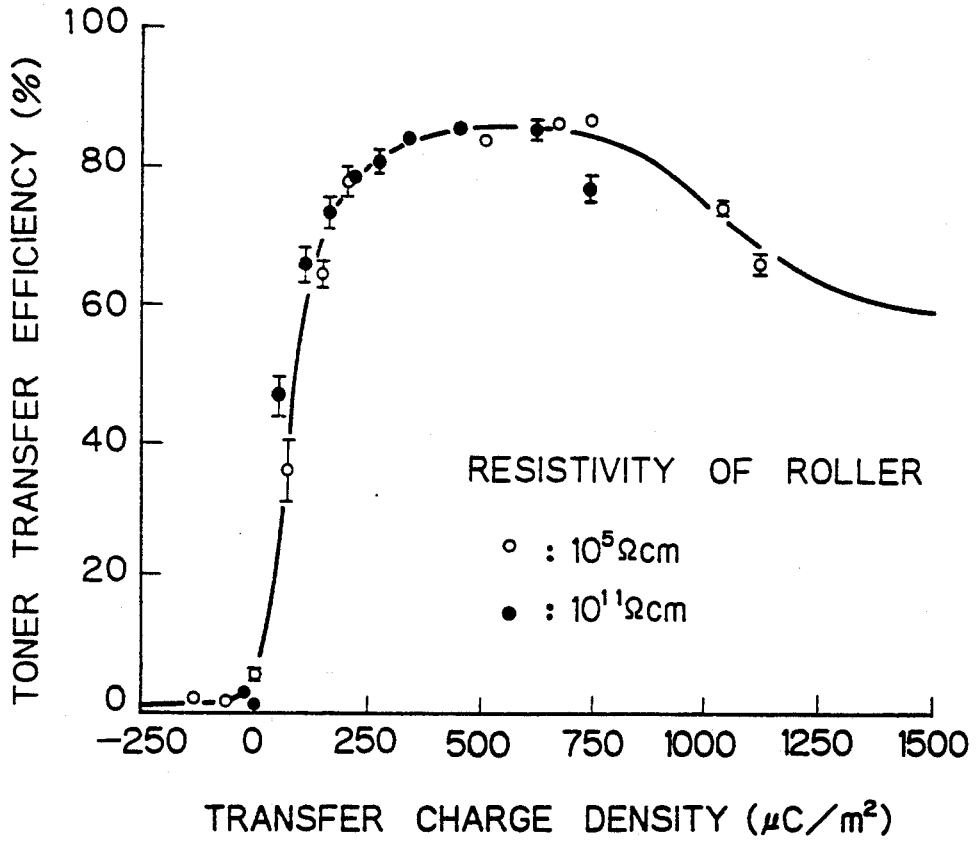

FIGS. 5(*a*) and 5(*b*) show graphs derived from the graphs of FIGS. 4(*a*) and 4(*b*), respectively. Namely, in each of the graphs of FIGS. 5(*a*) and 5(*b*), the plots indicating the toner transfer efficiency are made with respect to the abscissa indicating a transfer charge density ($\mu C/m^2$) of a paper in place of the transfer voltage. From the graphs of FIGS. 5(*a*) and 5(*b*), it can be easily understood that the toner transfer efficiency depends upon only a transfer charge density of the paper, regardless of a thickness of the paper and a resistivity of the conductive transfer roller. Accordingly, if a predetermined constant transfer charge density can be always given to a paper, it is possible to obtain a reasonable toner transfer efficiency regardless of a thickness of the paper and a resistivity of the conductive transfer roller. This can be achieved by using a constant current electric source as a transfer electric source.

Note, in the embodiment shown in FIGS. 1 and 2 a charge density of about 500 $\mu C/m^2$ can be always given to the paper P, by supplying the constant current of about 10 μA from the constant current source circuit 20*a* of the electric power device 20 to the conductive transfer roller 18.

Figure 6A:
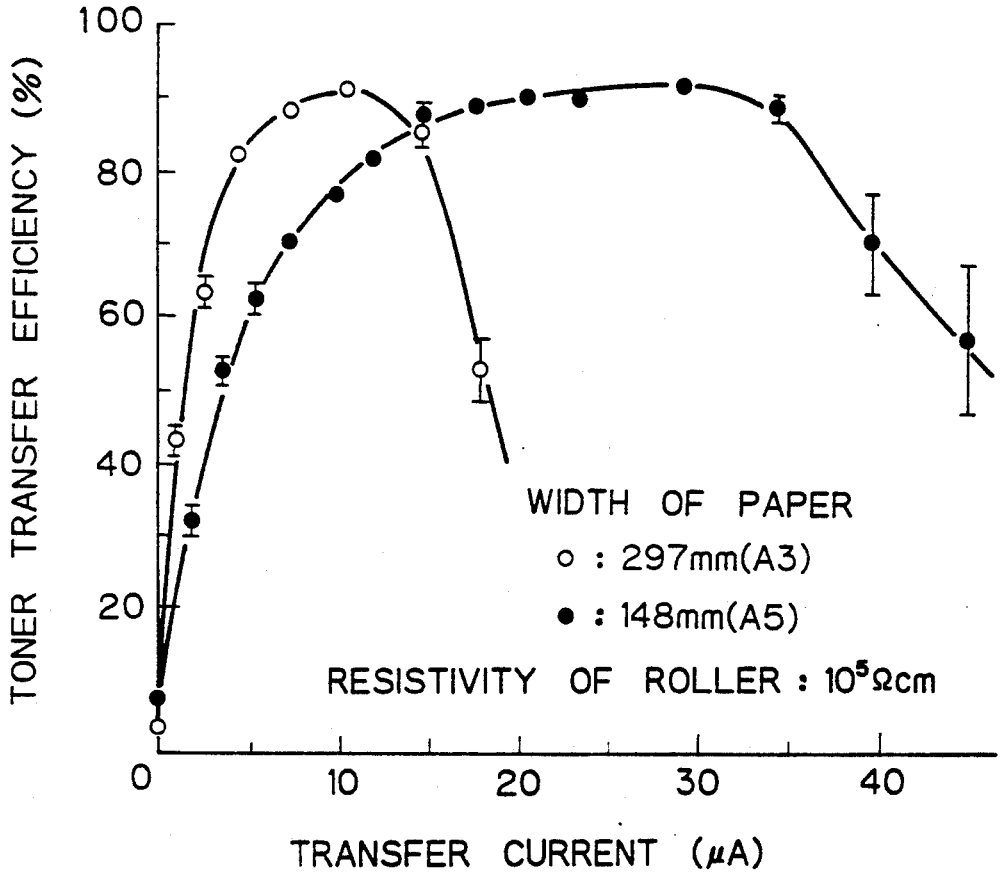
FIG. 6(*a*) is a graph showing a relationship between a transfer current and a toner transfer efficiency with respect to a width of a paper and a resistivity of a conductive transfer roller.
Figure 6B:
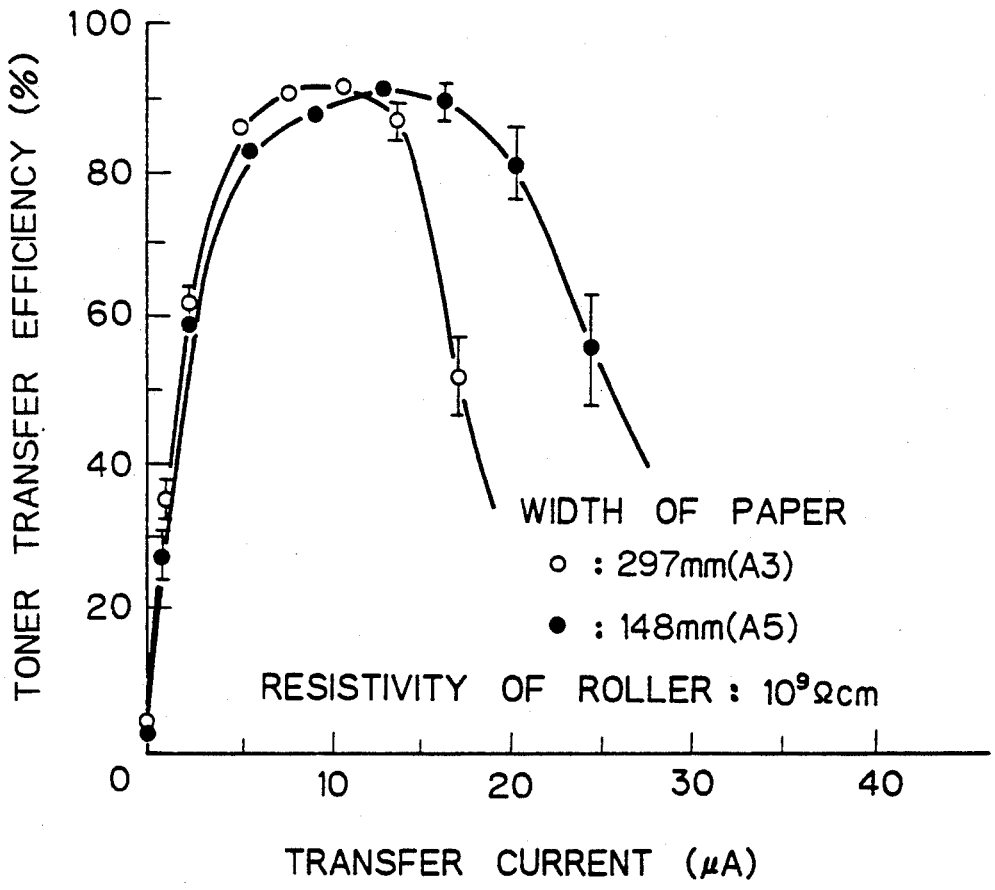
Figure 6C:
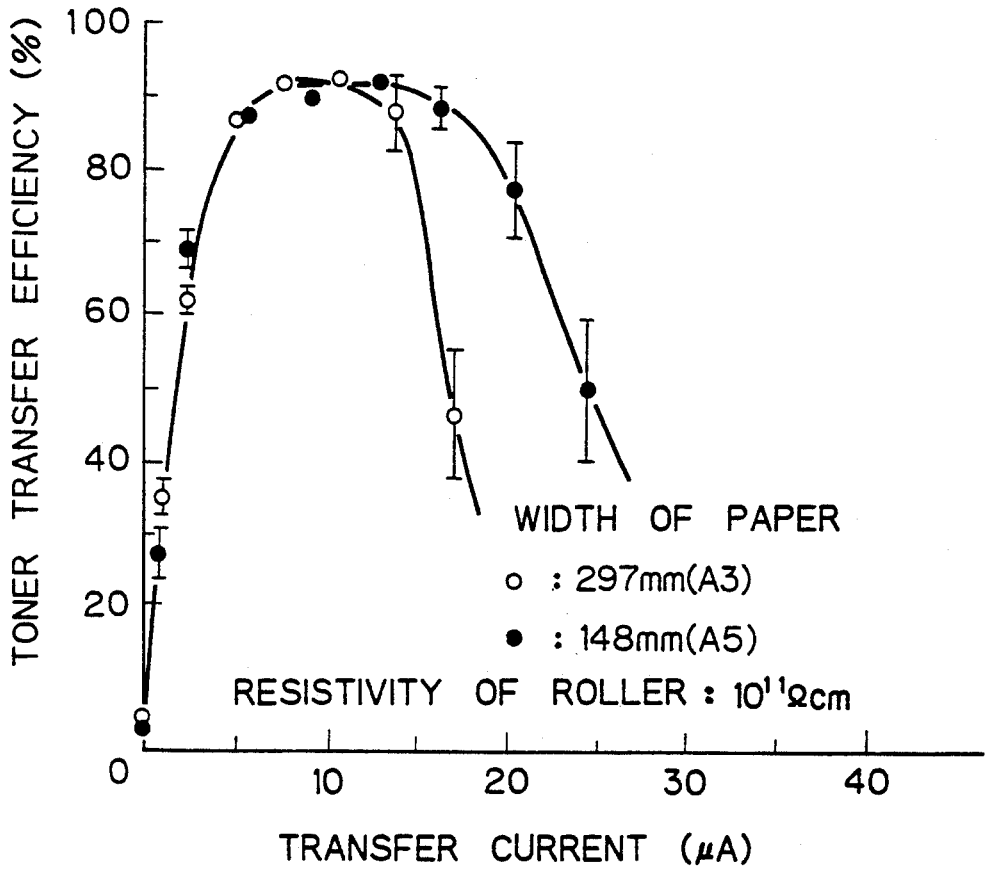

Although the constant current is supplied to the conductive transfer roller, a toner transfer efficiency furthermore varies in accordance with a width of a paper, as shown in a graph of FIG. 6(*a*). As apparent from FIG. 6(*a*), with respect to a A3-size paper having a width of 148 μm, a maximum toner transfer efficiency of about 90% is obtained when a constant current of about 10 μA is supplied to the conductive transfer roller having a resistivity of $10^5$ Ωcm. Nevertheless, with respect to a A5-size paper having a width of 148 mm, it is necessary to supply an current of from about 20 to about 30 μA to the conductive transfer roller before the maximum toner transfer efficiency of about 90% can be obtained. This means that, although the constant current is supplied to the conductive transfer roller, a value of the constant current must be adjusted in accordance with a width of the paper before a reasonable toner transfer efficiency can be obtained with respect to paper having a different width.

Nevertheless, according to the present invention, with respect to paper having a different width, it is possible to obtain a reasonable toner transfer efficiency without any adjustment of the value of the constant current, by using the conductive transfer roller having a resistivity of more than $10^7$ Ωcm, preferably from about $10^9$ to about $10^{11}$ Ωcm, as shown in the graphs of FIGS. 6(*b*) and 6(*c*). As apparent from these graphs, with respect to papers (A4 and A5) having the widths of 274 mm and 148 mm, a reasonable toner transfer efficiency of more than 80% can be obtained by supplying a constant current of about 5 to about 15 μA to the conductive transfer roller 18 having a resistivity of about from $10^9$ to about $10^{11}$ Ωcm.

Figure 7:
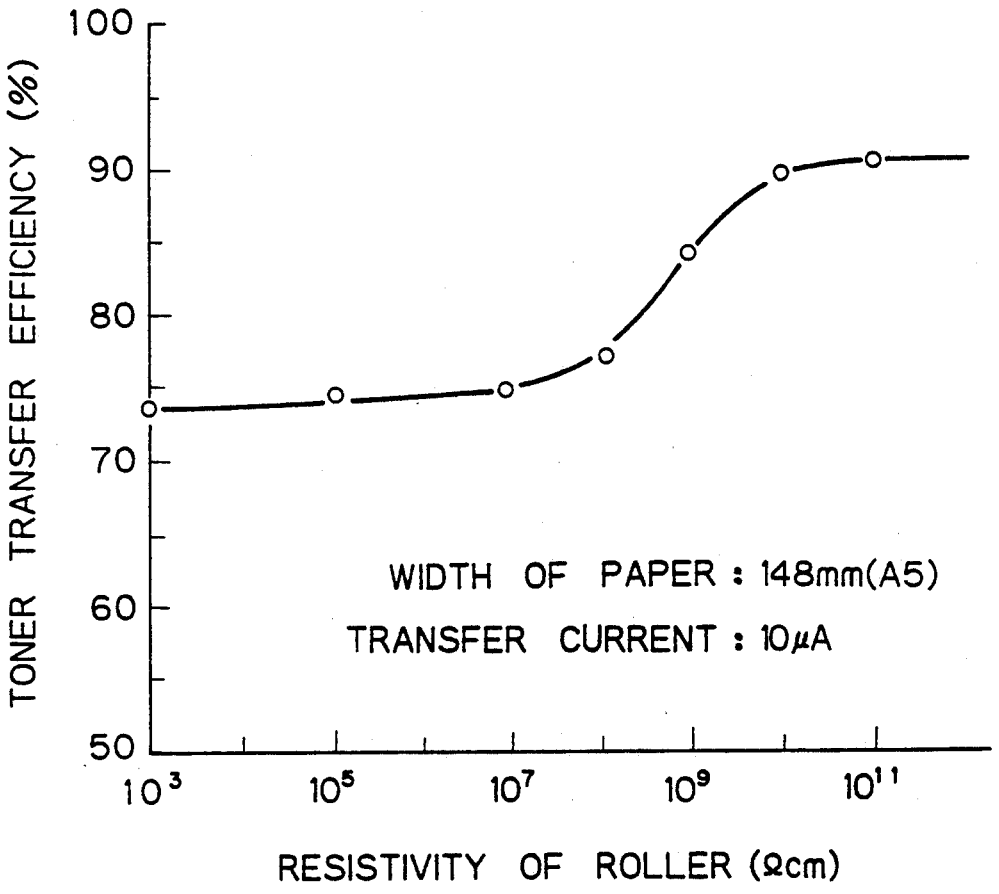
FIG. 7 is a graph showing a resistivity of a conductive transfer roller and a toner transfer efficiency.

FIG. 7 is a graph showing a relationship between a toner transfer efficiency and a resistivity of the conductive transfer roller with respect to A5-size paper having a smaller width of 148 mm, when supplying a constant current of about 10 μA to the conductive transfer roller. From this graph, it is understood that the conductive transfer roller must have a resistivity of more than $10^7$ Ωcm before a toner transfer efficiency of more than 75% can be obtained.

Note, in a developing process, a latent image should be developed with a suitable and reasonable amount of toner, to avoid a wasteful consumption of toner. Accordingly, an enhancing of the toner transfer efficiency can not only improve the quality of the transferred toner image but can also contribute to a lowering of the consumption of toner.

A relationship between a toner transfer efficiency η and a visible evaluation of a transferred toner image quality is shown in the following table:

| η (%) | Optical Density of Transferred Toner Image (OD) | Uneveness of Toner Image Density (Δ OD) | Evaluation |
|---|---|---|---|
| 50 | 0.8 | 0.4 | X |
| 60 | 1.0 | 0.4 | X |
| 70 | 1.1 | 0.3 | Δ |
| 80 | 1.2 | 0.2 | ○ |
| 85 | 1.3 | 0.1 | ◎ |

In this table, the transferred toner image qualities evaluated by symbols "x", "Δ", "○", and "◎" denote rejected, passable, good, and excellent in practical use, respectively. As apparent from FIGS. 5(*a*) and 5(*b*), a charge density of from about 200 to about 1000 $\mu C/m^2$ should be given to a paper before at least a passable quality "Δ" can be obtained with respect to the transferred toner image (efficiency of more than 70%). Also, a charge density of from about 250 to 900 $\mu C/m^2$ must be fed to a paper for obtaining a good quality "○" of the transferred toner image. Further, a charge density of from about 400 to 750 $\mu C/m^2$ is necessary for obtaining an excellent quality "○" of the transferred toner image.

A relationship between a constant current I supplied from an constant current source to the conductive transfer roller and a charge density $\sigma(\mu C/m^2)$ of the paper is defined by the following formula:

$$I=\sigma VL$$

wherein: V (mm/s) is a peripheral speed of an photosensitive drum ; and L (mm) is a width thereof. As mentioned above, if V=70 mm/s, and L=279 mm, the current I is as follows:

$$I=70\times 10^{-3}\times 279\times 10^{-3}\sigma$$

Accordingly, it is possible to determine a necessary charge density σ by selecting a value of the constant current I output from the constant current source.

Figure 8A:
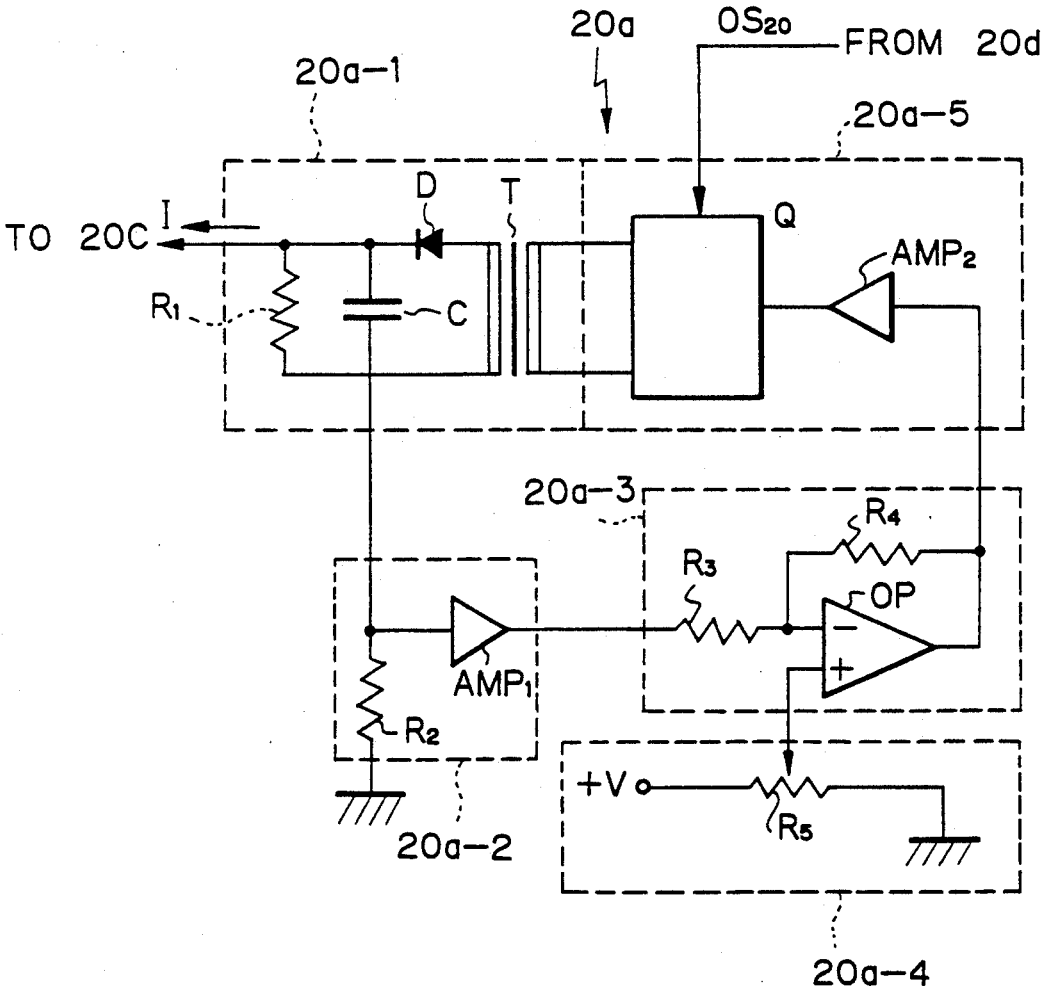
FIG. 8(*a*) is a circuit diagram of the block diagram shown in FIG. 3(*b*)
Figure 8B:
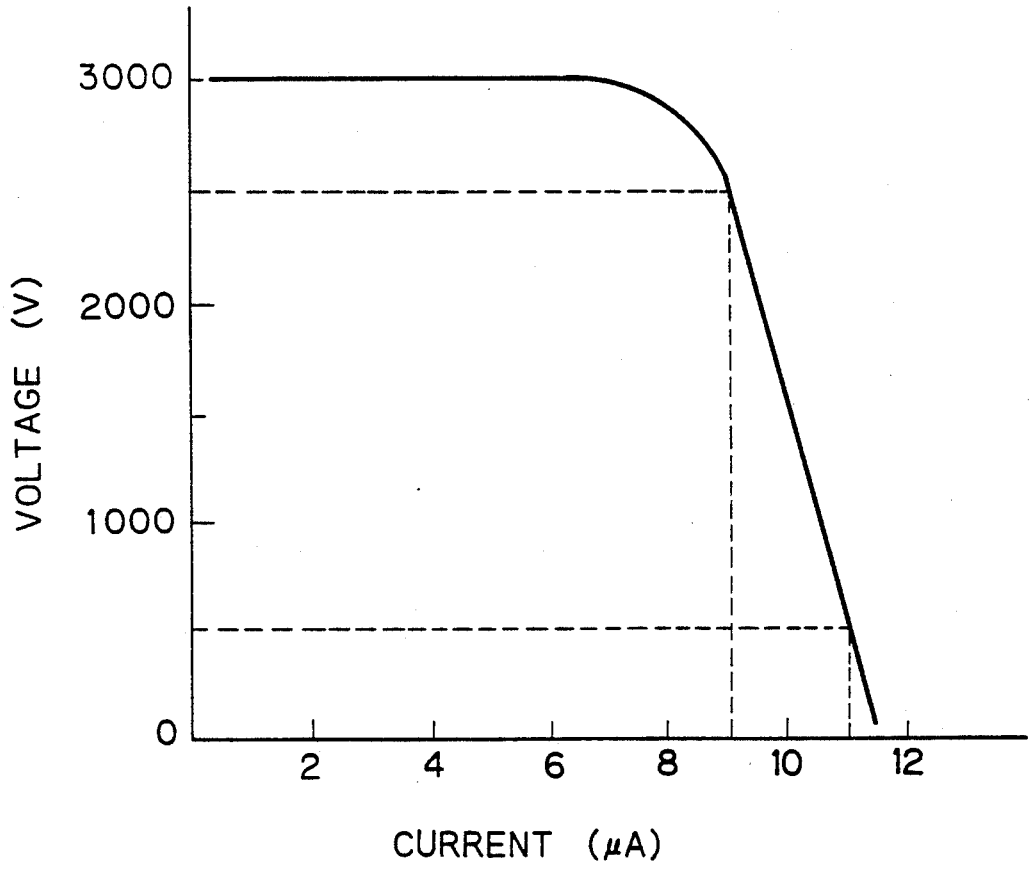

FIG. 8(*a*) shows, by way of example, a circuit diagram of the constant current source circuit 20*a* in which it is possible to select the value of the constant current I, if necessary. As shown in FIG. 8(*a*), the constant current source circuit 20*a* includes: a direct current source circuit 20*a*-1 having a high voltage transformer T, a diode D, a capacitor C, and a resistor $R_1$; a detecting circuit 20*a*-2 having a resistor $R_2$, and an amplifier $AMP_1$; a comparing/amplifying circuit 20*a*-3 having an operational amplifier OP, resistors $R_3$ and $R_4$; a reference voltage setting circuit 20*a*-4 having an adjustable resistor $R_5$; and a controlling circuit 20*a*-5 having an oscillator Q, and an amplifier $P_2$.

In the direct current source circuit 20*a*-1, an alternating current output from a secondary coil of the high voltage transformer T is rectified by the diode D, and is then output to the conductive transfer roller 18 through the switching circuit 26*c* as a direct current I due to the capacitor C and the resistor $R_1$. The direct current I supplied to the transfer roller 18 is detected as a voltage value by the resistor $R_1$ of the detecting circuit 20*a*-2, and is then amplified by the amplifier $AMP_1$ thereof. In the comparing/amplifying circuit 20*a*-3, the detected voltage is input to an inverting input terminal of the operational amplifier OP through the resistor $R_3$, and a reference voltage determined by the adjustable resistor $R_5$ of the reference voltage setting circuit 20*a*-4 is input to a non-inverting input terminal of the operational amplifier OP. The detected voltage is compared with the reference voltage in the operational amplifier OP, and a voltage difference therebetween is then multiplied by $RV_4/RV_3$ (Note, $RV_3$ and $RV_4$ indicate resistance values of the resistors $R_3$ and $R_4$, respectively). This multiplied voltage is output to the oscillator Q of the controlling circuit 20*a*-5 through the amplifier $P_2$ thereof. The oscillator Q generates an alternating current having a frequency that is variable in accordance with a value of the multiplied voltage input from the operational amplifier OP to the oscillator Q. This alternating current is then input to a primary coil of the high voltage transform T, and then output from the secondary coil thereof. Thus, the direct current I output from the direct current source circuit 20*a*-1 can be maintained at a constant value, and a constant value of the direct current I is based upon the reference voltage output from the reference voltage setting circuit 20*a*-4.

A voltage supplied from the constant current source circuit 20*a* to the conductive transfer roller 18 is made variable, to thus maintain the constant value of the direct current I. If the supplied voltage is raised to more than 3k volts, a spark discharge may occur at the transfer roller 18. Accordingly, the constant current source circuit 20*a* is preferably constituted such that and rise of the voltage supplied to the transfer roller 18 can be suppressed to less than 3k volts. Namely, the constant current source circuit 20*a* should be given an I-V characteristic as shown in FIG. 8(*b*). As apparent from this I-V characteristic, the circuit 20*a* shown in FIG. 8(*a*) substantially functions as a constant current source within a range of from 500 to 2500 volts, whereby the occurrence of a spark discharge can be prevented.

According to another aspect of the present invention, the toner image transfer device is constituted such that the cleaning process of the conductive transfer roller 18 is executed over at least one part of a period except for a time of the toner image transferring process during an operation of the printer. For example, the cleaning process is preferably executed just after power is supplied to the printer, and/or when a successive printing operation is once finished and while power is supplied to the printer. Also, whenever a paper is jammed at the printer, the cleaning process should be executed because the transfer roller 18 will be greatly polluted by a toner image directly transferred thereto. These executions of the cleaning process are explained in details with reference to FIG. 9, 10, and 11.

Figure 9:
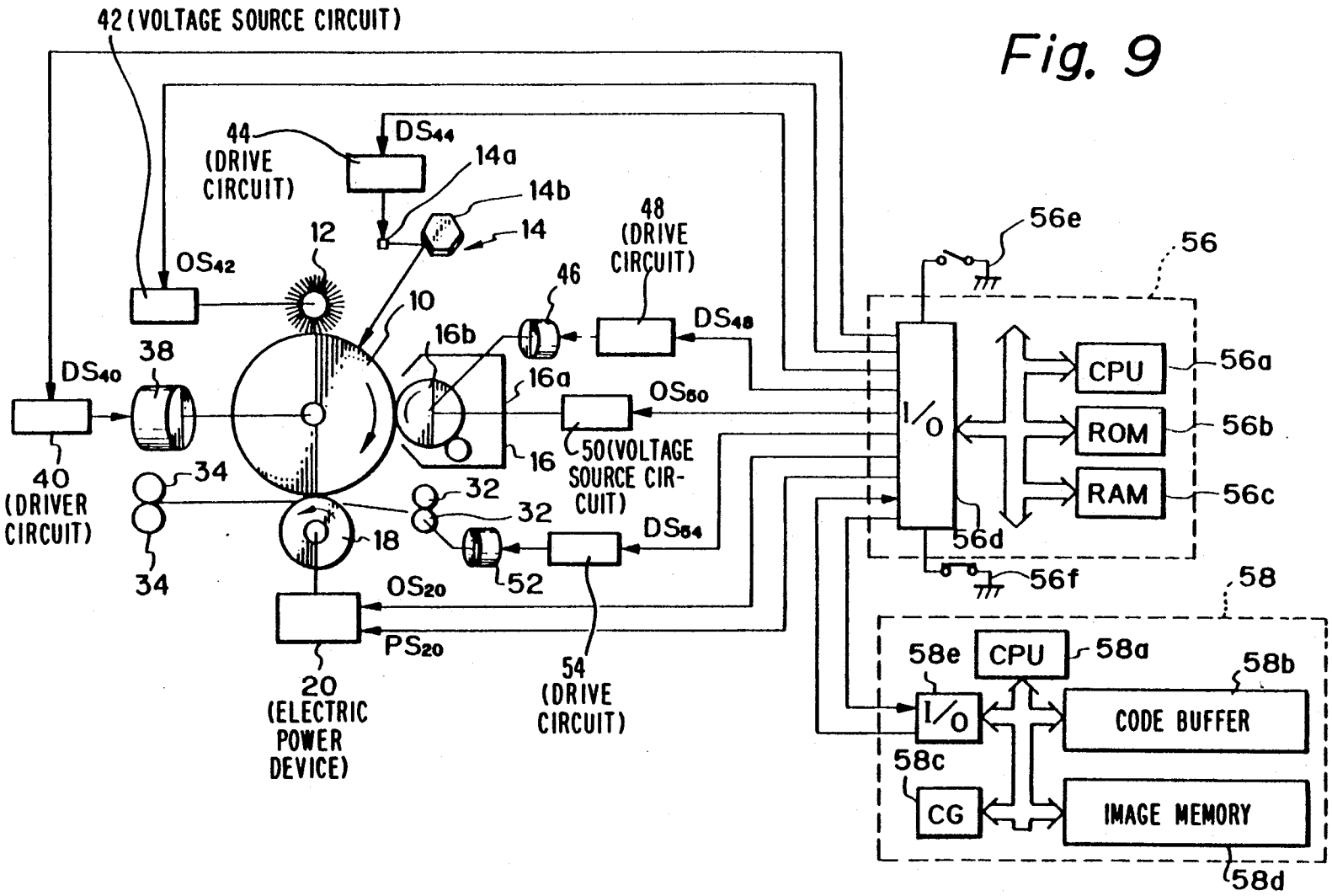
FIG. 9 is a block diagram of the printer shown in FIGS. 1 and 2.
Figure 10A:
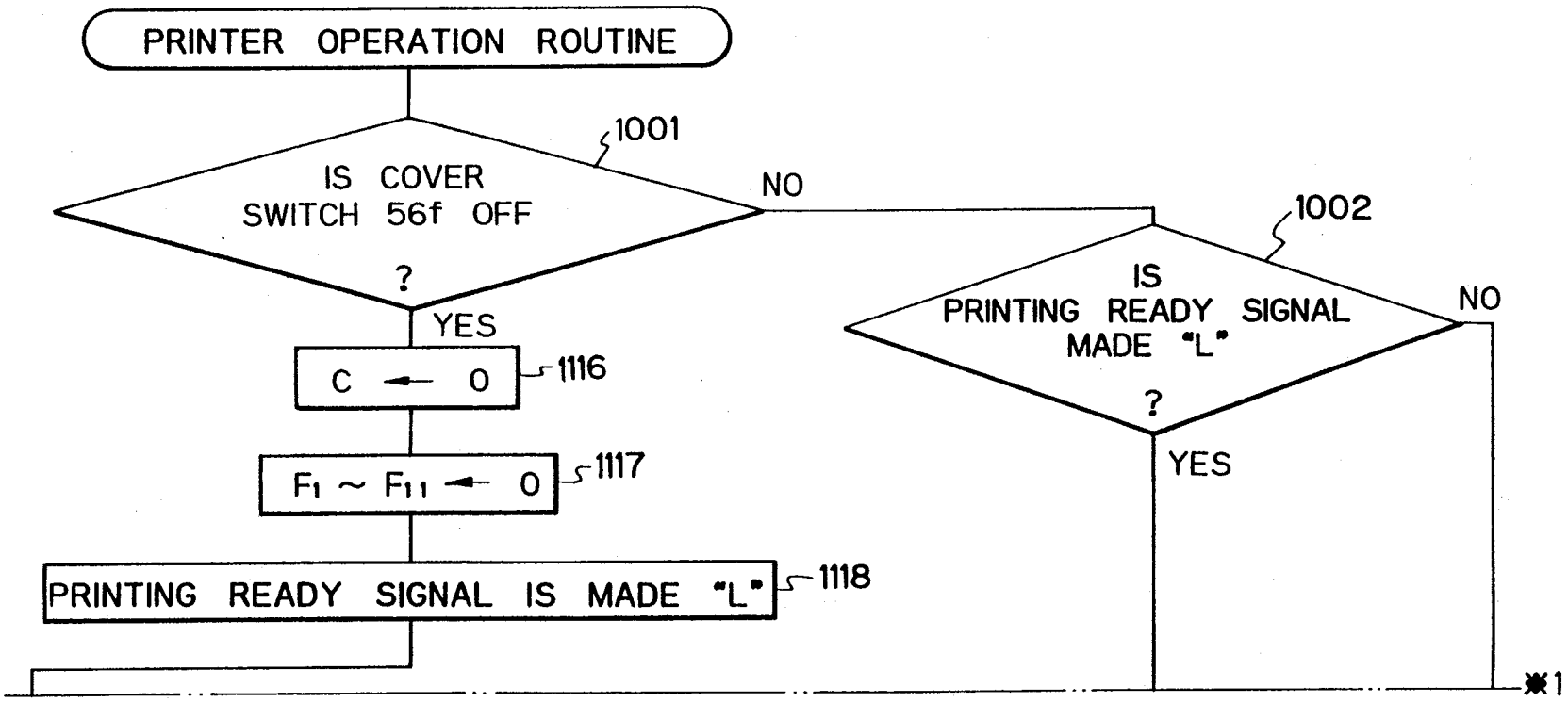
FIGS. 10(*a*) to 10(*m*) is a flow chart for explaining an operation of the block diagram shown in FIG. 9.
Figure 10B:
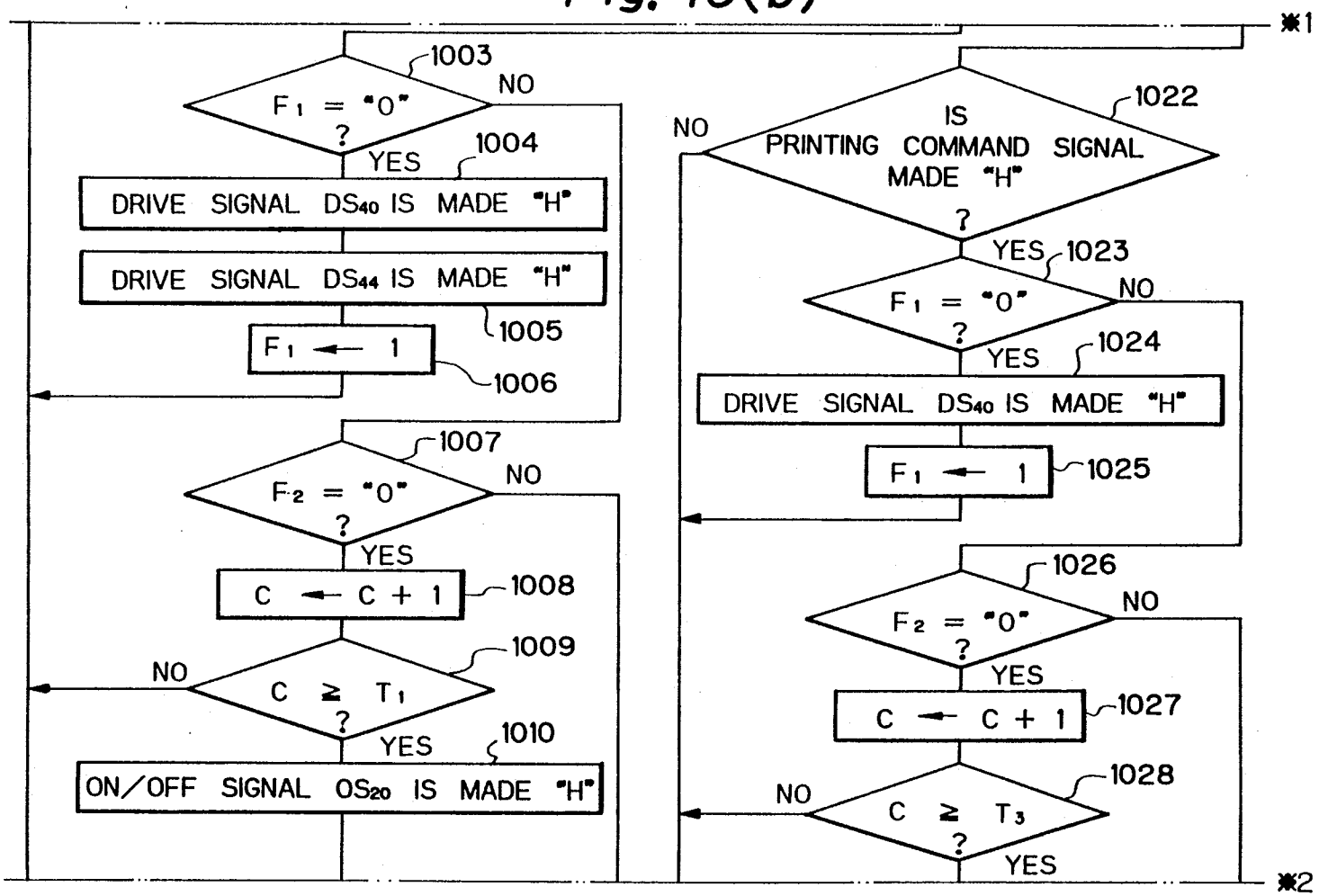
Figure 10C:
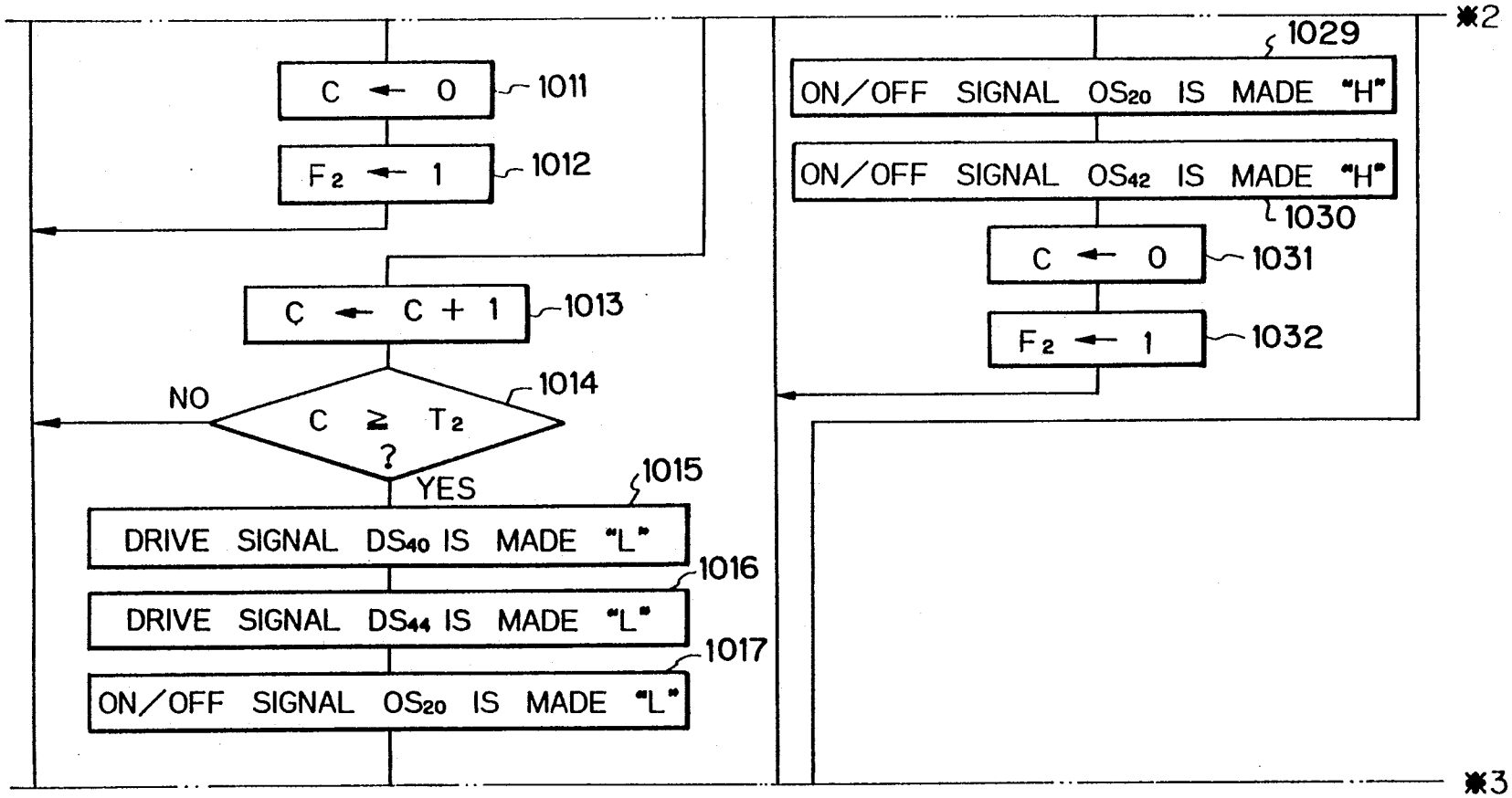
Figure 10D:
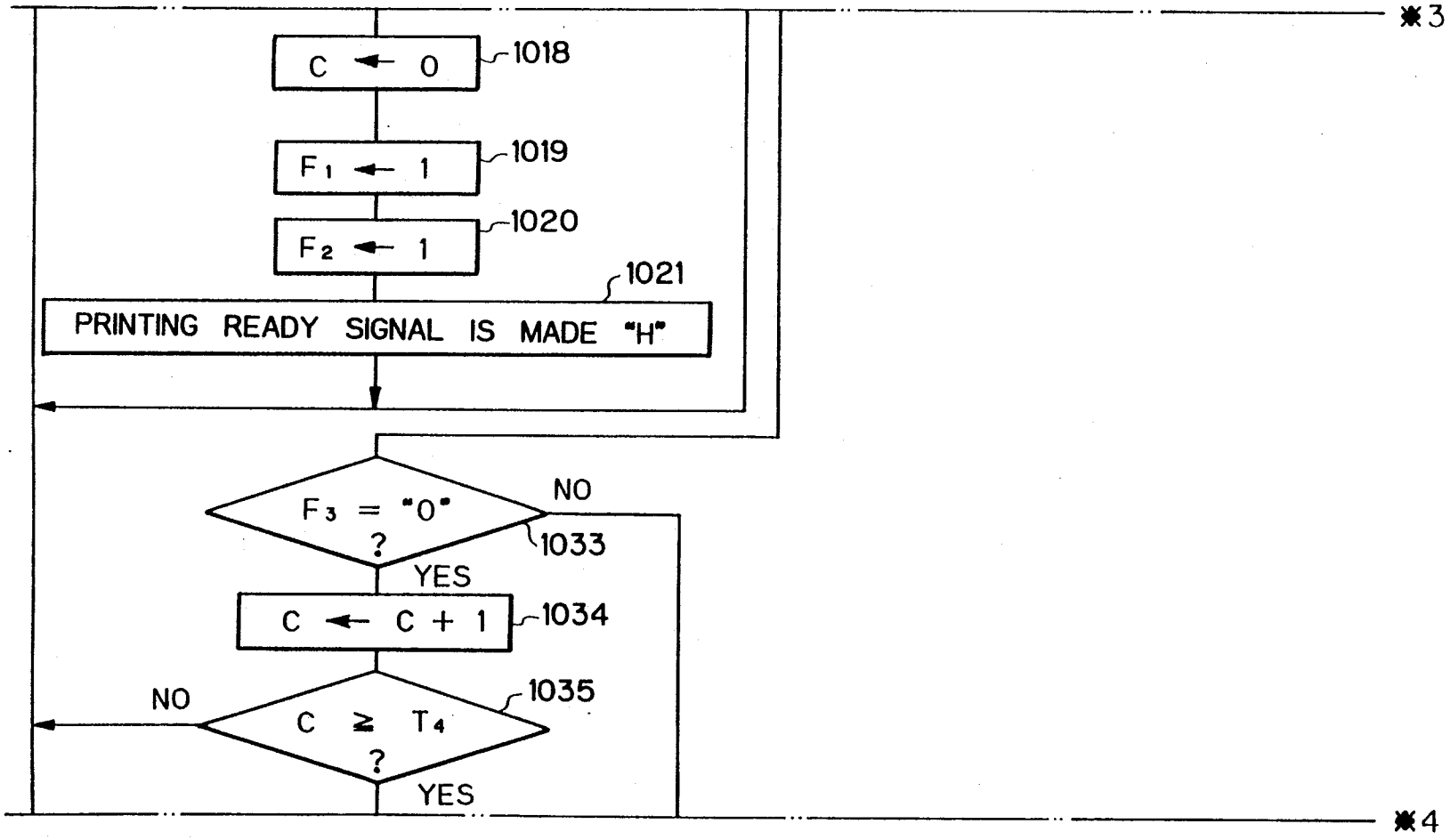
Figure 10E:
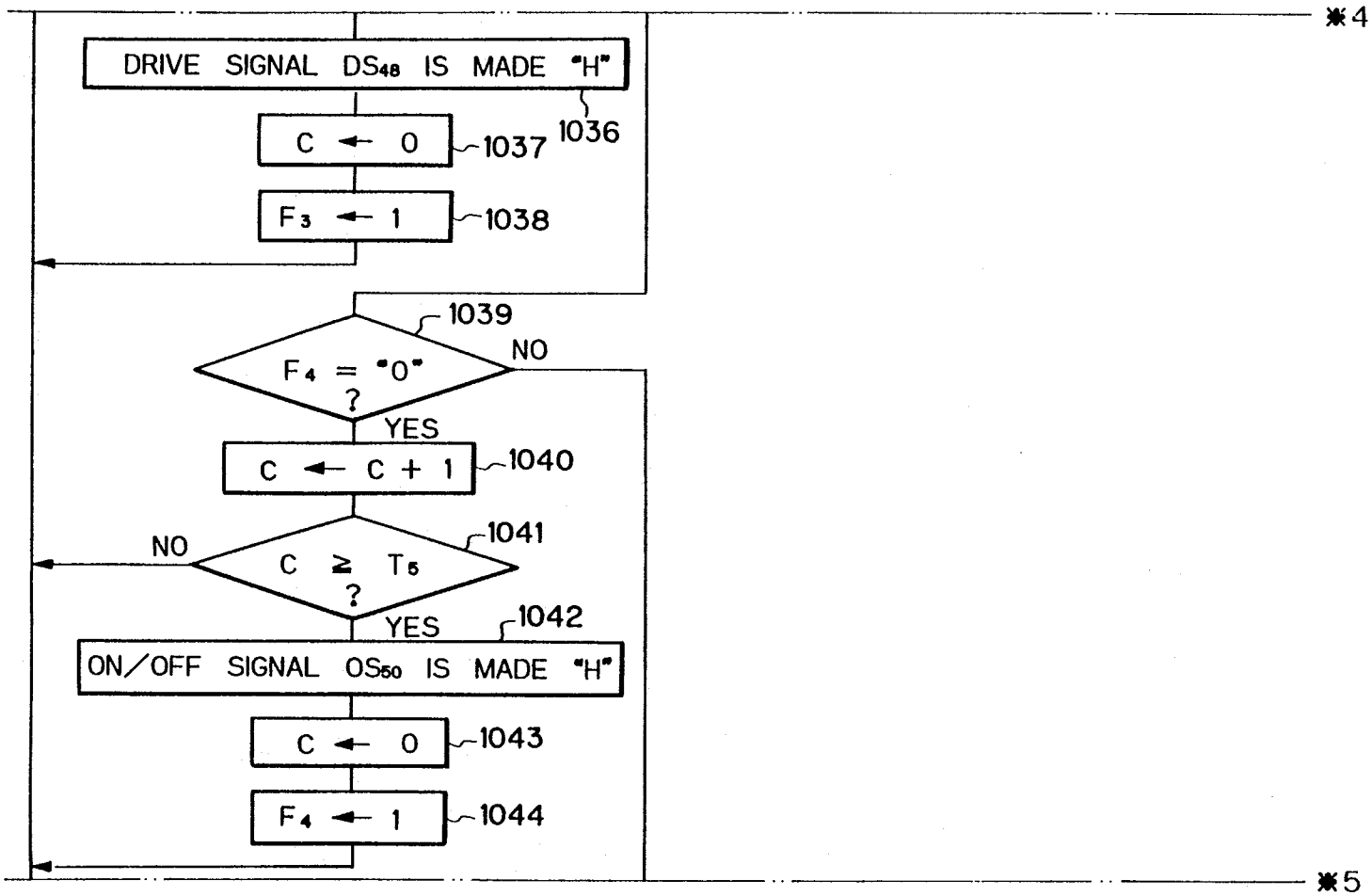
Figure 10F:
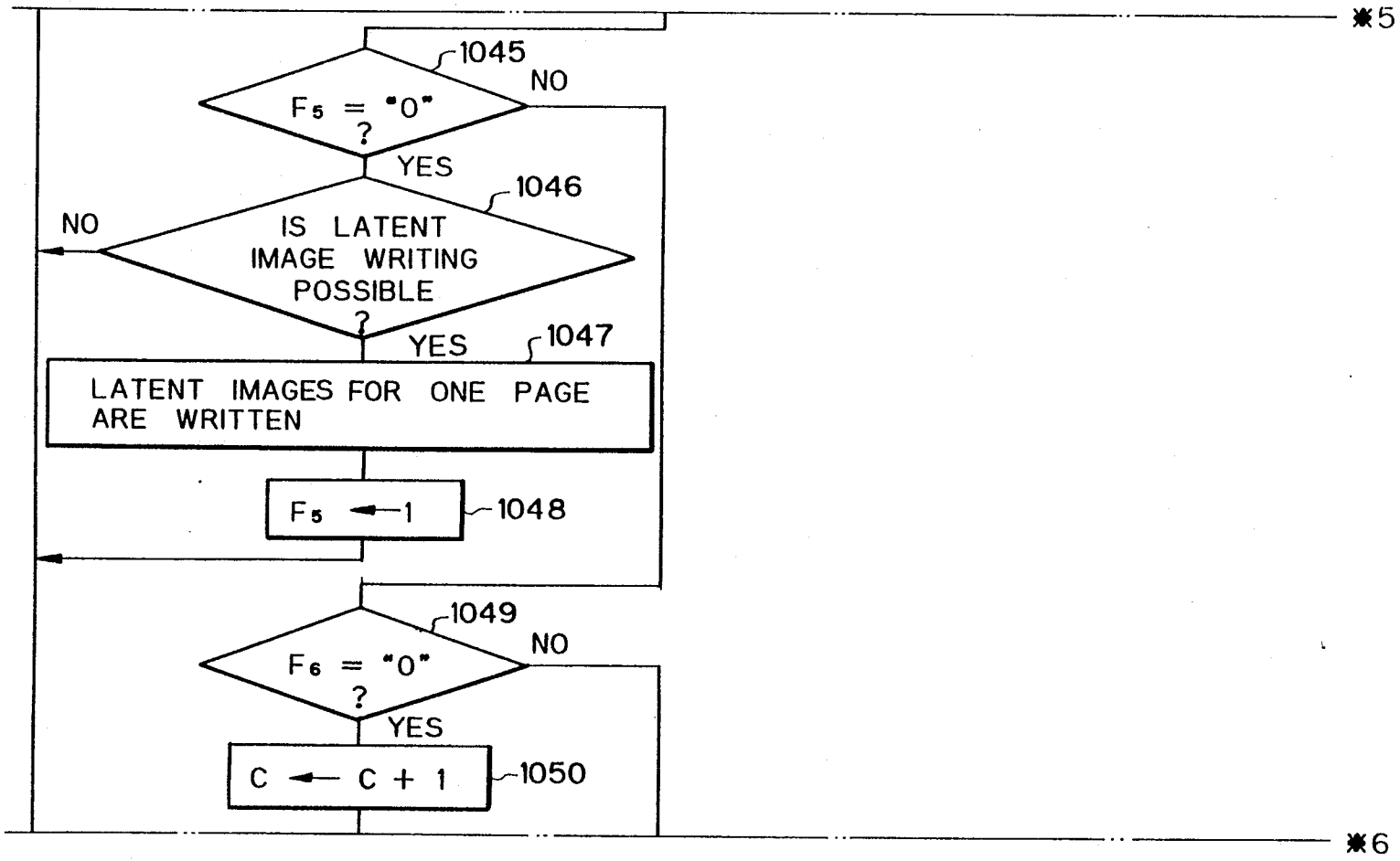
Figure 10G:
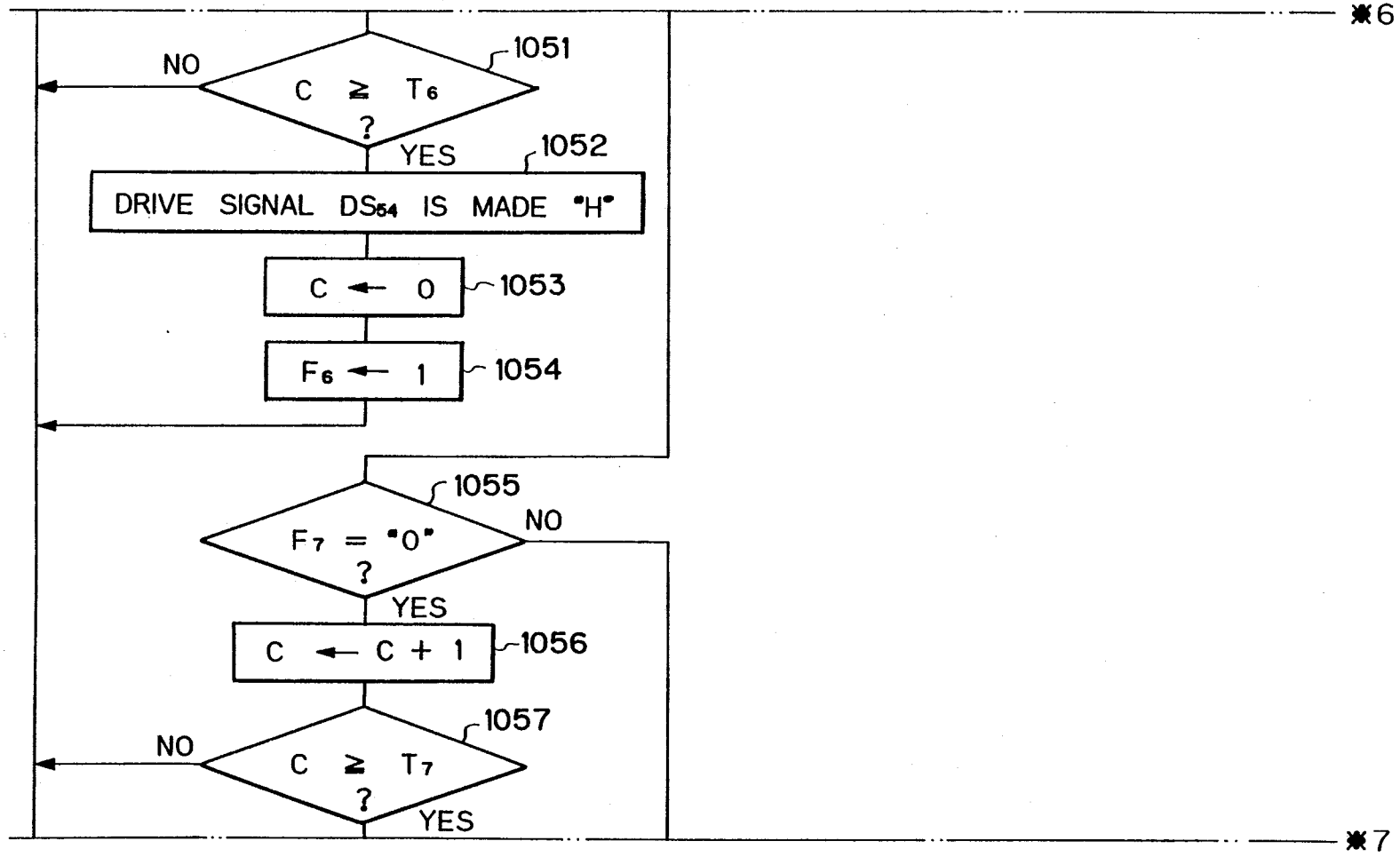
Figure 10H:
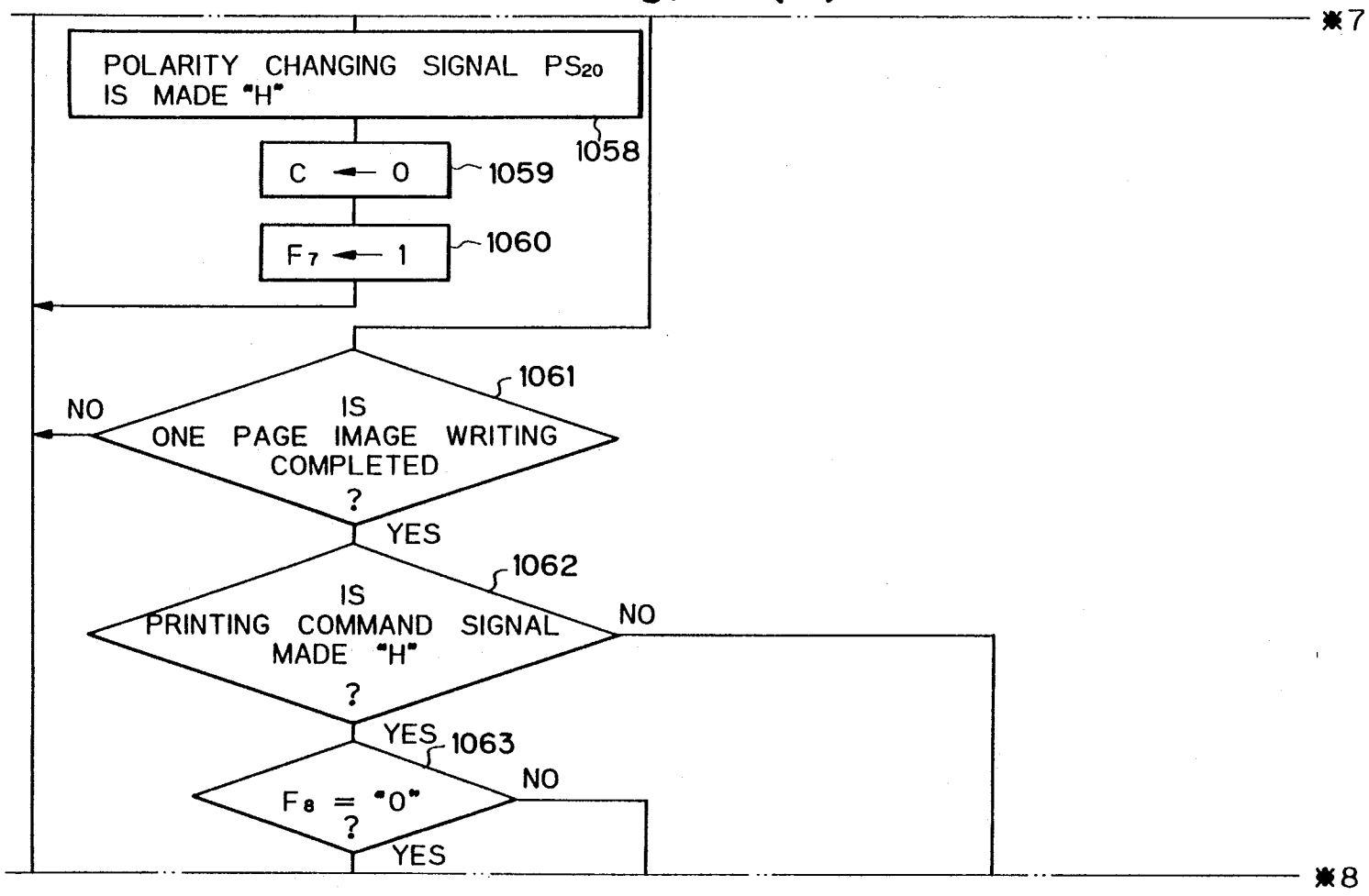
Figure 10I:
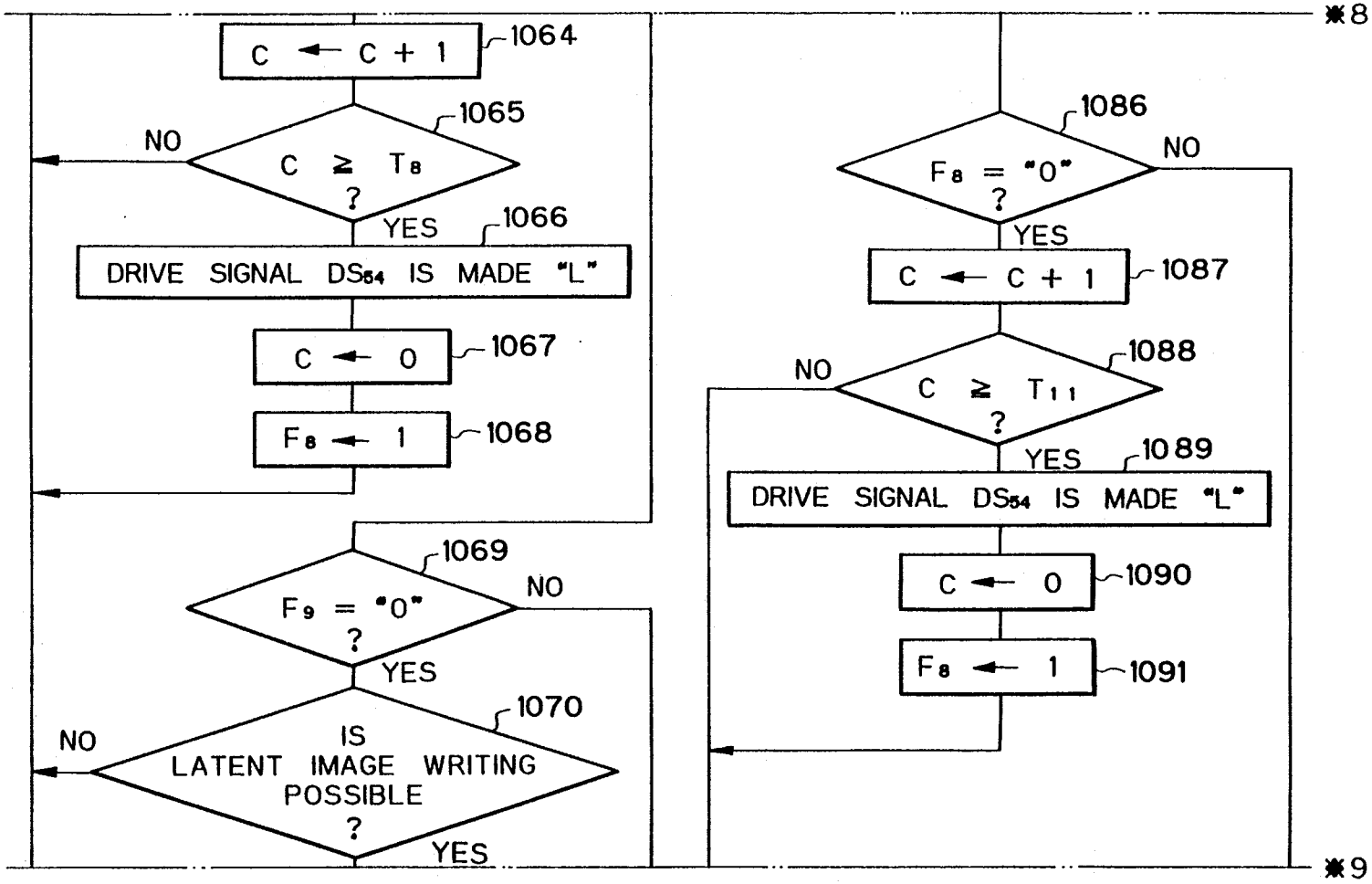
Figure 10J:
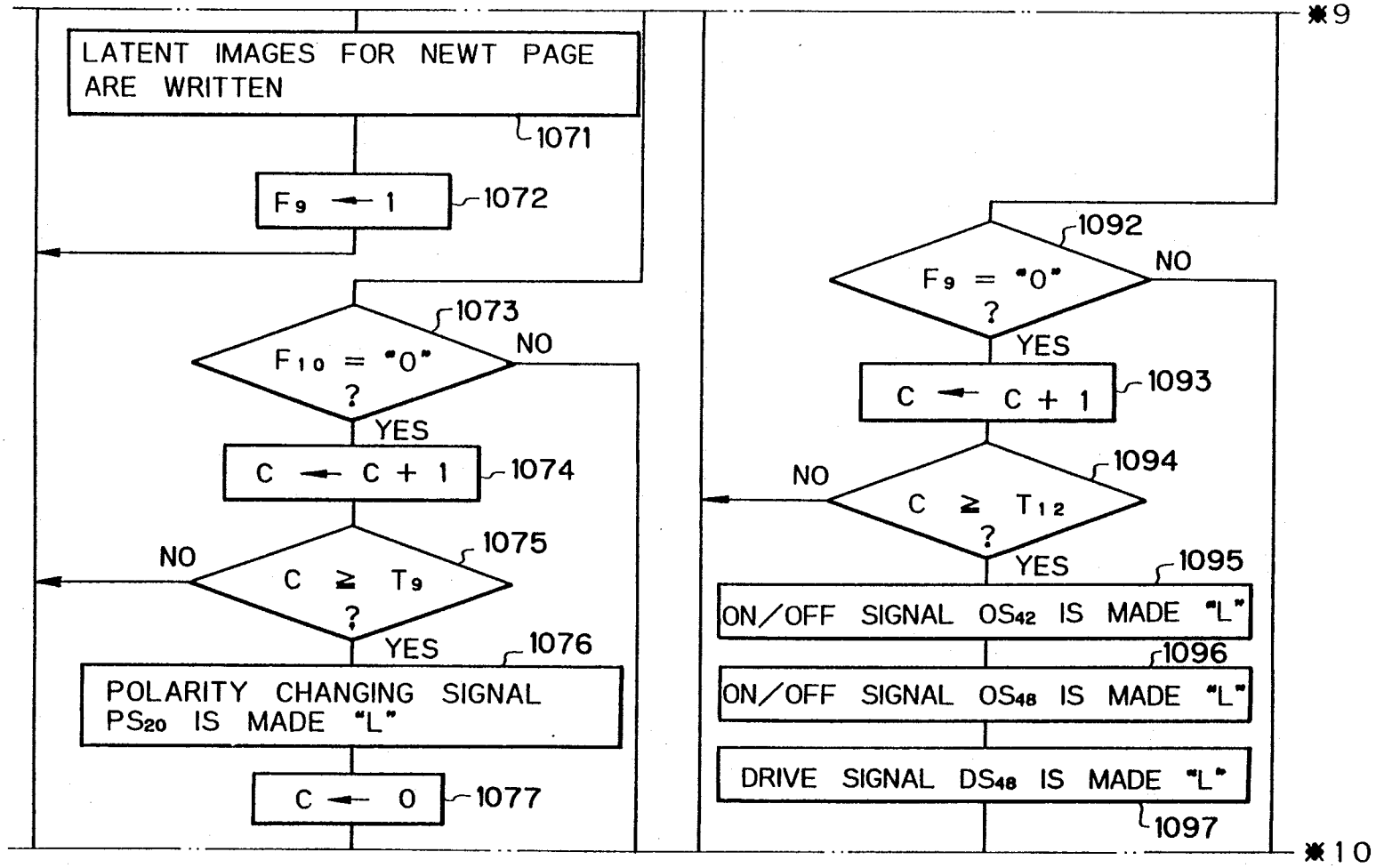
Figure 10K:
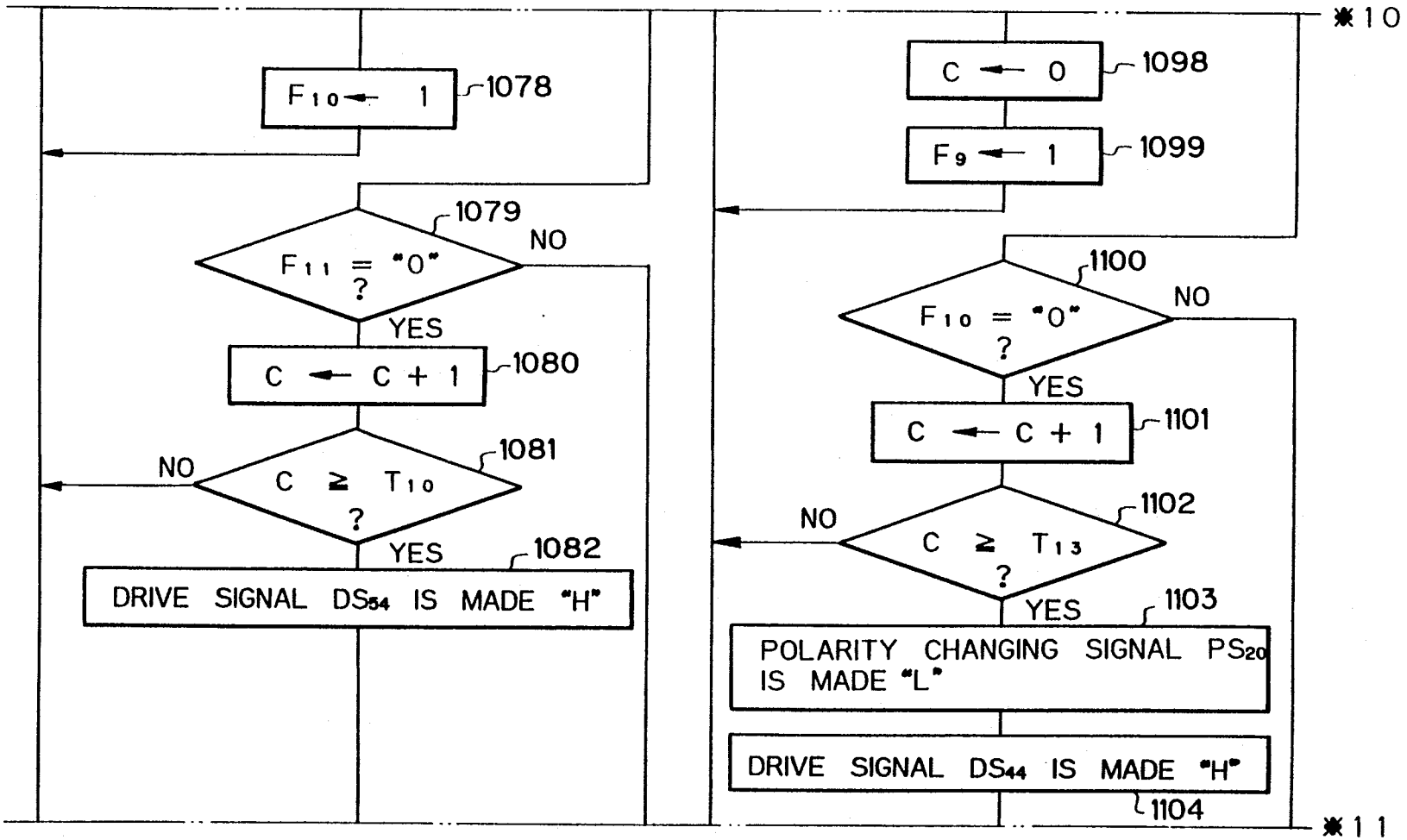
Figure 10L:
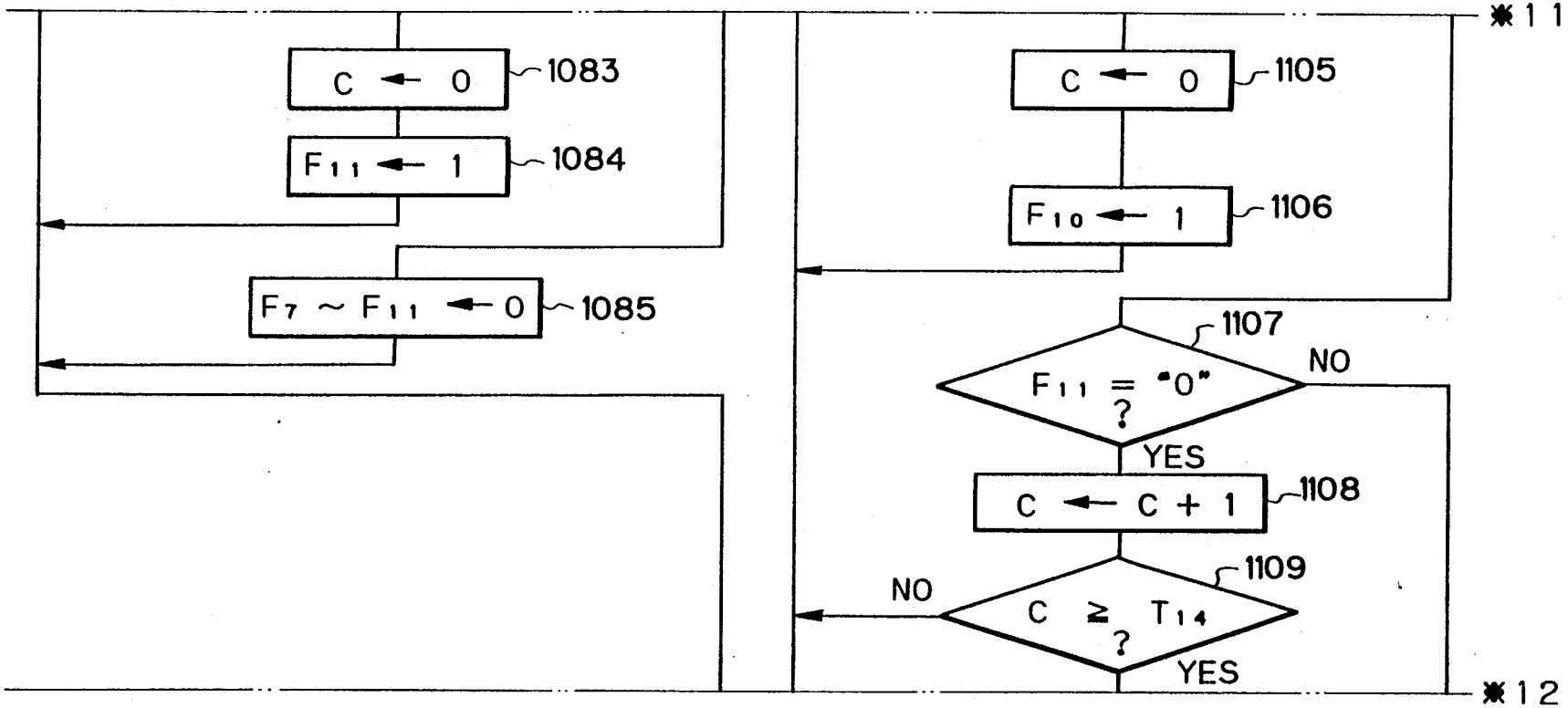
Figure 10M:
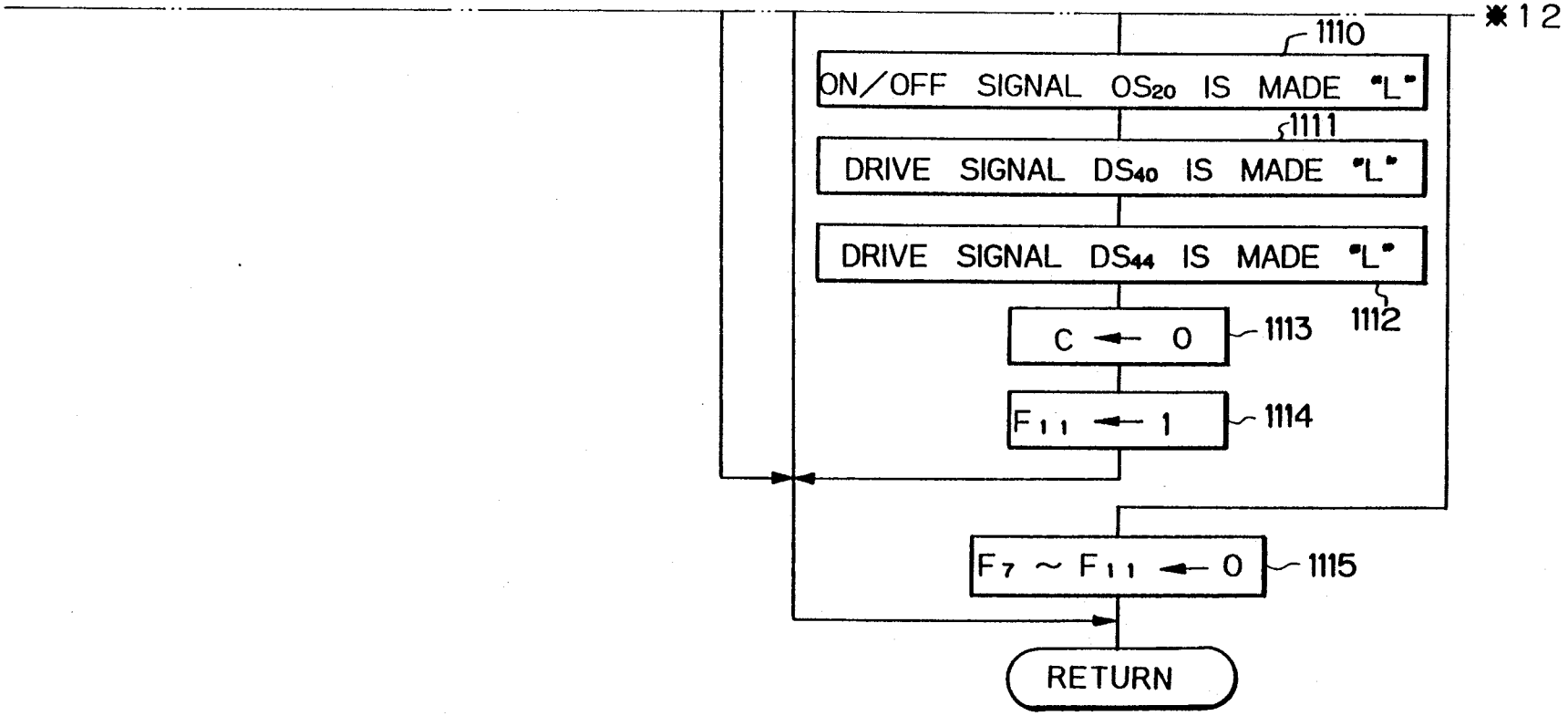

FIG. 9 shows a block diagram of the printer shown in FIGS. 1 to 3. In this block diagram, an electric motor 38 such as a stepping motor, a servomotor or the like is mechanically connected to the photosensitive drum 10 through a gear train (not shown), and is electrically connected to a driver circuit 40. When a drive signal $DS_{40}$ input to the driver circuit 40 is changed from a low level "L" to a high level "H", the motor 38 is driven. Also, the motor 38 is 30 mechanically connected to the transfer roller 18 through a gear train (not show), so that the drum 10 and the transfer roller 18 are simultaneously rotated when the motor 38 is driven. The conductive brush 12 is electrically connected to a voltage source circuit 42, and is electrically energized when an ON/OFF signal $OS_{42}$ goes from a low level "L" to a high level "H". The laser beam scanner 14 includes a laser source 14*a* such as a semiconductor laser electrically connected to a drive circuit 44. When a drive signal $DS_{44}$ input to the drive circuit 44 is changed from a low level "L" to a high level "H", the laser beam LB is emitted from the laser source 14*a* through a suitable optical system including a polygon mirror 14*b*. The surface of the drum 10 is scanned with the laser beam LB deflected by the polygon mirror 14*b*. An electric motor 46 such as a stepping motor, a servo-motor or the like is mechanically connected to the developing roller 16*b*, and is electrically connected to a drive circuit 48. When a drive signal $DS_{48}$ input to the drive circuit 48 is changed from a low level "L" to a high level "H", the motor 46 is driven to thus rotate the developing roller 16*b*. Also, the developing roller 16*b* is electrically connected to a voltage source circuit 50, and is supplied with the developing bias voltage when an ON/OFF signal $OS_{50}$ is changed from a low level "L" to a high level "H". An electric motor 52 such as a stepping motor, a servo-motor or the like is mechanically connected to one of the paper feeder rollers 32, 32, and is electrically connected to a drive circuit 54. When a drive signal $DS_{54}$ input to the drive circuit 54 is changed from a low level "L" to a high level "H", the motor 52 is driven to rotate the paper feed rollers 32, 32.

A printer control circuit 56 may be constructed by a microcomputer, as shown in FIG. 9, which comprises a central processing unit (CPU) 56*a*, a read-only memory (ROM) 56*b* for storing routines, constants, etc., a random access memory (RAM) 56*c* for storing temporary data, and an input/output interface (I/O) 56*d*. The printer control circuit 56 controls each output of the above-mentioned various signals through the I/O 56*d*. In FIG. 9, a reference 56*e* indicates a power switch for the printer. Also, a reference 56*f* indicates an ON/OFF switch incorporated in the movable housing cover 26 (FIG. 1). When the movable housing cover 26 is closed as shown in FIG. 1, the ON/OFF switch 56*f* is turned ON. When the movable housing cover 26 is opened, for example, for removing a jammed paper from the printer, the ON/OFF switch 56*f* is turned OFF.

The printer control circuit 56 is connected to a host control circuit 58, which may be incorporated into a word processor, a microcomputer or the like, and which comprises a central processing unit (CPU) 58*a*, a code buffer 58*b* for temporarily storing character code data successively read from a memory means such as a floppy disk, a character generator 58*c* for converting the character code data into image data, an image memory 58*d* for temporarily storing the image data, and an input/output interface (I/O) 58*e* connected to the I/O 56*d* of the printer control circuit 56.

Figure 11:
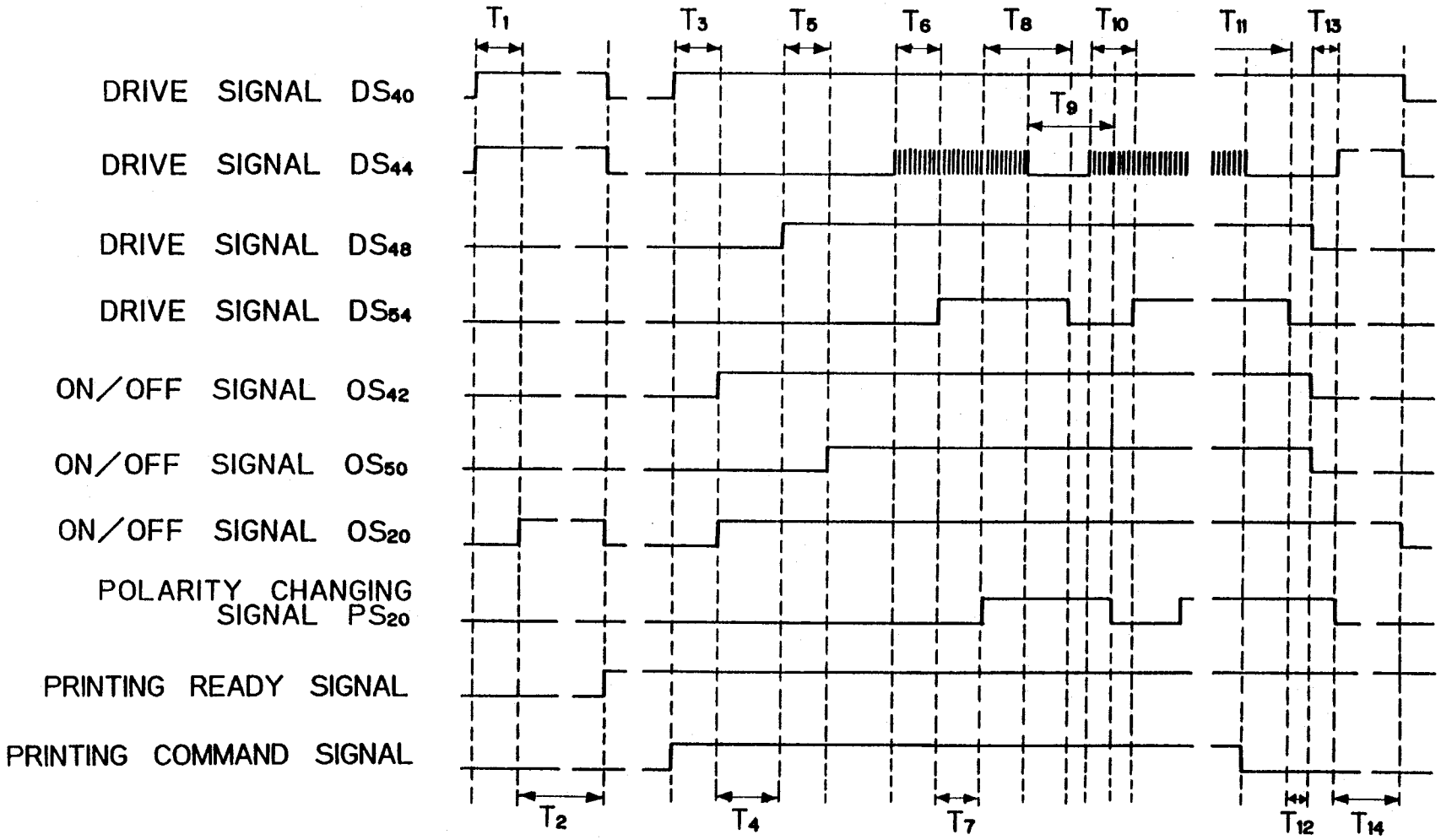
FIG. 11 is a time chart relating to the flow chart of FIGS. 10(*a*) to 10(*m*)

FIG. 10 shows a routine for an operation of the printer in which a cleaning process of the transfer roller 18 is suitably executed, and FIG. 11 shows a time chart relating to the routine of FIG. 10. Note, the routine of FIG. 10 is started by switching ON the power switch 56*e*, and is executed by interruptions output at intervals of 4 ms.

At step 1001, it is determined whether the ON/OFF switch 56*f* incorporated in the movable housing cover 26 is turned ON or OFF. Note, since the housing cover 26 is normally closed, to thus turn the ON/OFF switch 56*f* ON, the control proceeds to step 1002 and it is determined whether a printing ready signal is high or low. The printing ready signal is output from the printer control circuit 56 to the host control circuit 58, to show whether or not a ready for printing process is completed. The low level of the printing ready signal means that the ready for printing process is still not completed, and the high level of the printing ready signal means that the ready for printing process is completed. Initially, the printing ready signal is low because of an execution of a pre-printing cleaning of the transfer roller 18.

Accordingly, the control proceeds from step 1002 to step 1003, in which it is determined whether a flag $F_1$ is "1" or "0" Initially, since $F_1$="0", the control proceeds to step 1004 in which the drive signal $DS_{40}$ is changed from the low level "L" (FIG. 11) to the high level "H" to drive the motor 38 for a rotation of the photosensitive drum 10 and the transfer roller 18. Then, at step 1005, the drive signal $DS_{44}$ is also changed from the low level "L" to the high level "H" (FIG. 11) to energize the drive circuit 44 for emitting the laser beam LB from the laser source 14*a*, so that the surface of the drum 10 is scanned with the laser beam LB. When the drum 10 is rotated, the surface of the drum 10 may be charged by a triboelectrification with the conductive brush 12, but the charge is eliminated from the drum surface by the scanning laser beam LB At step 1006, the flag $F_1$ is made "1" and the routine is once ended.

When the routine is again executed after 4 ms, the control proceeds from step 1003 to step 1007 ($F_1$="1") in which it is determined whether a flag $F_2$ is "1" or "0". Initially, since $F_2$="0", the control proceeds to step 1008 in which a counter C is incremented by 1. Then, at step 1009, it is determined whether or not the counter C has counted up a given count number $T_1$. If $C<T_1$, the routine is once ended. Thereafter, the routine is repeatedly executed at intervals of 4 ms, but the counter C is only incremented by 1 until the count number thereof reaches $T_1$. For example, the count number $T_1$ may be 25. At step 1009, when the count number of the counter C reaches 25, i.e., 100 milliseconds have elapsed, the control proceeds to step 1010 in which the ON/OFF signal $OS_{20}$ is changed from the low level "L" to the high level "H" (FIG. 11), so that the cleaning voltage of −500 volts is supplied from the constant voltage source circuit 20*b* of the electric power device 20 to the transfer roller 18. In this case, an electric potential difference between the photosensitive drum 10 and the transfer roller 18 can be substantially maintained at −500 volts because the drum surface is scanned with the laser beam LB, as mentioned above, whereby the negative toner particles by which the roller 18 is polluted can be effectively returned to the drum 10. At step 1011, the counter C is reset, and at step 1012, the flag $F_2$ is made "1". Thereafter, the routine is once ended.

As mentioned above, the supply of the cleaning voltage to the transfer roller 18 is later by 100 milliseconds than the driving of the motor 38 for the rotation of the drum 10 and the roller 18. This is to protect the conductive foam rubber roller 18 from damage thereto. In particular, although the drive signal $DS_{44}$ and the ON/-OFF signal $OS_{20}$ are simultaneously made "H", the rotation of the transfer roller 18 cannot be started at exactly the same time as the supply of the cleaning voltage to the roller 18, due to a backlash of the gear train provided between the motor 38 and the roller 18. Namely, before the rotation of the roller 18 is started, if the cleaning voltage is supplied to the roller 18, and thus a high electric current flows at a localized contacting zone between the drum 10 and roller 18, in a fusion of the conductive foam rubber surface of the roller 18 will occur due to the generation of Joule heat. Nevertheless, according to the present invention, the heat-fusing of the roller 18 can be effectively prevented because the supply of the cleaning voltage to the roller 18 is always carried out before the rotation of the roller 18.

When the routine is again executed after 4 ms, the control proceeds from step 1007 to step 1013 ($F_2$ ="1") in which the counter C is incremented by 1. Then, at step 1014, it is determined whether or not the counter C has counted up a given count number $T_2$. If $C < T_2$, the routine is once ended. Thereafter, the routine is repeatedly executed at intervals of 4 ms, but the counter C is only incremented by 1 until the count number thereof reaches $T_2$. According to the present invention, the count number $T_2$ corresponds to a time necessary for rotating the transfer roller 18 at least five times. For example, the count number $T_2$ may be 2500 corresponding to 10 sec. At step 1014, when the count number of the counter C reaches 2500, i.e., 10 seconds have elapsed, the control proceeds to step 1015 in which the drive signal $DS_{40}$ is made "L" (FIG. 11) so as to stop the rotation of the drum 10 and the roller 18. Then, at step 1016, the drive signal $DS_{44}$ is made "L" to deenergize the driver circuit 44 for the laser beam scanner 14, and at step 1017, the ON/OFF signal $OS_{20}$ is made "L", so that the pre-printing cleaning of the roller 18 is finished. Namely, the pre-printing cleaning process is executed within a period wherein the roller 18 is rotated at least five times.

At step 1018, the counter C is reset, and at steps 1019 and 1020, the flags $F_1$ and $F_2$ are made "0". Then, the control proceeds to step 1021 in which the printing ready signal is made "H", whereby the host control circuit 58 is informed that the ready for printing process has been completed. Thereafter, the routine is once ended.

When the routine is again executed after 4 ms, the control proceeds from step 1002 to step 1022, in which it is determined whether a printing command signal is low or high. The printing command signal is output from the host control circuit 58 to the printer control circuit 56 as information on whether or not image data to be printed is stored in the image memory 58*d*. When the image data to be printed is stored in the image memory 58*d*, the printing command signal is changed from the low level "L" to the high level "H". If the printing command signal is "L", the routine is once ended. Thereafter, the routine is repeatedly executed at intervals of 4 ms, but there is no further progress in the control until the printing command signal is made "H".

At step 1022, when the printing command signal is made "H", the control proceeds from step 1022 to step 1023, in which it is determined whether the flag $F_1$ is "1" or "0". At this time, since $F_1$="0", the control proceeds to step 1024 in which the drive signal $DS_{40}$ is made "H" (FIG. 11) to drive the motor 38 for rotation of the drum 10 and the roller. Then, at step 1025, the flag $F_1$ is made "1", and the routine is once ended.

When the routine is again executed after 4 ms, the control proceeds from step 1023 to step 1026, in which it is determined whether the flag $F_2$ is "1" or "0". At this time, since $F_1$="0" the control proceeds to step 1027 in which the counter C is incremented by 1. Then, at step 1028, it is determined whether or not the counter C has counted up a given count number $T_3$. If $C < T_3$, the routine is once ended. Thereafter, the routine is repeatedly executed at intervals of 4 ms, but the counter C is only incremented by 1 until the count number thereof reaches $T_3$. This count number $T_3$ is equal to $T_1$ (25=100 ms) for the same purpose. At step 1028, when the count number of the counter C reaches 25, the control proceeds to step 1029 in which the ON/OFF signal $OS_{20}$ is made "H" (FIG. 11), so that the cleaning voltage of −500 volts is supplied to the transfer roller 18. Then, at step 1030, the ON/OFF signal $OS_{42}$ is changed from the low level "L" to the high level "H" to energize the voltage source circuit 42 for the conductive brush 12, whereby a uniform charge distribution is produced on the surface of the photosensitive drum 10. At step 1031, the counter C is reset, and at step 1032, the flag $F_2$ is made "1". Thereafter, the routine is once ended.

When the routine is again executed after 4 ms, the control proceeds to step 1033 ($F_2$="1"), in which it is determined whether a flag $F_3$ is "1" or "0". Initially, since $F_3$="0" the control proceeds to step 1034 in which the counter C is incremented by 1. Then, at step 1035, it is determined whether or not the counter C has counted up a given count number $T_4$. If $C < T_4$, the routine is once ended. Thereafter, the routine is repeatedly executed at intervals of 4 ms, but the counter C is only incremented by 1 until the count number thereof reaches $T_4$. This count number $T_4$ corresponds to a time during which a location on the surface of the drum 10 is moved from the conductive brush 12 to the developing device 16. For example, the count number may be 80, corresponding to 320 ms. At step 1035, when the count number of the counter C reaches 80, i.e., 320 milliseconds have elapsed, the control proceeds to step 1036 in which the drive signal $DS_{48}$ is changed from the low level "L" to the high level "H" (FIG. 11) to drive the motor 46 for rotation of the developing roller 16*b*. Then, at step 1037, the counter C is reset, and at step 1038 the flag $F_3$ is made "1". Thereafter, the routine is once ended.

When the routine is again executed after 4 ms, the control proceeds to step 1039 ($F_3$="1") in which it is determined whether a flag $F_4$ is "1" or "0". Initially, since $F_4$="0" the control proceeds to step 1040 in which the counter C is incremented by 1. Then, at step 1041, it is determined whether or not the counter C has counted up a given count number $T_5$. If $C < T_5$, the routine is once ended. Thereafter, the routine is repeatedly executed at intervals of 4 ms, but the counter C is only incremented by 1 until the count number thereof reaches $T_5$. For example, the count number $T_5$ may be 25. At step 1041, when the count number of the counter C reaches 25, i.e., 100 milliseconds have elapsed, the control proceeds to step 1042 in which the ON/OFF signal $OS_{50}$ is changed from the low level "L" to the high level "H" (FIG. 11), so that the developing bias voltage of −600 volts is supplied from the voltage source circuit 50 to the developing roller 16*b*. At step 1043, the counter C is reset, and at step 1044, the flag $F_4$ is made "1". Thereafter, the routine is once ended.

Note, the reason why the supply of the developing bias voltage to the developing roller 16*b* is later by 100 milliseconds than the driving of the motor 46 for the rotation of the developing roller 16*b* is the same as the reason why the supply of the cleaning voltage to the transfer roller 18 is later by 100 milliseconds than the driving of the motor 38 for the rotation of the drum 10 and the transfer roller 18. Namely, this is to prevent heat-fused damage to the conductive foam rubber material of the developing roller 16*b*.

When the routine is again executed after 4 ms, the control proceeds to step 1045 ($F_4$="1") in which it is determined whether a flag $F_5$ is "1" or "0". Initially, since $F_5$="0" the control proceeds to step 1046 in which it is determined whether or not a writing of latent image on the photosensitive drum 10 is possible, i.e., whether or not a timing of a start of the latent image writing is correct for forming the latent image in place on the surface of the drum 10. If the latent image writing is impossible, the routine is once ended. Thereafter, the routine is repeatedly executed at intervals of 4 ms, but there is no further progress in the control until the latent image writing is made possible. In step 1046, if the latent image writing is possible, the control proceeds to step 1047 in which the laser beam LB is switched on and off on the basis of a binary image data successively transmitted from the host control circuit 58 to the printer control circuit 56. Namely, the writing of a latent image for one page on the drum 10 is started. Then, at step 1048, the flag $F_5$ is made "1", and the routine is once ended.

Note, in this embodiment, the switching on and off of the laser beam LB is carried out by selectively making the drive signal $DS_{44}$ "L" and "H" on the binary image data, and these "L" and "H" are symbolically represented by a plurality of raised line sections in FIG. 11. Also note, the latent image formed on the drum 10 is successively moved to the toner developing device 16, and is thus developed as a visible image with the toner, as mentioned above.

When the routine is again executed after 4 ms, the control proceeds to step 1049 ($F_5$="1") in which it is determined whether a flag $F_6$ is "1" or "0". Initially, since $F_6$="0" the control proceeds to step 1050 in which the counter C is incremented by 1. Then, at step 1051, it is determined whether or not the counter C has counted up a given count number $T_6$. If $C < T_6$, the routine is once ended. Thereafter, the routine is repeatedly executed at intervals of 4 ms, but the counter C is only incremented by 1 until the count number thereof reaches $T_6$. This count number $T_6$ corresponds to a time defined on the basis of the time at which the latent image writing is started. At step 1051, when the count number of the counter C reaches $T_6$, the control proceeds to step 1042 in which the drive signal $DS_{54}$ is changed from the low level "L" to the high level "H" (FIG. 11) to drive the motor 52, so that the register rollers 32, 32 are rotated to introduce a paper through the nip between the drum 10 and the roller 18. Note, the count number $T_6$ is selected such that the paper moved by the register rollers 32, 32 encounters the developed toner image at a given transfer position. At step 1053, the counter C is reset, and at step 1054, the flag $F_6$ is made "1". Thereafter, the routine is once ended.

When the routine is again executed after 4 ms, the control proceeds to step 1055 ($F_6$="1") in which it is determined whether a flag $F_7$ is "1", Initially, since $F_7$="0", the control proceeds to step 1056 in which the counter C is incremented by 1. Then, at step 1057, it is determined whether or not the counter C has counted up a given count number $T_7$. If $C < T_7$, the routine is once ended. Thereafter, the routine is repeatedly executed at intervals of 4 ms, but the counter C is only incremented by 1 until the count number thereof reaches $T_7$. This count number $T_7$ corresponds to a time defined on the basis of the time at which the drive signal $DS_{54}$ is made "H". At step 1057, when the count number of the counter C reaches $T_7$, the control proceeds to step 1058 in which the polarity changing signal $PS_{23}$ is changed from the low level "L" to the high level "H" (FIG. 11), so that the constant current of about 10 μA is supplied from the constant current source circuit 20*a* to the transfer roller 18. Note, the count number $T_7$ is selected such that the supply of the constant current to the roller 18 is carried out just before the developed toner image reaches the transfer position. At step 1059, the counter C is reset, and at step 1060, the flag $F_7$ is made "1". Thereafter, the routine is once ended.

When the routine is again executed after 4 ms, the control proceeds to step 1061 ($F_7$="1") in which it is determined whether or not the writing of the latent image for one page is completed. If the one-page latent image writing is not completed, the routine is once ended. Thereafter, the routine is repeatedly executed at intervals of 4 ms, but there is no further progress in the control until the one-page latent image writing is completed.

If the one-page latent image writing is completed, the control proceeds from step 1061 to step 1062 in which it is determined whether the printing command signal is low or high. If the printing command signal is made "H", i.e., the store of the image data to be printed is in the image memory 58*d*, the control proceeds to step 1063 in which it is determined whether a flag $F_8$ is "1" or "0". Initially, since $F_8$="0", the control proceeds to step 1064 in which the counter C is incremented by 1. Then, at step 1065, it is determined whether or not the counter C has counted up a given count number $T_8$. If $C < T_8$, the routine is once ended. Thereafter, the routine is repeatedly executed at intervals of 4 ms, but the counter C is only incremented by 1 until the count number thereof reaches $T_8$. This count number $T_8$ corresponds to a time necessary for a complete feeding of the paper by the register rollers 32, 32 and is defined on the basis of the time at which the polarity changing signal $PS_{20}$ is made "H". At step 1065, when the count number of the counter C reaches $T_8$, i.e., the paper is completely fed by the register rollers 32, 32, the control proceeds to step 1066 in which the drive signal $DS_{54}$ is made "L" to stop the drive of the motor 52. Then, at step 1067, the counter C is reset, and at step 1068 the flag $F_8$ is made "1". Thereafter, the routine is once ended.

When the routine is again executed after 4 ms, the control proceeds to step 1069 ($F_8$="1") in which it is determined whether a flag $F_9$ is "1" or "0". Initially, since $F_9$="0" the control proceeds to step 1070 in which the same determination as in step 1046 is carried out. If the latent image writing is impossible, the routine is once ended. Thereafter, the routine is repeatedly executed at intervals of 4 ms, but there is no further progress in the control until the latent image writing is made possible. In step 1070, if the latent image writing is possible, the control proceeds to step 1071 in which the same process as in step 1047 is carried out. Namely, the writing of a latent image for a next page on the drum 10 is started. Then, at step 1072, the flag $F_8$ is made "1", and the routine is once ended.

When the routine is again executed after 4 ms, the control proceeds to step 1073 ($f_9$="1") in which it is determined whether a flag $F_{10}$ is "1" or "0". Initially, since $F_{10}$="0" the control proceeds to step 1074 in which the counter C is incremented by 1. Then, at step 1057, it is determined whether or not the counter C has counted up a given count number $T_9$. If $C < T_9$, the routine is once ended. Thereafter, the routine is repeatedly executed at intervals of 4 ms, but the counter C is only incremented by 1 until the count number thereof reaches $T_9$. This count number $T_9$ corresponds to a time defined on the basis of the time at which the latent image writing for the first page is completed. At step 1075, when the count number of the counter C reaches $T_9$, the control proceeds to step 1076 in which the polarity changing signal $PS_{20}$ is made "L" (FIG. 11), so that the cleaning voltage of −500 volts is supplied from the constant voltage source circuit **20*b* of the electric power device 20 to the transfer roller 18. Namely, the count number $T_9$ is selected such that the cleaning process of the roller 18 is executed just after the transfer of the developed toner image for the first page is completed. Then, at step 1077, the counter C is reset, and at step 1078** the flag $F_{10}$ is made "1". Thereafter, the routine is once ended.

When the routine is again executed after 4 ms, the control proceeds to step 1079 ($F_{10}$="1") in which it is determined whether a flag $F_{11}$ is "1" or "0". Initially, since $F_{11}$="0", the control proceeds to step 1080 in which the counter C is incremented by 1. Then, at step 1081, it is determined whether or not the counter C has counted up a given count number $T_{10}$. If $C<T_{10}$, the routine is once ended. Thereafter, the routine is repeatedly executed at intervals of 4 ms, but the counter C is only incremented by 1 until the count number thereof reaches $T_{10}$. This count number $T_{10}$ is equal to $T_6$. Namely, the count number $T_{10}$ is selected such that the paper moved by the register rollers 32, 32 encounters the developed toner image at the given transfer position. At step 1081, when the count number of the counter C reaches $T_{10}$, the control proceeds to step 1082 in which the drive signal $DS_{54}$ is made "H" (FIG. 11) to drive the motor 52, so that the register rollers 32, 32 are rotated to introduce a next paper through the nip between the drum 10 and the roller 18. Then, at step 1083, the counter C is reset, and at step 1084 the flag $F_{11}$ is made "1". Thereafter, the routine is once ended.

When the routine is again executed after 4 ms, the control proceeds to step 1085 ($F_{11}$="1") in which the flags $F_7$ to $F_{11}$ are made "0", and the routine is once ended. When the routine is again executed after 4 ms, the control proceeds to step 1055, and the steps 1055 to 1085 are repeatedly processed until the printing command signal is made "L" at step 1062.

At step 1062, when the printing command signal is made "L", i.e., no image data to be printed is stored in the image memory **58*d*, the control proceeds from step 1062 to step 1086 in which it is determined whether the flag $F_8$ is "1" or "0". At this time, since $F_8$="0", the control proceeds to step 1087 in which the counter C is incremented by 1. Then, at step 1088, it is determined whether or not the counter C has counted up a given count number $T_{11}$. If $C<T_{11}$, the routine is once ended. Thereafter, the routine is repeatedly executed at intervals of 4 ms, but the counter C is only incremented by 1 until the count number thereof reaches $T_{11}$. This count number $T_{11}$ corresponds to a time defined on the basis of the time at which the polarity changing signal $PS_{20}$ is made "H" for transferring the developed toner image for the last page. At step 1088, when the count number of the counter C reaches $T_{11}$, the control proceeds to step 1089 in which the drive signal $DS_{54}$ is made "L" (FIG. 11) to stop the drive of the motor 52. Note, the count number $T_{11}$ is selected such that the last paper can be completely fed by the register rollers 32, 32. Then, at step 1090, the counter C is reset, and at step 1091**, the flag $F_8$ is made "1". Thereafter, the routine is once ended.

When the routine is again executed after 4 ms, the control proceeds to step 1092 ($F_8$="1") in which it is determined whether the flag $F_9$ is "1" or "0". At this time, since $F_9$="0" the control proceeds to step 1093 in which the counter C is incremented by 1. Then, at step 1094, it is determined whether or not the counter C has counted up a given count number $T_{12}$. This count number $T_{12}$ corresponds to a suitable time defined on the basis of the time at which the drive signal $DS_{54}$ is finally made "L". At step 1094, when the count number of the counter C reaches $T_{12}$, the control proceeds to step 1095 in which the ON/OFF signal $OS_{42}$ is made "L" (FIG. 11) to deenergize the voltage source circuit 42 for the conductive brush 12, and then at step 1096, the ON/OFF signal $OS_{50}$ is made "L", so that the supply of the developing bias voltage of −600 volts from the voltage source circuit 50 to the developing roller **16*b* is stopped. Successively, at step 1097, the drive signal $DS_{48}$ is made "L" to stop the drive of the motor 46. Then, at step 1098, the counter C is reset, and at step 1099**, the flag $F_9$ is made "1". Thereafter, the routine is once ended.

When the routine is again executed after 4 ms, the control proceeds to step 1100 ($F_9$="1") in which it is determined whether the flag $F_{10}$ is "1" or "0". At this time, since $F_{10}$="0", the control proceeds to step 1101 in which the counter C is incremented by 1. Then, at step 1102, it is determined whether or not the counter C has counted up a given count number $T_{13}$. If $C<T_3$, the routine is once ended. Thereafter, the routine is repeatedly executed at intervals of 4 ms, but the counter C is only incremented by 1 until the count number thereof reaches $T_{13}$. This count number $T_{13}$ also corresponds to a suitable time defined on the basis of the time at which the drive signal $DS_{48}$ is made "L". At step 1102, when the count number of the counter C reaches $T_{13}$, the control proceeds to step 1103 in which the polarity changing signal $PS_{20}$ is made "L" (FIG. 11), so that the cleaning voltage of −500 volts is supplied from the constant voltage source circuit **20*b* of the electric power device 20 to the transfer roller 18. Namely, an execution of a post-printing cleaning of the transfer roller 18 is started. At step 1104, the drive signal $DS_{44}$ is made "H" (FIG. 11) to energize the driver circuit 44 for emitting the laser beam LB from the laser source 14*a*, so that the surface of the drum 10 is scanned with the laser beam LB, whereby a charge of the drum 10, which results from the triboelectrification with the conductive brush 12, can be eliminated from the drum surface. Then, at step 1105, the counter C is reset, and at step 1106**, the flag $F_{10}$ is made "1". Thereafter, the routine is once ended.

When the routine is again executed after 4 ms, the control proceeds to step 1107 ($F_{10}$="1") in which it is determined whether the flag $F_{11}$ is "1" or "0". At this time, since $F_{11}$="0", the control proceeds to step 1108 in which the counter C is incremented by 1. Then, at step 1109, it is determined whether or not the counter C has counted up a given count number $T_{14}$. If $C < T_{14}$, the routine is once ended. Thereafter, the routine is repeatedly executed at intervals of 4 ms, but the counter C is only incremented by 1 until the count number thereof reaches $T_{14}$. This count number $T_{14}$ corresponds to a time necessary for rotating the transfer roller 18 at least one time and defined on the basis of the time at when the polarity changing signal $PS_{20}$ is made "L". For example, the count number $T_{14}$ may be 500, corresponding to 2 sec. At step 1109, when the count number of the counter C reaches 500, i.e., 2 seconds have elapsed, the control proceeds to step 1110 in which the ON/OFF signal $OS_{20}$ is made "L" (FIG. 11), so that the post-printing cleaning of the roller 18 is finished, and then at step 1111, the drive signal $DS_{40}$ is made "L" so as to stop the rotation of the drum 10 and the roller 18. Successively, at step 1112, the drive signal $DS_{44}$ is made "L" to deenergize the driver circuit 44 for the laser beam scanner 14. Then, at step 1113, the counter C is reset, and at step 1114, the flag $F_{11}$ is made "1". Thereafter, the routine is once ended.

When the routine is again executed after 4 ms, the control proceeds to step 1115 ($F_{11}$="1" ) in which the flags $F_1$ to $F_{11}$ are made "0". Thereafter, the routine is repeatedly executed at intervals of 4 ms, but there is no progress in the control until the printing command signal is made "H" at step 1022. Namely, the printer is put in a standby condition.

Note, when a paper is jammed in the printer during an operation thereof, the transfer roller 18 may be greatly polluted with an toner image directly transferred thereto. In this case, the movable housing cover 26 is opened to remove the jammed paper from the printer, so that the ON/OFF switch **56*f* (FIG. 9) is turned OFF. Thus, the control proceeds from step 1001 to step 1116 in which the counter C is reset. Then, at step 1117, the flags $F_1$ to $F_{11}$ are made "0", and at step 1118, the printing ready signal is made "L". Thus, the pre-printing cleaning of the transfer roller 18** is executed.

Figure 12A:
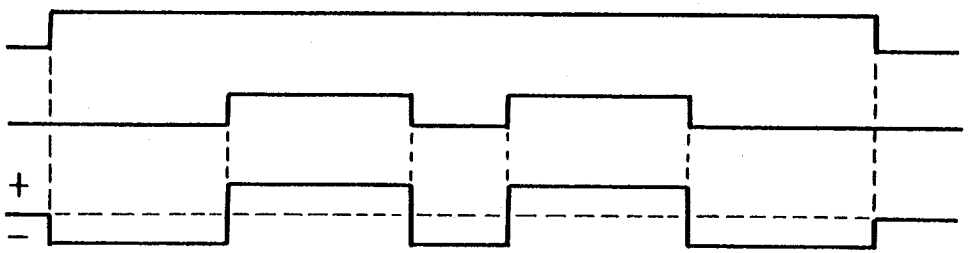
FIG. 12(*a*) is a time chart relating to an output voltage of the electric power device shown as the block diagram in FIG. 3(*b*), and an ON/OF signal and a polarity changing signal input therein.
Figure 12B:
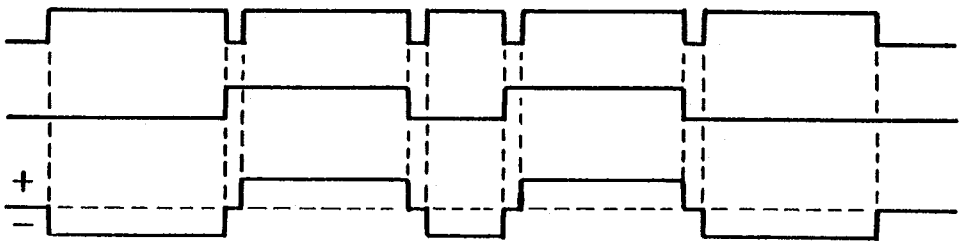

When the polarity changing signal $PS_{20}$ is changed from the low level "L" to the high level "H" in the condition that the ON/OFF signal $OS_{20}$ is maintained at the high level "H", an output voltage applied from the electric power device 20 to the conductive transfer roller 18 is abruptly raised from the negative side to the positive side, as shown in a time chart of FIG. 12(*a*), so that a spark discharge and an insulation breakage may occur in the electric power device 20. Accordingly, it is preferable to change the ON/OFF signal $OS_{20}$ from the high level "H" to the low level "L" for a short time when the polarity changing signal $PS_{20}$ is changed from the low level "L" to the high level "H". as shown a time chart of FIG. 12(*b*). In this case, the output voltage applied from the electric power device 20 to the transfer roller 18 is raised step-wise from the negative side to the positive side (FIG. 12(*b*)), so that the occurrence of the spark discharge and insulation breakage can be prevented.

According to the present invention, preferably, the conductive foam rubber roller 18 is constituted such that pore openings appear over the outer surface thereof. If the roller element **18*b* has an outer solid or skin surface, the toner particles can be firmly adhered to the skin surface. Of course, it is difficult to remove these firmly adhered toner particles from the skin surface of the roller by only applying the cleaning voltage thereto. When the skin surface of the roller is greatly by polluted with the toner particles, this polluted roller leaves a stain on a rear surface of a paper during the toner image transferring process. On the other hand, when the roller having the outer skin layer is coated with Teflon (Trademark), a removal of the toner particles from the roller surface by the apply of the cleaning voltage can be facilitated due to the Teflon coating thereof. Nevertheless, all of the toner particles cannot be completely removed from the roller surface. Namely, a small amount of toner particles is inevitably left on the Teflon coated roller surface, and there residual toner particles stain a rear surface of a paper during the toner image transferring process, because the residual toner particles can be easily removed from the Teflon-coated roller surface when the paper is in contact with the roller. When the pore openings appear over the outer surface of the conductive foam rubber roller, an amount of residual toner particles is larger than in the Teflon coated roller because the residual toner particles are trapped in the pore openings of the roller surface. Nevertheless, the trapped toner particles cannot be easily removed from the roller to the paper in contact therewith, and thus no stain is left on the rear surface of the paper during the toner image transferring process. Also, preferably, the roller element 18*b* of the roller 18** has a closed cell foam structure by which a penetration of the residual toner particles therein can be prevented.

As mentioned hereinbefore, the pre-printing cleaning process should be executed over the period necessary for rotating the conductive transfer roller 18 at least five times. This has been proved by the following experiment:

First, two conductive foam rubber rollers having diameters 12 mm and 14 mm were intentially polluted with a developer or toner having an average charge of $-10\ \mu C/g$. Namely, a solid toner layer was electrostatically adhered to a surface of a photosensitive drum, and then was directly transferred to each roller. Thereafter, a cleaning voltage of $-500$ volts was applied to each roller to electrostatically remove the toner particles from the surface of each roller, and a time over which the cleaning voltage is applied to each roller was stepwise varied. Note, an electric potential of the surface of the drum is substantially maintained at zero volt by an irradiation of a scanning laser beam. The results are shown in a graph of FIG. 13(*a*). In this graph: the abscissa indicates a time of cleaning, i.e., a cleaning-voltage applying time; the left ordinate indicates an efficiency of cleaning, i.e., a ratio (%) of an amount of removed toner particles to an amount of transferred toner particles; and the right ordinate indicates an optical density of stain left on a rear surface of a paper passed through the nip between the cleaned roller and the drum. As apparent from the graph of FIG. 13(*a*), with respect to the roller having the diameter of 12 mm, a cleaning time of more than 3 sec is necessary before a cleaning efficiency of more than 80% and a stain optical density of less than 0.01 (OD), which can be generally evaluated as at least good, can be obtained. Also, with respect to the roller having the diameter of 20 mm, a cleaning time of more than 5 sec is necessary for obtaining the same evaluation as the 12 mm diameter roller.

Figure 13A:
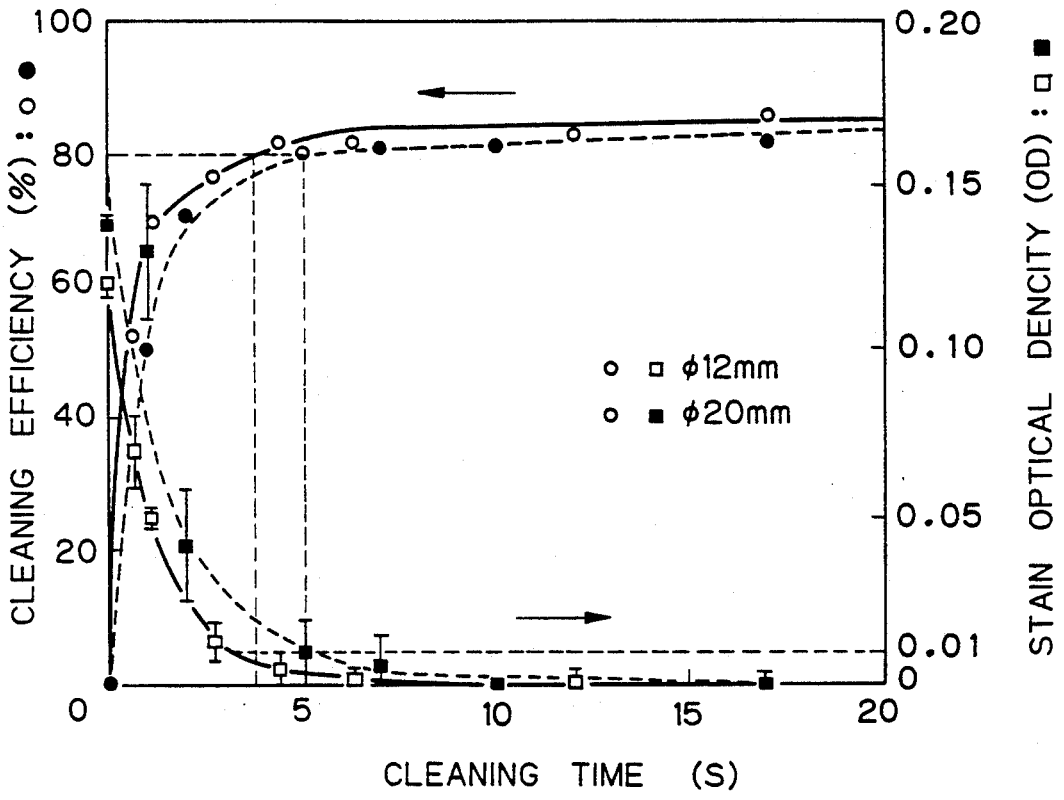
FIG. 13(*a*) is a graph showing a relationship between a cleaning time and a cleaning efficiency and a stain optical density.
Figure 13B:
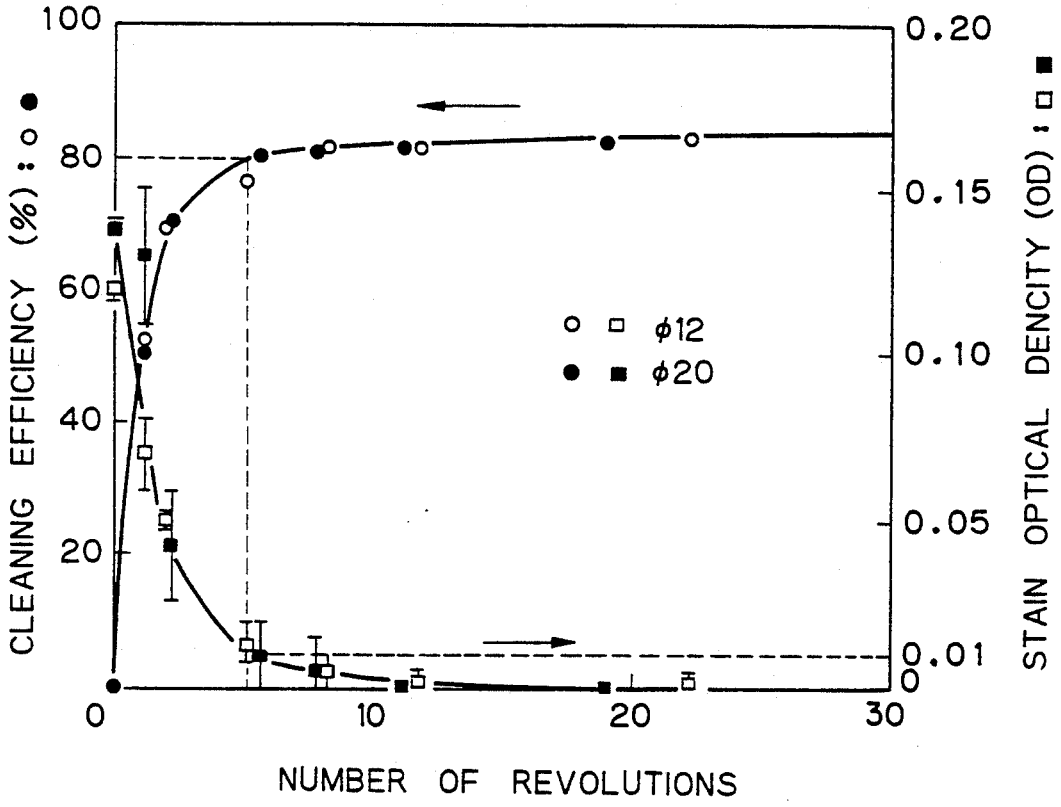

FIG. 13(*b*) shows a graph derived from the graph of FIG. 13(*a*). Namely, in the graph 13(*b*), the plottings indicating the cleaning efficiency and the stain optical density are made with respect to the abscissa indicating a number of revolutions of the rollers in place of the cleaning time. As seen from the graph of FIG. 13(*b*), the respective rollers having the diameters of 12 mm and 20 mm must be rotated at least five times before the cleaning efficiency of more than 80% and the stain optical density of less than 0.01 (OD) can be obtained.

Figure 14:
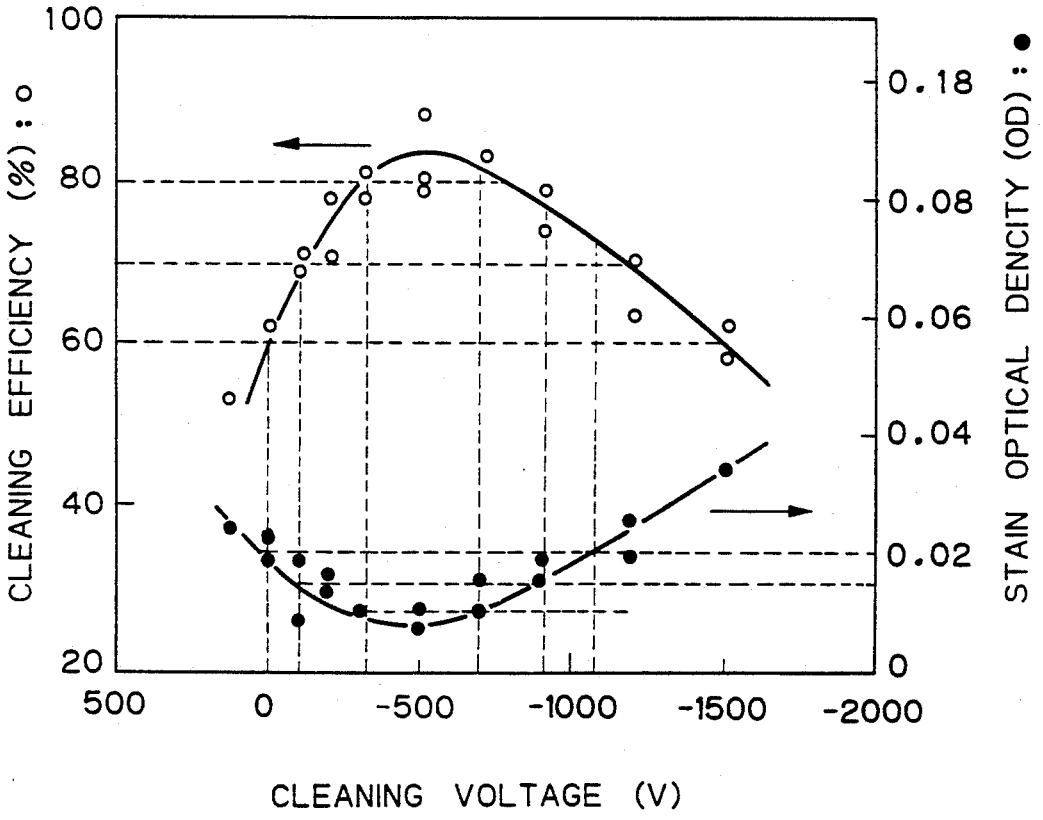
FIG. 14 is a graph showing a relationship between a cleaning voltage and a cleaning efficiency and a stain optical density.

FIG. 14 is a graph showing a relationship between a cleaning voltage and a cleaning efficiency and a stain optical density, resulting from the varying of the cleaning voltage. As apparent from this graph, a potential difference between the roller and the drum must be a voltage of from about 300 to about 700 volts before the cleaning efficiency of more than 80% and the stain optical density of less than 0.01 (OD) can be obtained.

In general, an electric charge of the developer or toner, and therefore, a charge distribution of the toner particles is easily changed by a variation of the temperature and air moisture content. Namely, a part of the toner particles has a smaller charge than an average charge of the toner particles, and a small part of the toner particles may even have a polarity opposite to that of the average charge.

Figure 15:
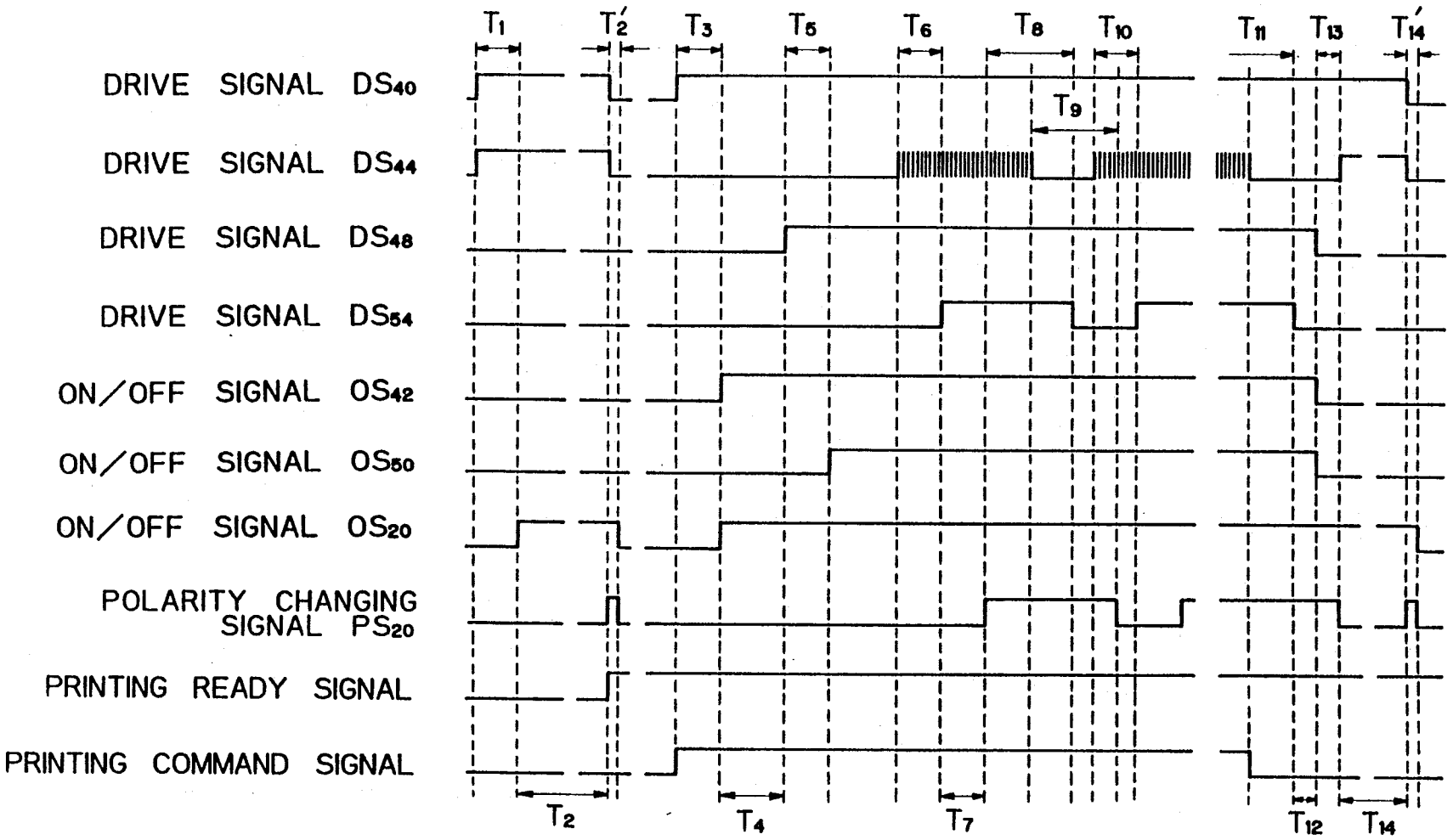
FIG. 15 is a time chart showing a modification of FIG. 11.

For this reason, in the embodiment as mentioned above, when the negative cleaning voltage is applied to the transfer roller 18, a small amount of the toner particles having the positive charge is not removed from the roller 18 but rather attracted thereto. To remove these positive toner particles from the roller 18, the constant current of about 10 μA is preferably applied to the roller 18 just after the pre-printing cleaning process and/or the post-printing cleaning process is finished. In particular, as shown in a time chart of FIG. 15, the point of time at which the ON/OFF signal $OS_{20}$ is made "L" to end the pre-printing cleaning process is extended by a time corresponding to a count number $T_2'$, and the polarity changing signal $PS_{20}$ is made "H" over the time corresponding to the count number $T_2'$. Similarly, the point of time at which the ON/OFF signal $OS_{20}$ is made "L" to end the post-printing cleaning process is extended by a time corresponding to a count number $T_{14}'$, and the polarity changing signal $PS_{20}$ is made "H" over the time corresponding to the count number $T_{14}'$. Thus, the voltage having the polarity (+) opposite to that of the cleaning voltage is applied to the roller 18 just after the pre- and post-printing cleaning processes, whereby the positive toner particles can be removed from the roller 18.

Figure 16:
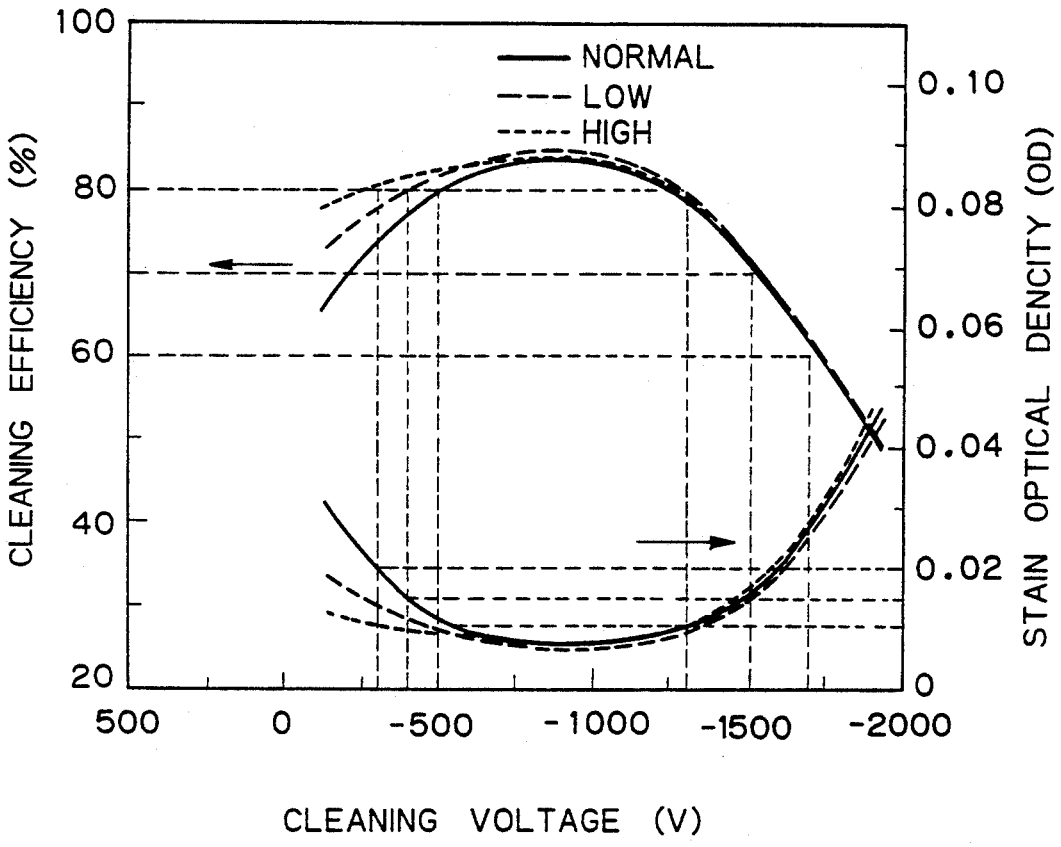
FIG. 16 is another graph showing a relationship between a cleaning voltage and a cleaning efficiency and a stain optical density.

FIG. 16 is a graph showing a relationship between a cleaning voltage and a cleaning efficiency and a stain optical density, resulting from the following experiment:

First, a conductive foam rubber roller was intentionally polluted with a developer or toner having an average charge of −10 μC/g. Namely, a solid toner layer was electrostatically adhered to a surface of a photosensitive drum, and then was directly transferred to the conductive transfer roller. Thereafter, a negative cleaning voltage was applied to the roller over a time of 8 sec to electrostatically remove the toner particles from the surface of the roller, and a constant current was then applied to the roller over a time of 2 sec to remove the residual or positive toner particles form the surface of the roller, under three circumstances of a normal temperature and normal air moisture content; a low temperature and low air moisture content; and a high temperature and high air moisture content. The negative cleaning voltage was step-wise varied, but the constant current was 10 μA. Note, an electric potential of the surface of the drum is substantially maintained at zero volt by an irradiation of a scanning laser beam. The results are shown in a graph of FIG. 16. In this graph, the abscissa indicates a negative cleaning voltage; the left ordinate indicates an efficiency of cleaning; and the right ordinate indicates an optical density of stain left on a rear surface of a paper. As apparent from the graph of FIG. 16, the negative voltage of from about −500 to about 3000 volts must be applied to the roller before the cleaning efficiency of more than 80% and the stain optical density of less than 0.01 (OD) can be obtained.

Figure 17:
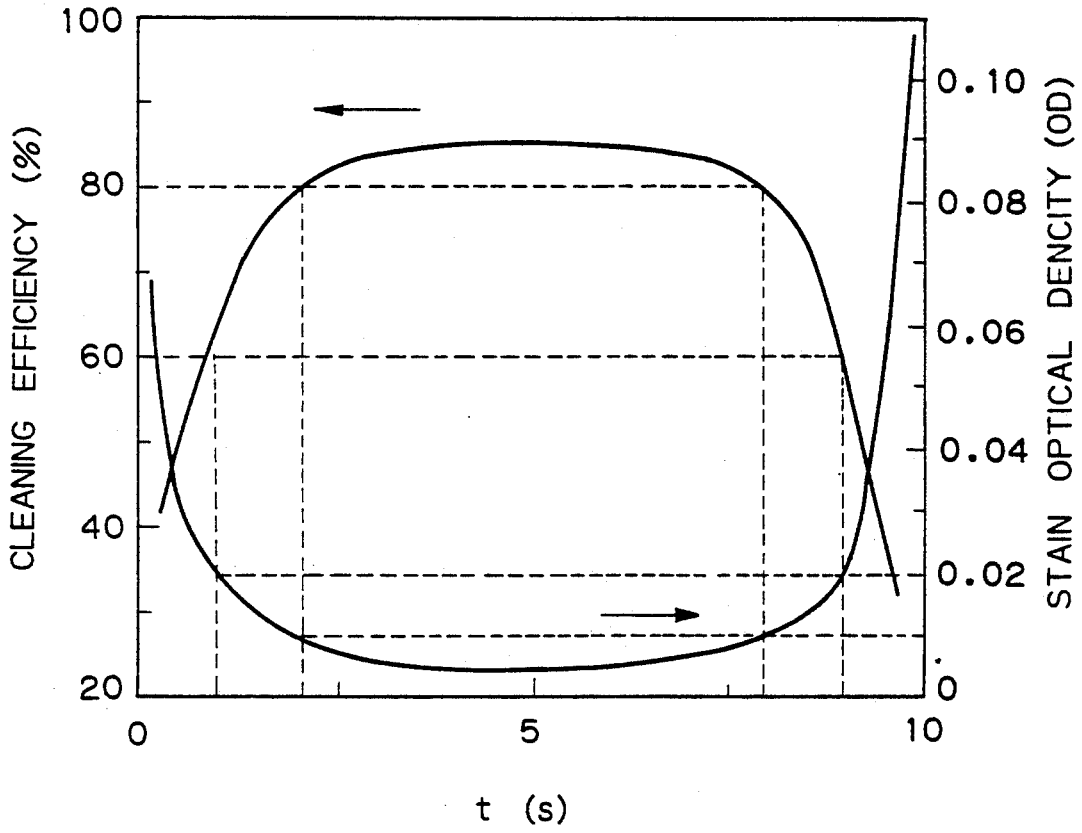
FIG. 17 is a graph showing a relationship between an cleaning voltage-applying time and a cleaning efficiency and a stain optical density.

FIG. 17 shows a graph resulting from the following experiment:

A conductive foam rubber roller was intentionally polluted in the same manner as in FIG. 16. A negative cleaning voltage of −1000 volts was applied to the polluted roller over a time (10−T) sec, and a constant current of 10 μA was then applied thereto over a time T in seconds. This time T was step-wise varied. Note, the roller was rotated at one revolution per second.

As apparent from the graph of FIG. 17, the constant current should be applied to the roller for cleaning over a time necessary for rotating the roller about 2 to about 8 times, before a toner transfer efficiency of more than 80% and a stain optical density of less than 0.01 OD can be obtained.

Figure 18:
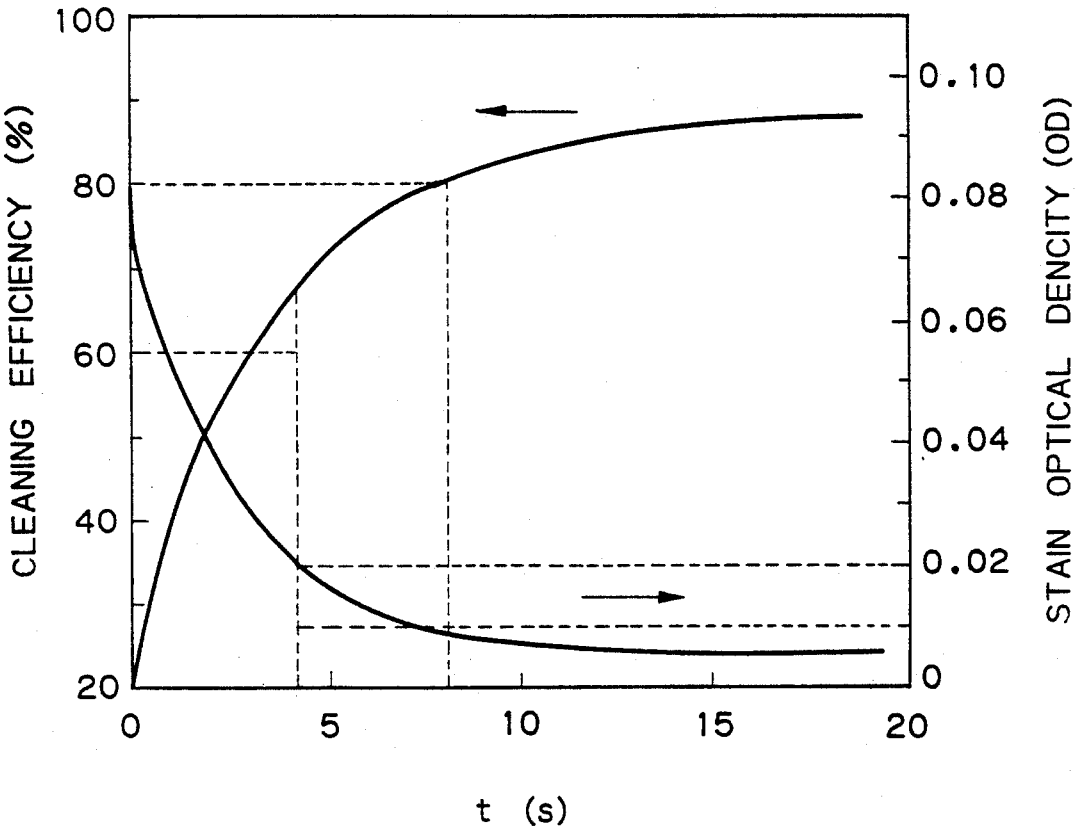
FIG. 18 is another graph showing a relationship between an cleaning voltage-applying time and a cleaning efficiency and a stain optical density.

FIG. 18 shows another graph resulting from the following experiment:

A conductive foam rubber roller was intentionally polluted in the same manner as in FIG. 16. A negative cleaning voltage of −1000 volts was applied to the polluted roller, and a constant current of 10 μA was then applied thereto. A time t over which the cleaning voltage of −1000 volts is applied to the roller was step-wise varied, whereas a time over which the constant current of 10 μA is applied to the roller was fixed at 2 sec. Note, the roller was rotated at one revolution per second.

As apparent from the graph of FIG. 18, the cleaning voltage should be applied to the roller for cleaning over a time necessary for rotating the roller at least 8 times, before a toner transfer efficiency of more than 80% and a stain optical density of less than 0.01 (OD) can be obtained.

When the toner developing device 16 using the non-magnetic type one-component developer is incorporated in the printer, it is preferable to separate the developing roller 16*b* from the photosensitive drum 10 during the pre- and/or post-printing cleaning processes. In particular, as apparent from the time charts of the FIGS. 11 and 15, during the pre- and post-printing cleaning processes, the developing bias voltage is not applied to the developing roller 16*b* so that a movement of the toner particles from the developing roller 16*b* to the drum 10 should be prevented. Nevertheless, a small amount of toner particles, which has a smaller charge (inclusive of a positive charge) than the average charge of the developer or toner, may be easily entrained by the drum 10. Accordingly, the developing roller 16*b* should be separated from the drum 10 during the pre- and/or post-printing cleaning processes before a cleaning efficiency of the conductive transfer roller 18 can be enhanced.

Figure 19A:
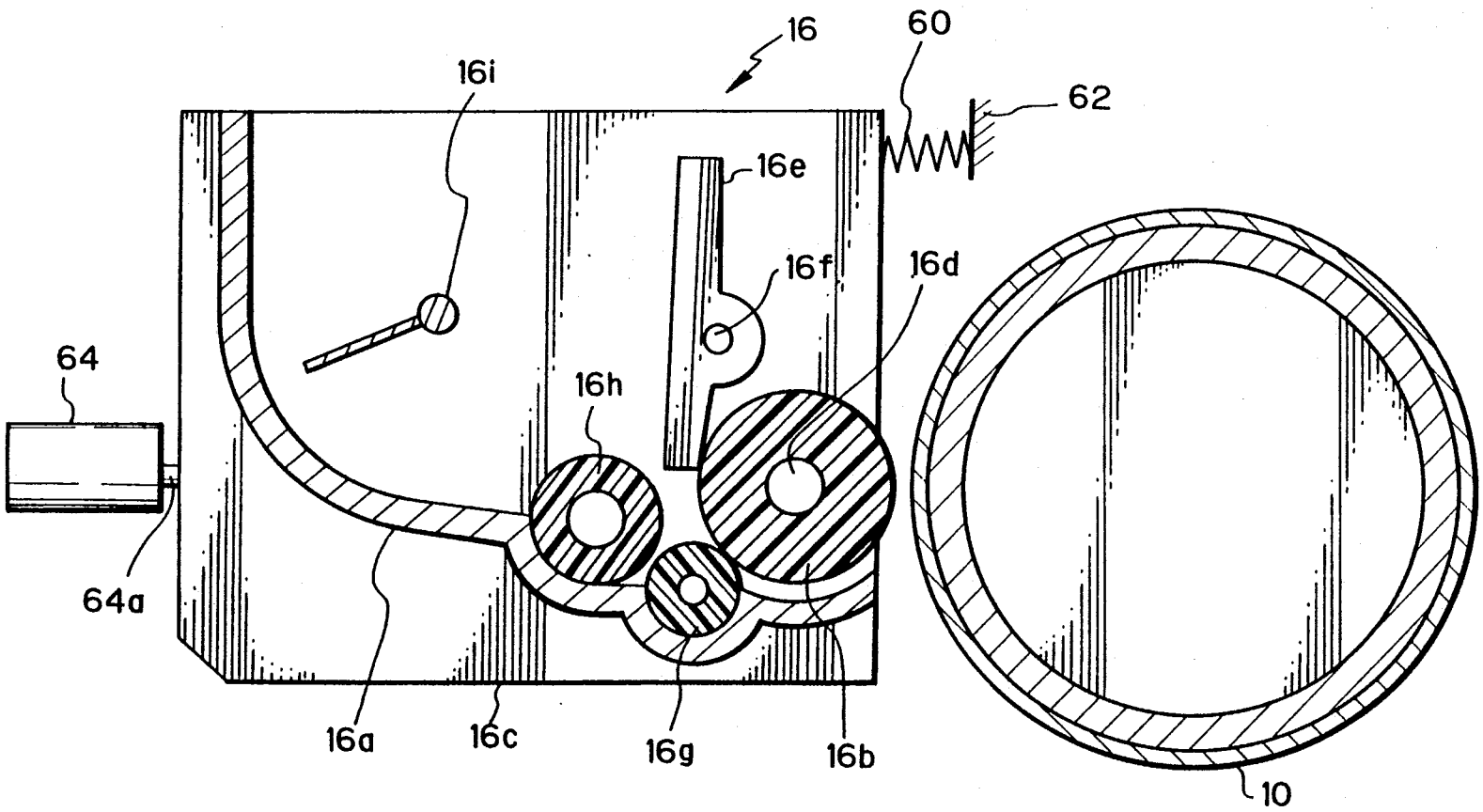
FIG. 19(*a*) is a schematic view of a developing device in relation to the toner image transferring device according to the present invention.
Figure 19B:
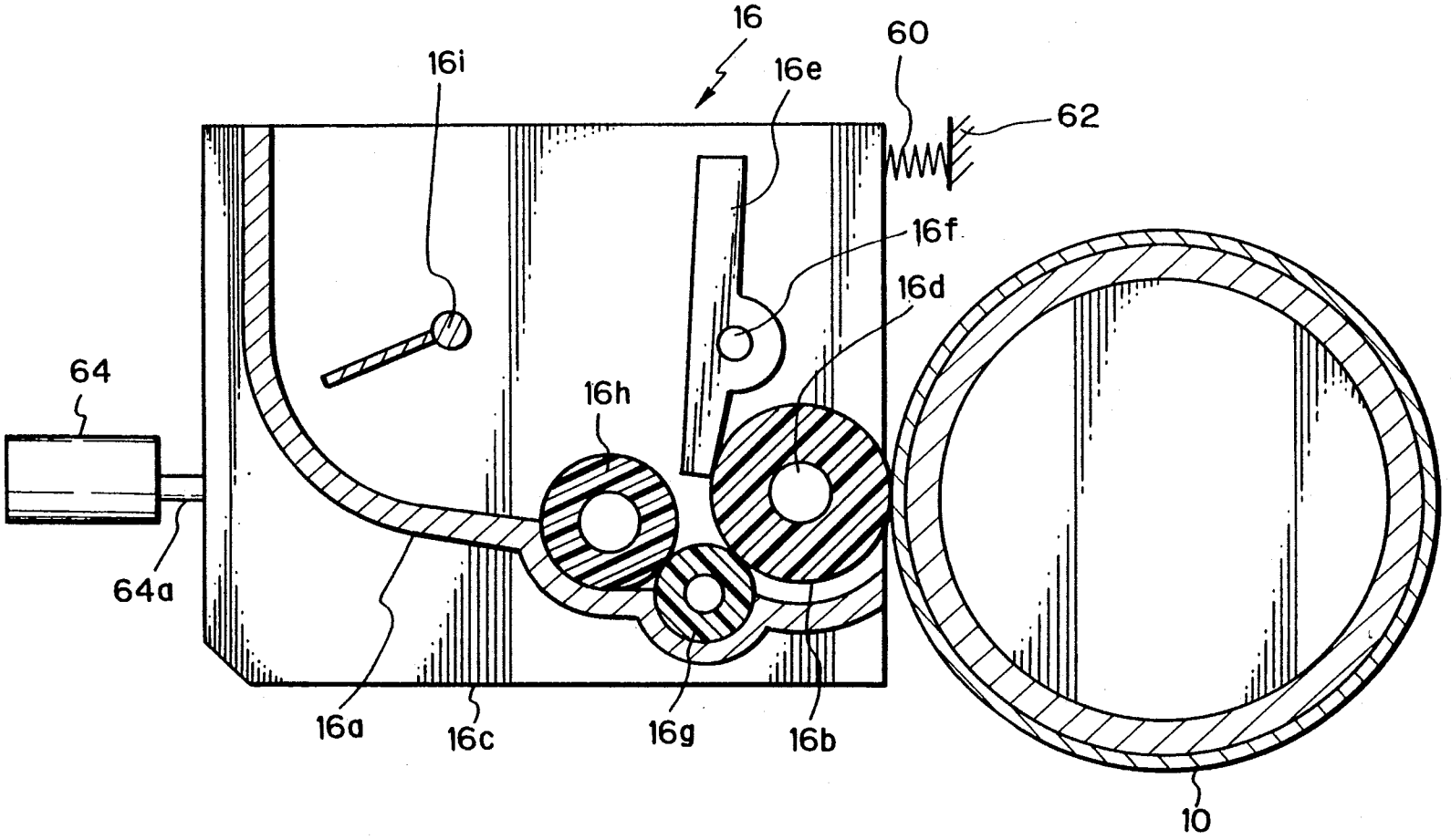

For this reason, the developing device 16 may be constructed as shown in FIGS. 19(*a*) and 19(*b*). In this embodiment, the vessel 16*a* has a generally rectangular parallelepiped shape, and is received in and supported by a frame casing 16*c*, which is then supported by a printer frame (not shown) to be moved toward and away from the drum 10. The developing roller 16*b* has a shaft 16*d* rotatably supported by the side walls of the vessel 16*c*. The developing device 16 also includes a blade member 16*e* engaged with the surface of the developing roller 16*b* and is resiliently biased by a spring (not shown), to uniformalize a thickness of the developer layer formed therearound. The blade member 16*e* is pivotably mounted between the side walls of the vessel 16*a* by pivot pins 16*f*. A toner-removing roller 16*g* is rotatably provided within the vessel 16*a*, and is engaged with the developing roller 16*b*, so that remaining toner particles not used for the development of the latent image are removed from the developing roller 16*b*. A paddle roller 16*h* is also rotatably provided within the vessel 16*a* for moving the toner particles toward the developing roller 16*b*, and an agitator 16*i* serves to agitate the developer for eliminating dead stock from the vessel 16*a*.

As shown in FIGS. 19(*a*) and 19(*b*), a coil spring 60 is disposed between the frame casing 16*c* and a portion 62 of the printer frame so that the frame casing 16*c* is resiliently biased to a position shown in FIG. 19(*a*) in which the developing roller 16*b* is separated from the drum 10. The developing device 16 is provided with a solenoid actuator 64 supported by the printer frame and having a working rod 64*a* connected to the back wall of the frame casing 16*c*. When the solenoid actuator 64 is electrically energized, the working rod 64*a* is extended so that the frame casing 16*c* is moved toward the drum 10, whereby the developing roller 16*b* is pressed against the surface of the drum 10. Namely, the developing device 16 is in a developing position. When the solenoid actuator 64 is electrically de-energized, the working rod 64*a* is retracted by the resilient force of the coil spring 60, and thus the frame casing 16*c* is resiliently biased to the position shown in FIG. 19(*a*) by the coil spring 60, whereby the developing roller 26 is separated from the drum 10. For example, the solenoid actuator 64 is constituted so as to be electrically energized when the motor 50 is driven, i.e., the drive signal $DS_{48}$ is made "H", and thus the developing roller 16*d* is separated from the drum 10 during the pre- and post-printing cleaning processes.

Figure 20A:
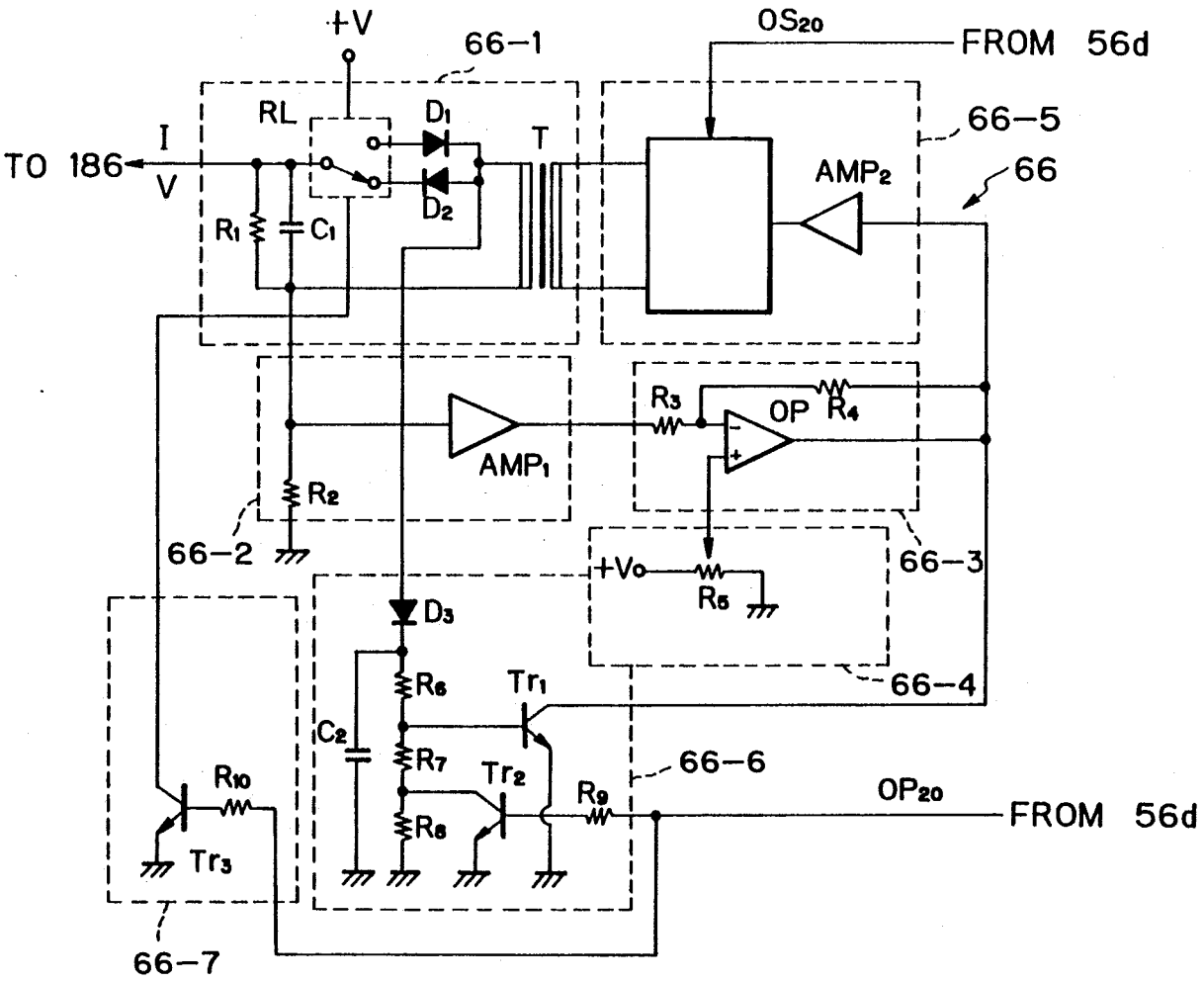
FIG. 20(*a*) is a circuit diagram of another electric power device used in the toner image transferring device according to the present invention.
Figure 20B:
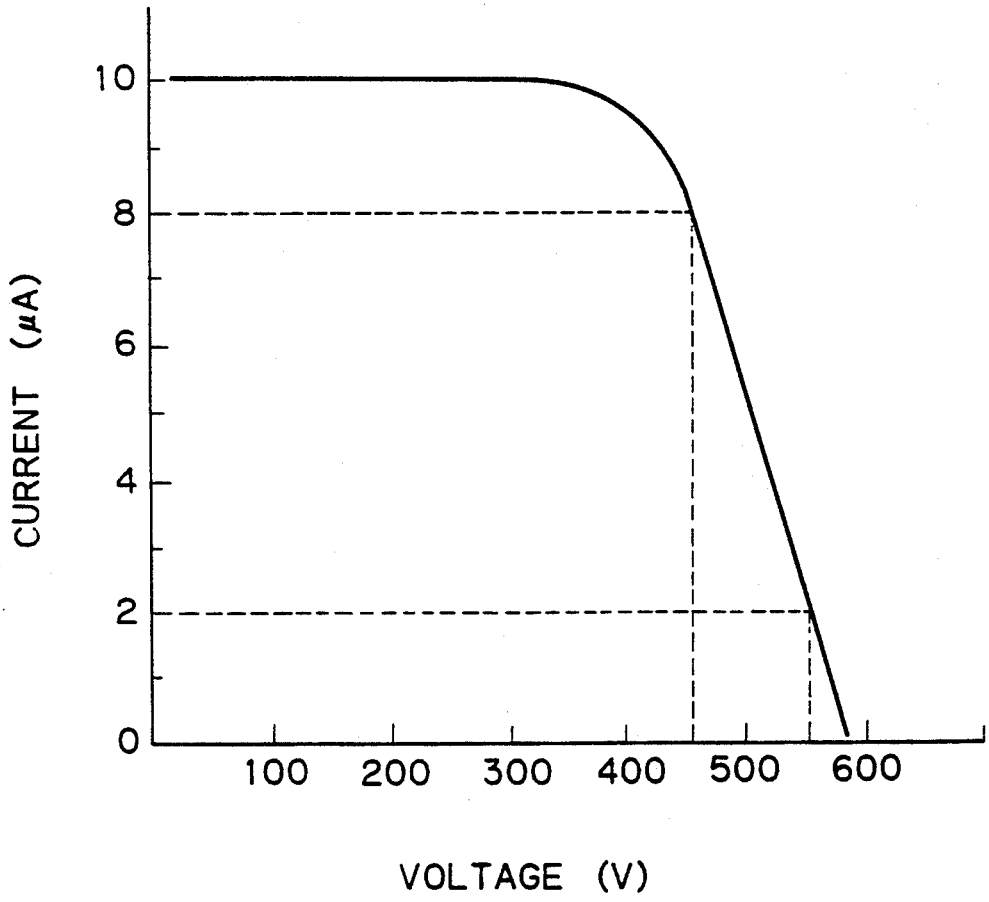

FIG. 20(*a*) shows an electric power device 66 which can be used in place of the electric power device 20 shown in FIG. 3(*b*). The electric power device 66 includes: a direct current source circuit 66-1 having a high voltage transformer T, diodes $D_1$ and $D_2$, a capacitor $C_1$, a resistor $R_1$, and a relay RL; a detecting circuit 66-2 having a resistor $R_2$, and an amplifier $AMP_1$; a comparing/amplifying circuit 66-3 having an operational amplifier OP, resistors $R_3$ and $R_4$; a reference voltage setting circuit 66-4 having an adjustable resistor $R_5$; a controlling circuit 66-5 having an oscillator Q, and an amplifier $P_2$; a voltage limiting circuit 66-6 having transistors $Tr_1$ and $Tr_2$, a diode $D_3$, a capacitor $C_2$, and a resistors $R_6$, $R_7$, $R_8$, and $R_9$; and a polarity changing circuit 66-7 having a transistor $Tr_3$, and a resistor $R_{10}$.

When the ON/OFF signal $OS_{20}$ is made "H" and when the polarity changing signal $OS_{20}$ is made "L" the , electric power device 66 is operated in essentially the same manner as the constant current source 20*a* shown in FIG. 8(*a*). Namely, a constant current I is output from the direct current source circuit 66-1 in accordance with the I-V characteristic as shown in FIG. 8(*b*). Nevertheless, when the ON/OFF signal $OS_{20}$ is made "H", and when the polarity changing signal $OS_{20}$ is made "H", the electric power device 66 functions as a constant voltage source. In particular, when the polarity changing signal $OS_{20}$ is made "H", the transistor $Tr_2$ is turned on so that a voltage applied to a base of the transistor $Tr_1$ is raised, and then the transistor $Tr_1$ is turned on. Thus, an output end of the comparing/amplifying circuit 66-3 is grounded through the transistor $Tr_1$, and thus a value of the current I is abruptly lowered as shown in an V-I characteristic of FIG. 20(*b*). On the other hand, when the polarity changing signal $OS_{20}$ is made "H", a voltage applied to a base of the transistor $Tr_3$ is raised so that the transistor $Tr_3$ is turned on, and thus the relay RL is switched to conduct the diode $D_1$. As a result, a substantially constant negative voltage V of from about −450 to about −550 (FIG. 20(*b*)) is output from the circuit 66-1. Accordingly, the electric power device 66 serves as both a constant current source for the toner transferring process and a constant voltage source for the cleaning process.

Figure 21:
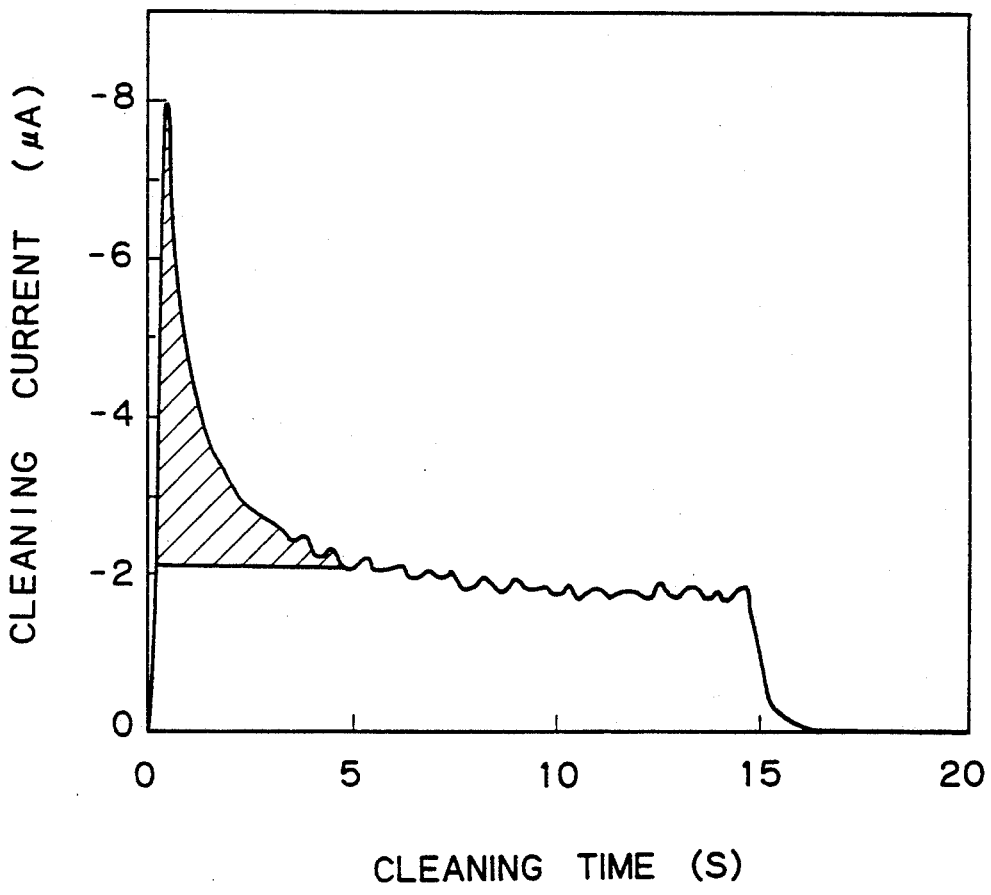
FIG. 21 is a graph showing a relationship between a cleaning time and a cleaning current.

FIG. 21 is a graph showing a relationship between a cleaning time and a cleaning current when using an electric power device as shown in FIG. 12(*a*). As apparent from this graph, the cleaning current has a peak of about −8 μA as soon as a cleaning voltage is applied from the electric power device (66) to a polluted transfer roller (the polarity changing signal $OS_{20}$ is made "H"), and is then stable at −2 μA. After 15 sec, the cleaning current is made zero. This characteristic matches that of FIG. 20(*b*). Note, a peak area indicating by a hatching in FIG. 21, i.e., an integrated value thereof corresponds a total charge of the removed toner particles just after the cleaning voltage is applied to the roller.

Figure 22A:
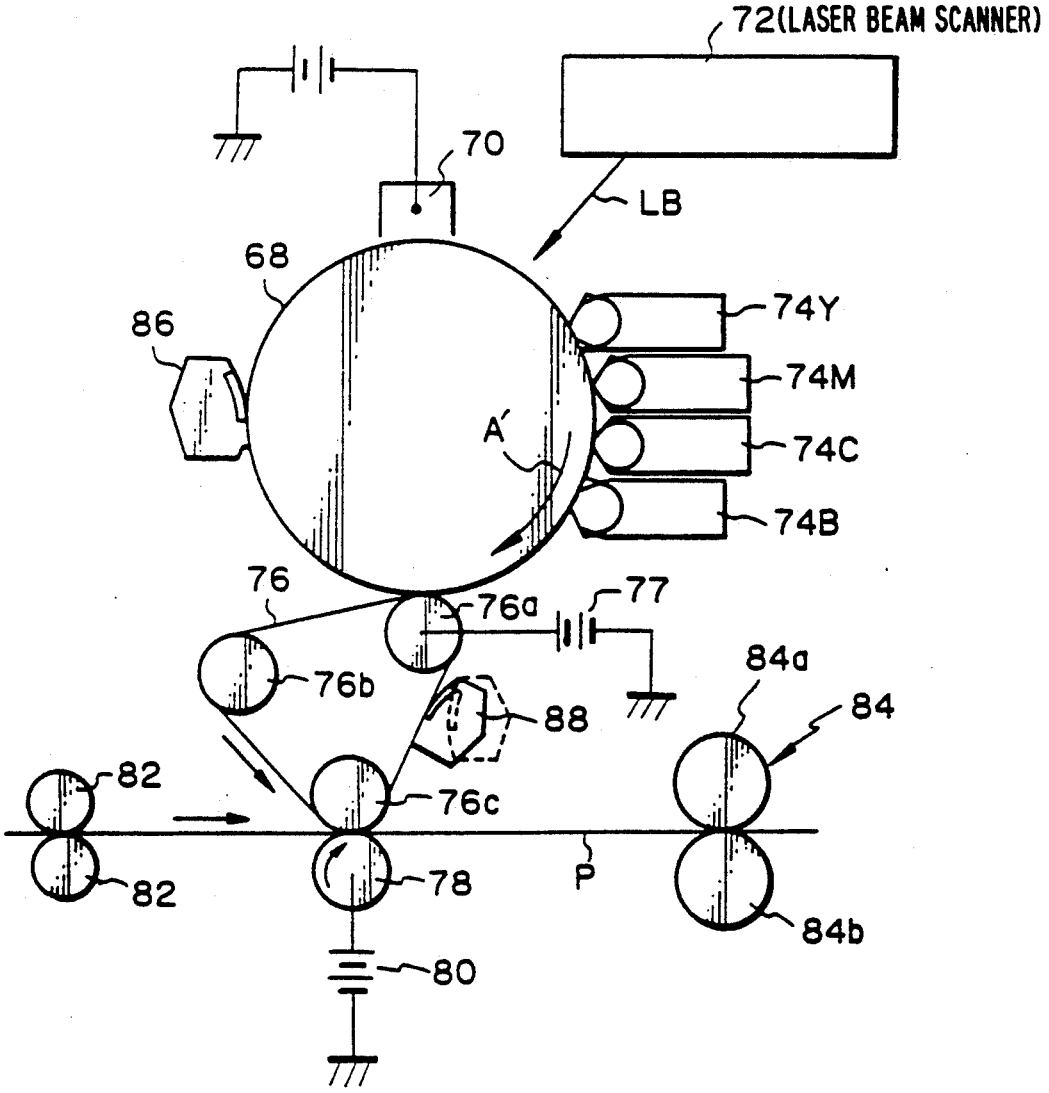
FIG. 22(*a*) is a schematic view of a full color laser printer in which the conductive roller type toner image transferring device according to the present invention is used.
Figure 22B:
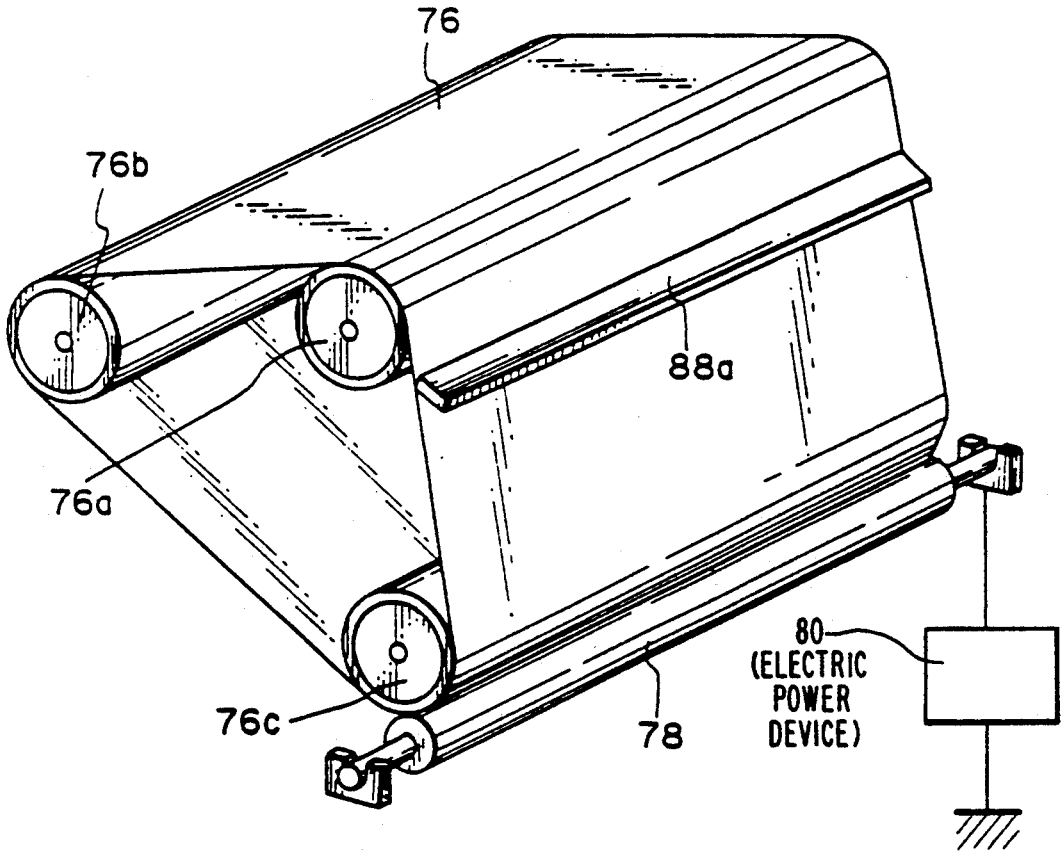

FIGS. 22(*a*) and 22(*b*) show, by way of example, a full color laser printer in which a conductive roller type transfer device according to the present invention may be incorporated. This color printer comprises a first toner image carrying body or photosensitive drum 68 substantially formed in the same manner as the drum 10. During an operation of the printer, the drum 68 is rotated in a direction as indicated by an arrow A', and a corona discharger 70 gives electric charges to a surface of the drum 68 to produce a uniform distribution of the charges thereon. A laser beam scanner 72 emits a laser beam LB, and writes a latent image on the charged area of the drum surface in the same manner as the laser beam scanner 14.

The color printer also comprises four developing devices 74Y, 74M, 74C, and 74B in which yellow toner, magenta, cyan, and black developers are held, respectively, and which are supported such that each device is movable between a developing position at which a developing roller thereof is pressed against the drum 68 and a non-developing position at the developing roller is separated therefrom. A second toner image carrying body or an endless belt 76 is entrained on three rollers 76*a*, 76*b*, and 76*c*, and is in contact with the drum 68 at the roller 76*b*. The endless belt 76 may be formed of a conductive synthetic resin material such as a conductive polycarbonate resin material, and the roller 76a is formed of a suitable metal material or a conductive rubber material and is connected to an electric voltage source 77.

As best shown in FIG. 22(*b*), a conductive transfer roller 78 of the transfer device according to the present invention is provided to be pressed against the roller 76c via the endless belt 76, and is formed and supported in substantially the same manner as the roller 18. The conductive transfer roller 78 is connected to an electric power device 80 which is preferably constituted in the same manner as the electric power device 66 of FIG. 20(*a*). Note, during the operation of the printer, the endless belt 76 and the conductive transfer roller 78 are rotated as indicated by arrows in FIG. 22(*a*).

The printer further comprises a pair of register rollers 82, 82 for feeding a paper P to be printed toward the conductive transfer roller 78 in a direction indicated by an arrow in FIG. 22(*a*), and a toner image fixing device 84 having a heat roller 84a and a backup roller 84b. Note, the rollers 82, 82 and the toner image fixing device 84 may be constructed in substantially the same manner as the rollers 32, 32, and the toner image fixing device 24, respectively.

Furthermore, the printer is provided with a toner cleaner 86 for the drum 68, which serves in the same manner as the toner cleaner 22, and a toner cleaner 88 for the endless belt 76, which is movable between an cleaning position shown by a solid line and a non-cleaning position shown by a broken line in FIG. 22(*a*). Note, in FIG. 22(*b*), reference 88a indicates a scraper blade 88a of the toner cleaner 88 for the endless belt 76.

In operation, a latent image is written on a charged area of the drum 68 by the laser beam scanner 72 on the basis of yellow image data, and is then developed with the yellow toner by the developing device 74Y moved to the developing position. Note, the other developing devices 74M, 74C, and 74B are in the non-developing positions, respectively. The developed yellow toner image is transferred from the drum 68 to the endless belt 76 by applying a transfer voltage from the electric source 77 to the roller 76a. Thereafter, a latent image is written on a charged area of the drum 68 by the laser beam scanner 72 on the basis of magenta image data, and is then developed with the magenta toner by the developing device 74M. This developed magenta toner image is also transferred from the drum 68 to the endless belt 76 in the same manner as the yellow toner image, and thus the magenta toner image is superimposed on the yellow toner image transferred to the endless belt 76. In a similar manner, cyan and black toner images are formed on the drum 68 by the developing devices 74C and 74B, and are successively superimposed on the yellow and magenta toner images, and thus full color toner images are produced on the endless belt 76. Then, the full color toner image is transferred from the endless belt 76 to the paper by applying a transfer voltage from the electric power device 80 to the paper P. Note, the toner cleaner 88 is in the non-cleaning position during the transfer of the toner images to the endless belt 76, and is moved to the cleaning position after the transfer of the full color toner image to the paper.

Note, since the conductive transfer roller 78 is given a resistivity of more than $10^7$ Ωcm, during the transfer of the full color toner image to the paper, a toner transfer efficiency of more than 75% can be obtained regardless of a size of the paper. Also, since the conductive transfer roller 78 is cleaned in substantially same manner as mentioned above, a color toner stain cannot be left on a rear surface of the paper during the full color toner image transferring process.

Finally, it will be understood by those skilled in the art that the foregoing description is of preferred embodiments of the present invention, and that various changes and modifications can be made without departing from the spirit and scope thereof.

We claim:

1. A toner image transferring device for electrostatically transferring a charged toner image electrostatically held by a toner image carrying body means to a sheet or paper, which comprises, a conductive elastic transfer roller means having a resistivity of more than $10^7$ Ωcm and disposed in contact with said toner image carrying body means to form a nip therebetween for passing the sheet or paper; and an electric source means for applying a substantially constant current output, which has a current of about from 5 to about 15 μa as an absolute value, to said conductive elastic transfer roller means so as to give the sheet or paper an electric charge having a polarity opposite to that of a charge of the toner image, during passage of the sheet or paper through the nip between said toner image carrying body means and said conductive elastic transfer roller means, whereby the charged toner image can be transferred from said toner image carrying body means to the sheet or paper at a desired toner transfer efficiency regardless of a size of the paper or sheet.

2. A toner image transferring device as set forth in claim 1, wherein the resistivity of said conductive elastic transfer roller means is preferably from about $10^8$ to about $10^{11}$ Ωcm.

3. A toner image transferring device as set forth in claim 1, wherein said electric source means is constituted such that the constant current output thereof has a voltage of less than 3k volts.

4. A toner image transferring device as set forth in claim 1, wherein the constant current output of said electric source means is variable within an absolute range of about 2 μA.

5. A toner image transferring device as set forth in claim 1, wherein said conductive elastic transfer roller means is formed of a conductive foam rubber material.

6. A toner image transferring device for electrostatically transferring a charged toner image electrostatically held by a toner image carrying body means to a sheet or paper, which comprises:

a conductive elastic transfer roller means disposed in contact with said toner image carrying body means to form a nip therebetween for passing the sheet or paper; and an electric source means for selectively applying a first electric energy and a second electric energy to said conductive elastic transfer roller means, said first electric energy giving the sheet or paper an electric charge having a polarity opposite to that of a charge of the toner image, during passage of the sheet or paper through the nip between said toner image carrying body means and said conductive elastic transfer roller means, whereby the charged toner image can be transferred from said toner image carrying body means to the sheet or paper, said second electric energy giving said conductive elastic transfer roller means an electric charge having the same polarity as the charge of the toner image, whereby a toner pollution of said conductive elastic transfer roller means can be electrostatically removed therefrom, wherein said conductive elastic transfer roller means being formed of a conductive foam rubber material such that pore openings appear over a surface of said conductive elastic transfer roller means, whereby a residual part of the toner pollution of said conductive elastic transfer roll means can leave no stain on a rear surface of the sheet or paper during the passage of the sheet or paper through the nip between said toner image carrying body means and said conductive elastic transfer roller means, and wherein said electric source means includes a constant current source having a substantially constant current output as said first electric energy, and a constant voltage source having a substantially constant voltage output as said second electric energy.

7. A toner image transferring device as set forth in claim 6, wherein said conductive foam rubber material has a closed cell foam structure.

8. A toner image transferring device as set forth in claim 6, wherein an electric potential of said toner image carrying body means is substantially maintained at zero during the application of said constant voltage output to said conductive elastic transfer roller means.

9. A toner image transferring device as set forth in claim 6, wherein the application of said constant voltage output to said conductive elastic transfer roller means is continued over a time necessary for rotating said conductive elastic transfer roller means at least five times, whereby the removal of the toner pollution can be effectively carried out.

10. A toner image transferring device as set forth in claim 9, wherein after the application of said constant voltage output to said conductive elastic transfer roller means is finished, said conductive elastic transfer roller means is subjected to an application of a voltage output having a polarity opposite to that of said constant voltage output over a time necessary for rotating said conductive elastic transfer roller means at least one time.

11. A toner image transferring device as set forth in claim 10, wherein said voltage output having the polarity opposite to that of said constant voltage output is derived from said constant current source.

12. A toner image transferring device as set forth in claim 6, wherein said conductive foam rubber material has a resistivity of more than $10^{7}$ Ωcm.

13. A toner image transferring device as set forth in claim 12, wherein the resistivity of said conductive elastic transfer roller means is preferably from about $10^{8}$ to about $10^{11}$ Ωcm.

14. A toner image transferring device as set forth in claim 12, wherein said constant current source is constituted such that the constant current output thereof has a voltage of less than 3k volts.

15. A toner image transferring device as set forth in claim 12, wherein the constant current output of said constant current source has a current of about from 5 to about 15 μA as an absolute value, and the constant voltage output of said constant voltage source has a voltage of about from 400 to about 1500 volts as an absolute value.

16. A toner image transferring device as set forth in claim 15, wherein the constant current output of said constant current source is variable within an absolute range of about 2 μA, and the constant voltage output of said constant voltage source is variable within an absolute range of about 100 volts.

17. A toner image transferring device as set forth in claim 6, wherein said electric source means includes a single current source capable of selectively generating one of a substantially constant current output as said first electric energy and a constant voltage source having a substantially constant voltage output as said second electric energy.

18. A toner image transferring device as set forth in claim 17, wherein an electric potential of said toner image carrying body means is maintained at substantially zero during the application of said constant voltage output to said conductive elastic transfer roller means.

19. A toner image transferring device as set forth in claim 17, wherein the application of said constant voltage output to said conductive elastic transfer roller means is continued over a time necessary for rotating said conductive elastic transfer roller means at least five times, whereby the removal of the toner pollution can be effectively carried out.

20. A toner image transferring device as set forth in claim 19, wherein after the application of said constant voltage output to said conductive elastic transfer roller means is finished, said conductive elastic transfer roller means is subjected to an application of a voltage output having a polarity opposite to that of said constant voltage output over a time necessary for rotating said conductive elastic transfer roller means at least one time.

21. A toner image transferring device as set forth in claim 20, wherein said voltage output having the polarity opposite to that of said constant voltage output is derived from said constant current source.

22. A toner image transferring device as set forth in claim 17, wherein said conductive foam rubber material has a resistivity of more than $10^{7}$ Ωcm.

23. A toner image transferring device as set forth in claim 22, wherein the resistivity of said conductive elastic transfer roller means is preferably from about $10^{8}$ to about $10^{11}$ Ωcm.

24. A toner image transferring device as set forth in claim 22, wherein said electric source means is constituted such that the constant current output thereof has a voltage of less than 3k volts.

25. A toner image transferring device as set forth in claim 22, wherein the constant current output of said electric source means has a current of about from 5 to about 15 μA as an absolute value, and the constant voltage output of said electric source means has a voltage of about from 400 to about 1500 volts as an absolute value.

26. A toner image transferring device as set forth in claim 23, wherein the constant current output of said electric source means is variable within an absolute range of about 2 μA, and the constant voltage output of said electric source means is variable within an absolute range of about 100 volts.

27. An electrophotographic recording apparatus comprising:

a photosensitive body means on which an electrically charged area can be produced;

an optical writing means for optically writing a latent image on the charged area of said photosensitive body means;

a toner developing means for electrostatically developing said latent image with an electrically charged toner to form a charged toner image thereon;

a conductive elastic transfer roller means disposed in contact with said photosensitive body means to form a nip therebetween for passing a sheet or paper; and an electric source means for selectively applying a first electric energy and a second electric energy to said conductive elastic transfer roller means, said first electric energy giving the sheet or paper an electric charge having a polarity opposite to that of a charge of the toner image, during passage of the sheet or paper through the nip between said photosensitive body means and said conductive elastic transfer roller means, whereby the charged toner image can be transferred from said photosensitive body means to the sheet or paper, said second electric energy giving said conductive elastic transfer roller means an electric charge having the same polarity as the charge of the toner image, whereby a toner pollution of said conductive elastic transfer roller means can be electrostatically removed therefrom, wherein an electric potential of said photosensitive body means is maintained at substantially zero by said optical writing means during the application of said second electric energy to said conductive elastic transfer roller means for the removal of the toner pollution therefrom.

28. An electrophotographic recording apparatus as set forth in claim 27, further comprising means for preventing the charged toner of said developing means from coming into contact with said photosensitive body means.

* * * * *

UNITED STATES PATENT AND TRADEMARK OFFICE

CERTIFICATE OF CORRECTION

PATENT NO. : 5,331,383

DATED : July 19, 1994

INVENTOR(S) : NOU et al.

It is certified that error appears in the above-indentified patent and that said Letters Patent is hereby corrected as shown below:

Col. 9, line 28, change "n" to --$\eta$--;
line 36, delete "H";
line 37, delete "35";
line 48, change "⅔$\mu$m" to --170 $\mu$m--.

Col. 11, line 46, change "○" to --◎--.

Col. 13, line 13, delete "30".

Col. 28, line 21, change "$\mu$a" to --$\mu$ A--.

Signed and Sealed this

Twenty-ninth Day of November, 1994

Bruce Lehman

*Attest:*

BRUCE LEHMAN

*Attesting Officer*

*Commissioner of Patents and Trademarks*